US012071754B2

(12) United States Patent
Heipp et al.

(10) Patent No.: US 12,071,754 B2
(45) Date of Patent: Aug. 27, 2024

(54) BATH WASTE AND OVERFLOW SYSTEMS AND METHODS OF USE

(71) Applicant: Oatey Co., Cleveland, OH (US)

(72) Inventors: Shawn Heipp, Strongsille, OH (US); Kenneth Brown, Columbia Station, OH (US); Douglas Buchan, Seville, OH (US); Joshua Funk, Strongsville, OH (US); Aaron Lorkowski, North Ridgeville, OH (US); Kai Zhang, Cleveland, OH (US)

(73) Assignee: Oatey Co., Cleveland, OH (US)

( * ) Notice: Subject to any disclaimer, the term of this patent is extended or adjusted under 35 U.S.C. 154(b) by 769 days.

(21) Appl. No.: 17/314,284

(22) Filed: May 7, 2021

(65) Prior Publication Data

US 2021/0262210 A1 Aug. 26, 2021

Related U.S. Application Data

(62) Division of application No. 15/959,664, filed on Apr. 23, 2018, now Pat. No. 11,001,996.
(Continued)

(51) Int. Cl.
*E03C 1/232* (2006.01)
*E03C 1/23* (2006.01)
*E03C 1/24* (2006.01)

(52) U.S. Cl.
CPC ..... *E03C 1/232* (2013.01); *E03C 1/2306* (2013.01); *E03C 1/24* (2013.01)

(58) Field of Classification Search
CPC ..... E03C 1/24; E03C 1/232
(Continued)

(56) References Cited

U.S. PATENT DOCUMENTS 4,581,781 A 4/1986 Ebert
5,890,241 A 4/1999 Ball
(Continued)

FOREIGN PATENT DOCUMENTS

CA 2325514 A1 3/2002
CA 2481693 A1 4/2004
(Continued)

OTHER PUBLICATIONS

U.S. Appl. No. 15/959,664, filed Apr. 23, 2018.

*Primary Examiner* — Lauren A Crane
(74) *Attorney, Agent, or Firm* — BakerHostetler

(57) ABSTRACT

A bath waste and overflow drain system of the present disclosure may comprise both drain and overflow assemblies. The drain assembly generally includes a drain elbow, drain gasket, drain spud, drain trim, and drain stopper. The drain trim may possess weep channels that urge stagnated water from a periphery of the drain spud and into the drain. The overflow assembly generally includes an overflow elbow, overflow gasket, retaining nut, and overflow faceplate. The overflow faceplate may have bayonet channels that engage with a protrusion of the overflow elbow so as to accommodate variances in tub design when effecting an installation. The system according to an embodiment may also comprise test plugs of the overflow and drain varieties which are, together, operable to permit pressure-related tests of the system prior to completing an installation. The overflow and drain test plugs are simple to manipulate and install/remove with quick-engaging, complementary locking features.

24 Claims, 36 Drawing Sheets

Related U.S. Application Data

(60) Provisional application No. 62/489,750, filed on Apr. 25, 2017.

(58) Field of Classification Search
USPC ..... 4/688, 694
See application file for complete search history.

(56) References Cited

U.S. PATENT DOCUMENTS

| | | | |
|---|---|---|---|
| 6,073,278 | A | 6/2000 | Ball |
| 6,138,298 | A | 10/2000 | Ball |
| 6,192,531 | B1 | 2/2001 | Fritz et al. |
| 6,546,573 | B1 | 4/2003 | Ball |
| 6,588,454 | B1 | 7/2003 | Johnson et al. |
| 6,681,420 | B1 | 1/2004 | Ball |
| 6,687,926 | B1 | 2/2004 | Bayley |
| 6,845,528 | B2 | 1/2005 | Bantz |
| 6,901,611 | B2 | 6/2005 | McEntire et al. |
| 7,055,184 | B2 | 6/2006 | Humber |
| 7,122,117 | B1 | 10/2006 | Goldring et al. |
| 7,155,184 | B2 | 12/2006 | Kim |
| 7,237,280 | B1 | 7/2007 | Holden et al. |
| 7,451,502 | B2 | 11/2008 | Ball |
| 7,624,759 | B1 | 12/2009 | Ismert et al. |
| 8,028,357 | B2 | 10/2011 | Ball |
| 8,336,132 | B2 | 12/2012 | Ball et al. |
| 8,505,132 | B2 | 8/2013 | Ball |
| 8,756,724 | B1 | 6/2014 | Lordahl et al. |
| 8,769,736 | B2 | 7/2014 | Ball |
| 8,782,824 | B2 | 7/2014 | Shoop et al. |
| 9,045,886 | B2 | 6/2015 | Ball et al. |
| 9,074,358 | B2 | 7/2015 | Ball et al. |
| 9,157,220 | B2 | 10/2015 | Ball et al. |
| 9,435,109 | B2 | 9/2016 | Ball et al. |
| 9,453,329 | B2 | 9/2016 | Ball |
| 2004/0025249 | A1 | 2/2004 | Berry et al. |
| 2004/0034926 | A1 | 2/2004 | Ball |
| 2004/0055083 | A1 | 3/2004 | Ball |
| 2004/0055084 | A1 | 3/2004 | Ball |
| 2006/0085907 | A1 | 4/2006 | Ball |
| 2008/0196161 | A1 | 8/2008 | Ball |
| 2015/0089736 | A1 | 4/2015 | Bird et al. |
| 2015/0152627 | A1* | 6/2015 | Ball ..... E03C 1/24 4/680 |
| 2016/0281341 | A1 | 9/2016 | Seckler et al. |
| 2017/0009439 | A1 | 1/2017 | Ball |
| 2017/0073949 | A1 | 3/2017 | Karnegie |

FOREIGN PATENT DOCUMENTS

| | | | |
|---|---|---|---|
| CA | 2633165 | A1 | 11/2009 |
| CA | 2648129 | A1 | 6/2010 |

* cited by examiner

BATH WASTE AND OVERFLOW SYSTEMS AND METHODS OF USE

CROSS-REFERENCE TO RELATED APPLICATIONS

This application is a Divisional of U.S. Ser. No. 15/959,664, filed Apr. 23, 2018, which claims the benefit of U.S. Provisional Application No. 62/489,750, filed on Apr. 25, 2017, the disclosure of which is incorporated herein by reference in its entirety.

TECHNICAL FIELD

The present disclosure relates to a design for bath waste and overflow assemblies to provide drainage from bathtubs and other devices. The disclosure also relates to methods of installing the plumbing attachment systems, as well as to methods of performing pressure-related testing.

BACKGROUND

Conventional bath waste and overflow systems are designed to provide fluid drainage from a bathtub, or other liquid-holding tank, and into a drain pipe. Typical systems include both overflow and drain aspects to provide drainage, respectively, from an overflow port and a drain port of the tub, and directing this water (or other fluid medium) out of the bathtub and into a central drainage system (such as a septic system or public sewage disposal system). The overflow aspects of existing systems permit the drainage of water when the water level exceeds a predetermined height in the tub, i.e., to prevent the water from overflowing. The drain aspects of existing systems allow a user to control whether the bathtub will retain water when the drain is sealed off (for example, using a common drain stopper or plug) or to drain the water when the drain is unsealed.

Particularly in new plumbing installations, such as in new construction, a plumber will typically run a pressurized leak test of the plumbing lines before installing the entire bath waste and overflow system in the bathtub. In that respect, plumbers will use conventional means to plug (or otherwise seal) the drain and overflow portions. Traditional pressure test plugs are somewhat crude and require time to install and remove to effectuate a proper pressure test. In most applications, traditional plugs are designed to be fitted with (and thereby sealed to) the bath waste and overflow devices themselves, rather than to the pipes. Thus, the testing requires partial assembly (or even disassembly) of these known drain and overflow devices to run this pressure test, which requires additional time and labor.

Existing waste and overflow systems are bulky and wrought with problems, including time-consuming installations, leaks/failures, rust buildup due to water-pooling near the drain, clogs in the drain, and time-consuming repairs/replacements of the overflow and drain aspects when the same becomes necessary. These problems are exacerbated in large dwellings and multi-unit apartment complexes, where hundreds or thousands of drain/overflow installations must be made at the time of construction/renovation and must be serviced throughout their lifespan. An improved waste and overflow system is desired to address these concerns and provide a plumber (or other user) with a convenient, simple, and aesthetically pleasing system that is quick and easy to install as well as to repair/replace should the need arise. With respect to existing pressure-testing devices and methods, pressure test plugs/seals are crude and time consuming to install and remove before and after the test is complete.

SUMMARY OF THE INVENTION

According to a first aspect, a bath waste and overflow system is disclosed for attachment to a bathtub and to provide drainage therefrom along a first fluid flow path. The system may comprise an overflow elbow pipe, a retaining nut, and an overflow faceplate. The overflow elbow pipe may be configured to be attached to an overflow port of the bathtub, and the overflow elbow pipe may also include an externally threaded neck portion. The retaining nut may have an internally threaded portion that is complementary with the externally threaded neck portion of the overflow elbow pipe, previously described. The retaining nut may be configured to engage the overflow elbow pipe so as to retain the bathtub in between the retaining nut and the overflow elbow pipe. The overflow faceplate may be configured to conceal the retaining nut and to abut an inner wall of the bathtub about the overflow port. The faceplate may include a central hollow portion and an outer hollow portion separated from the central hollow portion by a partition wall, and the partition wall may include a helical channel that is configured to receive a projection of the overflow elbow pipe. In an aspect, guiding the projection through the helical channel may adjust a distance between the overflow elbow pipe and the overflow faceplate.

The system according to the first aspect may further comprise a drain assembly for attachment to a drain port of the bathtub to provide drainage therefrom along a second fluid flow path. The drain assembly may include a drain elbow pipe, a drain spud, and a drain trim. The drain elbow pipe may be positioned adjacent the drain port along an exterior of the bathtub. The drain spud may be inserted into and engaged with the drain elbow from an interior of the bathtub that is opposite the exterior previously described. The drain spud may be configured to be inserted into the drain elbow along an insertion direction. The drain trim may be inserted into and engaged with the drain spud, also substantially along the insertion direction. The term "substantially" is intended to mean considerable in extent or largely but not necessarily wholly that which is specified.

A bath waste and overflow system for attachment to a bathtub, according to another aspect is disclosed. The system may comprise a drain elbow pipe, a drain spud, and a drain trim. The drain elbow pipe, may be configured to be attached to a drain port of the bathtub, and the drain elbow pipe may include an internally threaded opening. The drain spud may have an externally threaded surface that is complementary to the internally threaded opening of the drain elbow pipe, and the drain spud may be configured to engage the drain elbow pipe so as to retain the bathtub therebetween. The drain spud may additionally have at least one locking feature circumferentially disposed on an inner drain spud surface that is opposite the externally threaded surface, and the at least one locking feature may include a drain spud projection. The drain trim may have a complementary locking feature circumferentially disposed on an exterior surface thereof, and the locking feature may define a drain trim channel that is configured to receive the drain spud projection (previously described) therein. As a result, the drain trim may be releasably locked to the drain spud.

The system according to this aspect may further include a drain stopper that is operable with the drain trim and which is selectively moveable between an open position and a closed position. Generally speaking, the open position allows for the drainage of water along a fluid flow path, and the closed position prevents the drainage of water along the fluid flow path. The stopper may generally include a body, a top seal element, and a bottom seal element. The body may be elongate along a central axis from a first end to a second end, and the body may have a cylindrical outer wall that includes a plurality of circumferentially spaced holes about the central axis. The top seal element may be disposed at the first end of the body and it may seal a central portion of the drain port (such central portion being substantially aligned with the central axis) when the stopper is in the closed configuration. The bottom seal element may be disposed at the second end of the body and it may seal a peripheral portion of the drain port that is spaced from the central axis. The bottom seal element may be disposed downstream of the top seal element along the fluid flow path.

In accordance with another aspect, a drain stopper is disclosed that may permit the selective opening and closing of a drain port in a bathtub so as to allow for the drainage of water therethrough (i.e., out of the bathtub) along a fluid flow path. The stopper in accordance with this aspect may comprise a hollow cylindrical body, a top seal element, and bottom seal element. The hollow cylindrical body may extend about a central axis from a first end to a second end, and the body may include a plurality of holes circumferentially disposed about the body. The holes may be in fluid communication with a central portion of the drain port, and the body may be both rotatable about the central axis and selectively translatable along the central axis within the drain port between an open configuration and a closed configuration. The top seal element may be disposed at the first end of the body and it may selectively seal the central portion when the body is in the closed configuration and it may permit drainage from the bathtub and through the central portion (i.e., along the fluid flow path) when the body is in the open configuration. The bottom seal element may be disposed at the second end of the body and it may selectively seal a peripheral portion of the drain port at a location downstream of the top seal element when the body is in the closed configuration and it may permit drainage from the bathtub through the peripheral portion of the drain port (i.e., along the fluid flow path) when the body is in the open configuration.

In accordance with still another aspect, a testing system is disclosed that may be used to perform a pressure test on a bath waste and overflow system that is attached to a bathtub. The testing system may comprise an overflow elbow, a drain elbow, a drain spud, an overflow test plug, and a drain test plug. The overflow elbow may be associated with an overflow port of the bathtub. The drain elbow may be associated with a drain port of the bathtub. The drain spud may be insertable into the drain elbow. The overflow test plug may be insertable into the overflow elbow and it may have a locking feature that is connectable to a projection element of the overflow elbow so as to form a fluid tight seal between a sealing element of the overflow test plug and an interior surface of the overflow elbow. In one aspect, the locking feature may include at least one helical track through which the projection may be guided. The drain test plug may be insertable into the drain spud and it may have a channel that is configured to rotatably receive a projection element of the drain spud so as to form a fluid tight seal between a sealing feature of the drain test plug and a top surface of the drain spud.

In accordance with another aspect, a bath waste and overflow system for attachment to a bathtub is disclosed. The system may include a drain elbow pipe, a drain spud, and a drain trim having weep drain channels. The drain elbow pipe may be associated with a drain port of the bathtub and it may provide drainage from the bathtub along a fluid flow direction. The drain spud may be partially insertable into an opening in the drain elbow pipe, and the drain spud may include a flange disposed about an outer drain spud surface that is opposite the inner surface. The drain trim may be partially insertable into the drain spud along the inner surface thereof, and the drain trim may have a drain trim flange that is circumferentially disposed about an exterior surface of the drain trim. The drain trim flange may include a plurality of the weep drain channels that urge stagnated water at a periphery of the drain trim flange through the weep channels and into the drain port of the bathtub.

In accordance with another aspect, a method of installing a bath waste and overflow system to a bathtub is also disclosed. The installation method according to this aspect may comprise the following steps. The method may include a step of inserting a threaded neck portion of an overflow elbow through an overflow port of the bathtub from an exterior of the bathtub. Another step may involve tightening a retention nut onto the threaded portion from an interior of the bathtub opposite the exterior of the bathtub, where such tightening creates a leak-proof seal between the bathtub and the overflow elbow. The method may continue by introducing an overflow faceplate over the retention nut so as to engage a channel of the overflow faceplate with a locking feature on an interior portion of the neck portion. A further step may include rotating the overflow faceplate to cause the locking feature to ride along the channel and thereby reduce a distance between the overflow faceplate and the overflow elbow.

The method may additionally include the step of positioning a drain elbow adjacent a drain port in the bathtub from the exterior. Another step may involve attaching a drain spud to the drain elbow from the interior of the bathtub and through the drain port. The method may continue by locking a drain trim into the drain spud by 1) engaging a locking feature in an interior of the drain spud with a receiving channel on an exterior of the drain trim, and 2) rotating the drain trim relative to the drain spud. A further step may include engaging a drain stopper with the drain trim such that the drain stopper may be actuated between a closed configuration and an open configuration. The open configuration may be defined as when the drain stopper creates a leak-proof seal with the drain trim to prevent fluid drainage from the bathtub. The open configuration may be defined as when the drain stopper is unsealed from the drain trim and fluid may drain from the bathtub through the drain trim along a fluid flow direction.

In still further aspects, a method of performing a pressure test on a bath waste and overflow system that is attached to a bathtub may be disclosed. The method may comprise the following steps.

The method of performing the pressure test may include a step of installing an overflow test plug, which may further include sub-steps. A sub-step may include securing the overflow test plug to an overflow elbow that extends through an overflow port of the bathtub, where the securing sub-step is performed by engaging a channel of the overflow test plug with a locking feature on an interior portion of the overflow elbow. Another sub-step may include rotating the overflow test plug relative to the overflow elbow to cause the locking feature to ride along the channel. This sub-step will cause and force a sealing feature of the overflow test plug to bear against the interior portion of the overflow elbow, thereby forming a leak-proof seal between the overflow test plug and the overflow elbow.

The method of performing the pressure test may also include a step of connecting a drain test plug, which may further include sub-steps. A sub-step may include mounting the drain test plug to a drain spud extending through a drain port of the bathtub by aligning a projection of the drain spud with a complementary channel of the drain test plug. Another sub-step may include turning the drain test plug relative to the drain spud to cause the projection of the drain spud to reside within the complementary channel. The turning sub-step may cause a sealing element of the drain test plug to bear against an upper surface of the drain spud, thereby forming a leak-proof seal between the drain test plug and the drain spud.

The method of performing the pressure test may further include the step of testing the system by increasing the pressure.

BRIEF DESCRIPTION OF THE DRAWINGS

FIG. 1D is a detailed perspective, cross-sectional view of an overflow portion of the system illustrated in FIG. 1C, such cross-section being taken along lines 1C-1C, as shown in FIG. 1A.

DETAILED DESCRIPTION

The bath waste and overflow system of the present disclosure is configured to replace existing bath waste systems by providing a complete attachment system that includes complementary pressure-testing components for ease of routine testing and for ease of final installation of the finishing components following said testing. In that respect, the system disclosed here includes both testing aspects (including, but not limited to, test plugs) as well as final installation aspects (including, but not limited to, a drain stopper and an overflow faceplate). Although both aspects and methods of using the same will be described in greater detail below, it is generally noted that the components of the system easily cooperate with one another to permit quick and easy assembly and disassembly without the need for plumbing tools.

Figure 1A:
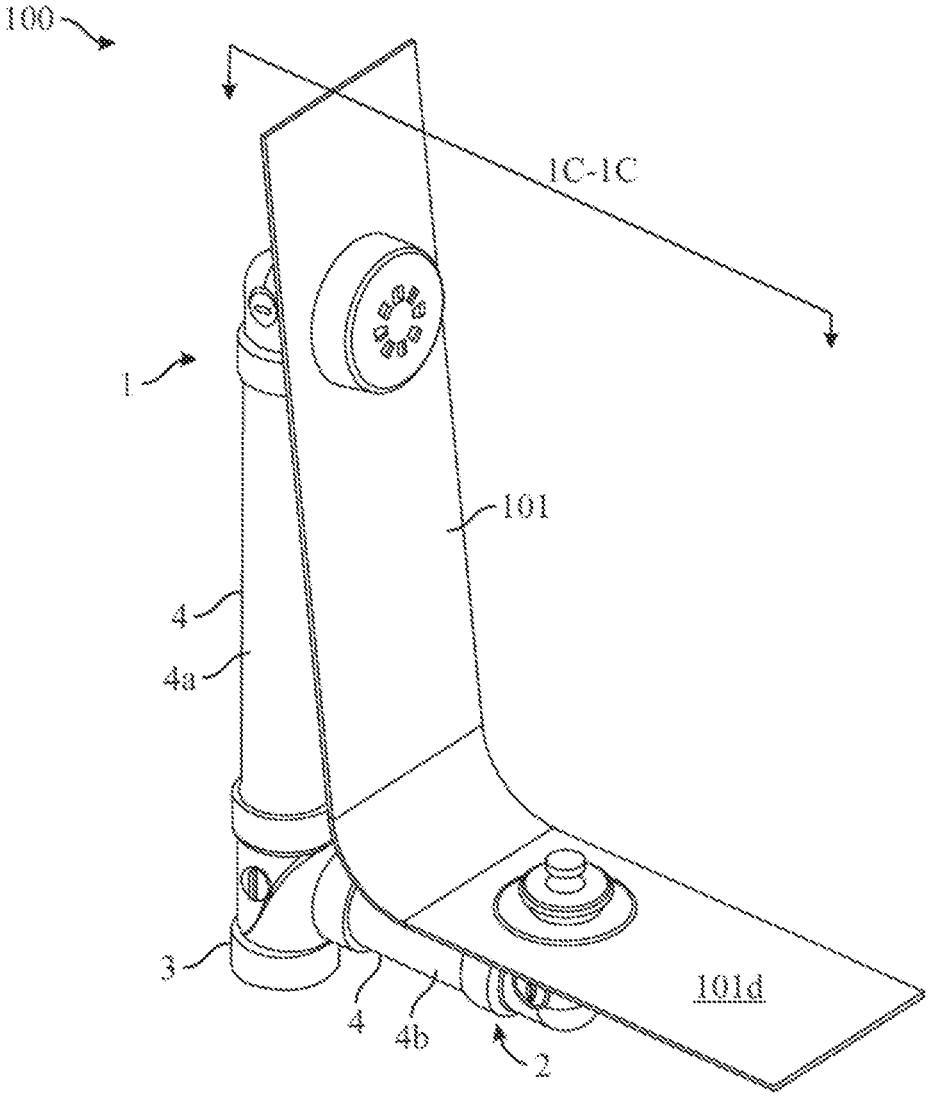
FIG. 1A is a front perspective view of a bath waste and overflow system according to an embodiment of the invention, the system being installed to a tub.
Figure 1B:
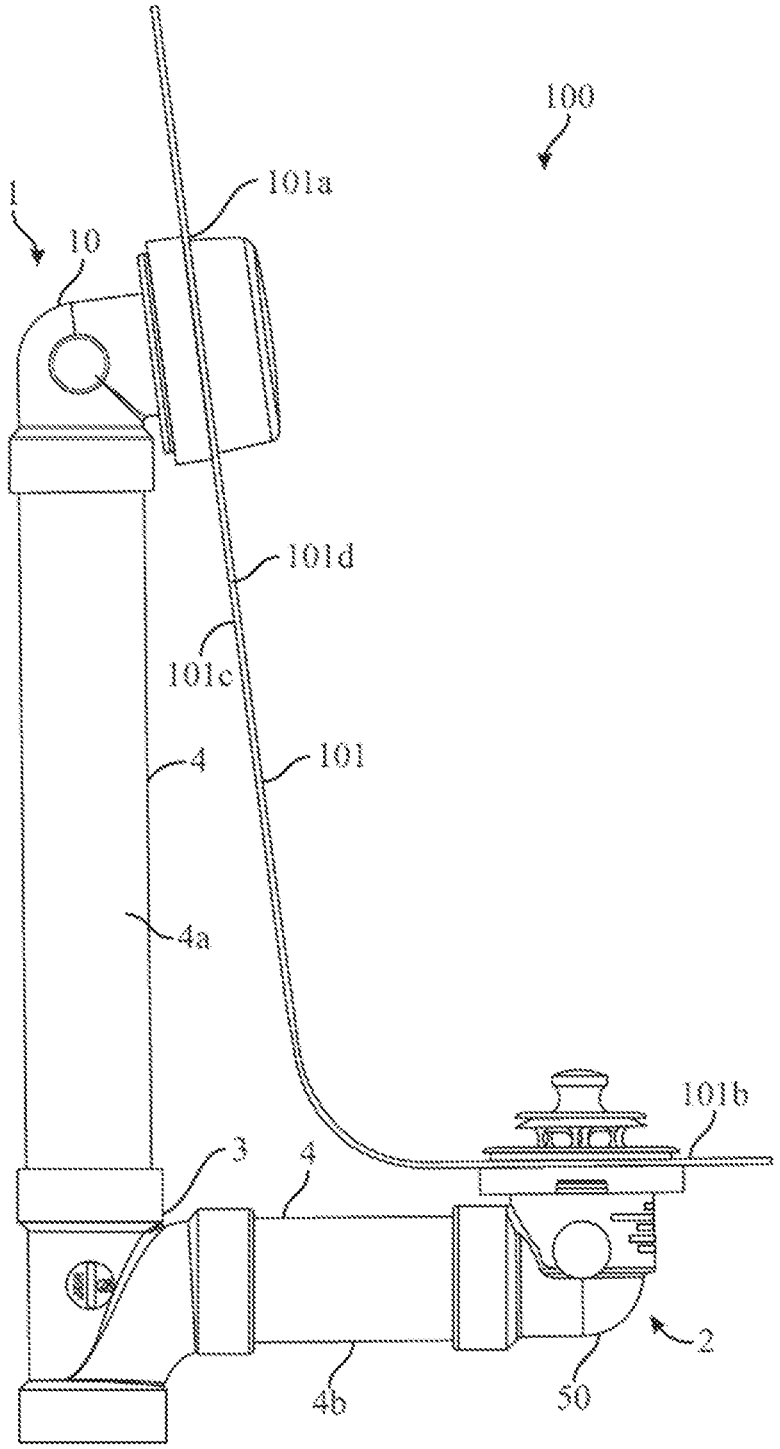
FIG. 1B is a side plan view of the system illustrated in FIG. 1A.

FIGS. 1A and 1B illustrate a bath waste and overflow system (100) according to an embodiment of the invention. As shown, the system (100) is attached and mounted directly to a bathtub (101), which is partially illustrated for purposes of clarity. As one of skill in the art will appreciate, typical bathtub installations will provide for both overflow and waste/drain connections which together direct water away from the tub and into a main drain system, terminating in, e.g., a septic system or public sewage system. To capture water from both the overflow and drain aspects of the bathtub (101), a plumber will split the drain line (not illustrated) into two ends by using a conventional sanitary tee pipe (3). To the tee pipe (3), extension pipes (4) may extend toward the respective locations of an overflow port (101*a*) and drain port (101*b*) in the bathtub (101). The ports (101*a*, 101*b*) extend through the bathtub (101) from an outer wall (101*c*) to an inner wall (101*d*) along respective port axes ($P_1$, $P_2$), and they are sized and configured to receive overflow and drain components that will place the interior of the bathtub (101) in fluid communication with the main drain system. Accordingly, the overflow port (101*a*) is disposed in a side-wall of the bathtub (101) while the drain port (101*b*) is disposed in a bottom-wall of the bathtub (101).

The system (100) generally includes an overflow assembly (1) and a drain assembly (2) that each connect respective ones of the extension pipes (4) to the bathtub (101), as noted above. With particular reference to FIG. 1B, a first extension pipe (4*a*) extends from the tee (3) to an overflow elbow pipe (10) of the overflow assembly (1) adjacent the overflow port (101*a*), and a second extension pipe (4*b*) extends from the tee (3) to a drain elbow pipe (50) of the drain assembly (2) adjacent the drain port (101*b*). As shown, the drain elbow (50) is positioned adjacent the drain port (101*b*) on an exterior of the bathtub (101), and a portion of the overflow elbow (10) is inserted through the overflow port (101*a*) from the exterior of the bathtub and into an interior of the bathtub (101) that is opposite the exterior.

Figure 1C:
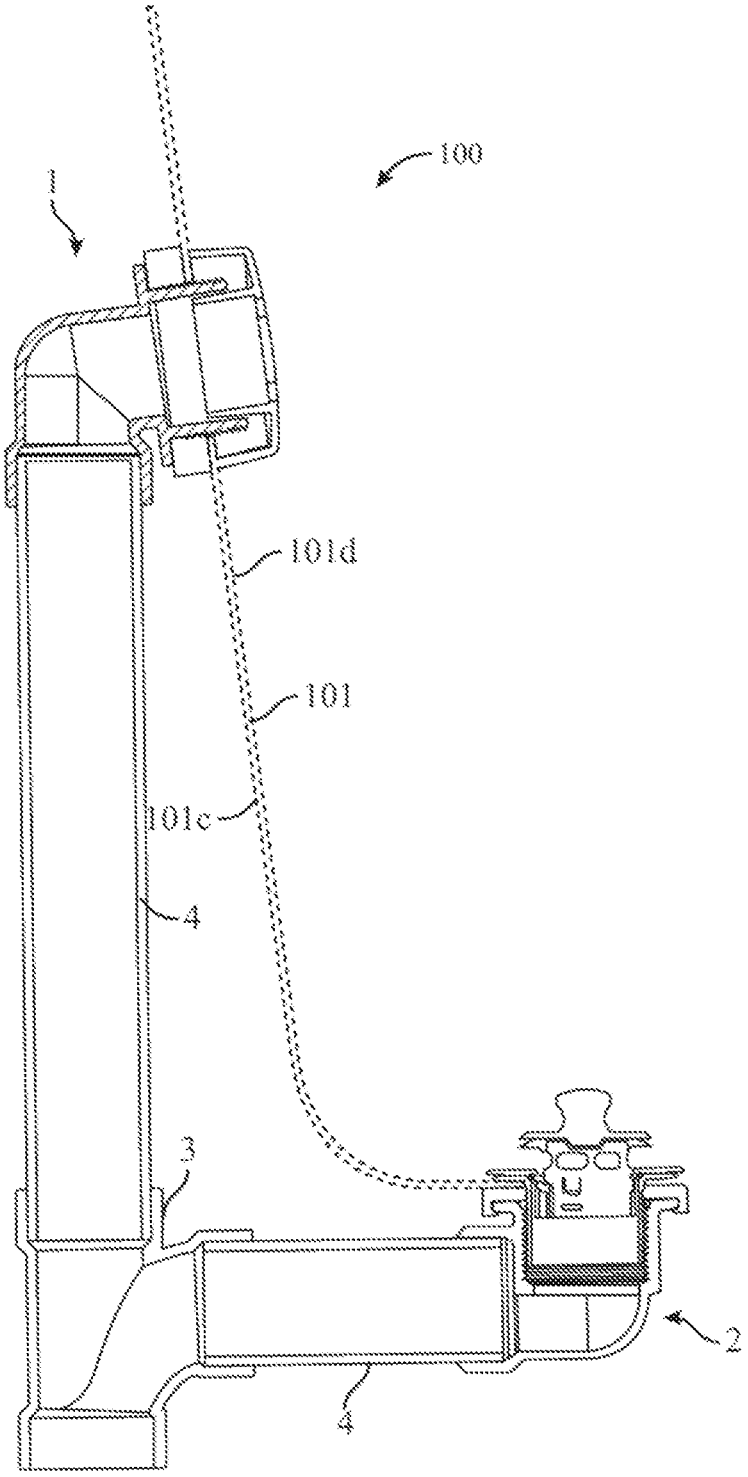
FIG. 1C is a side cross-sectional view of the system illustrated in FIG. 1A, such cross-section being taken along lines 1C-1C, as shown in FIG. 1A.
Figure 10:
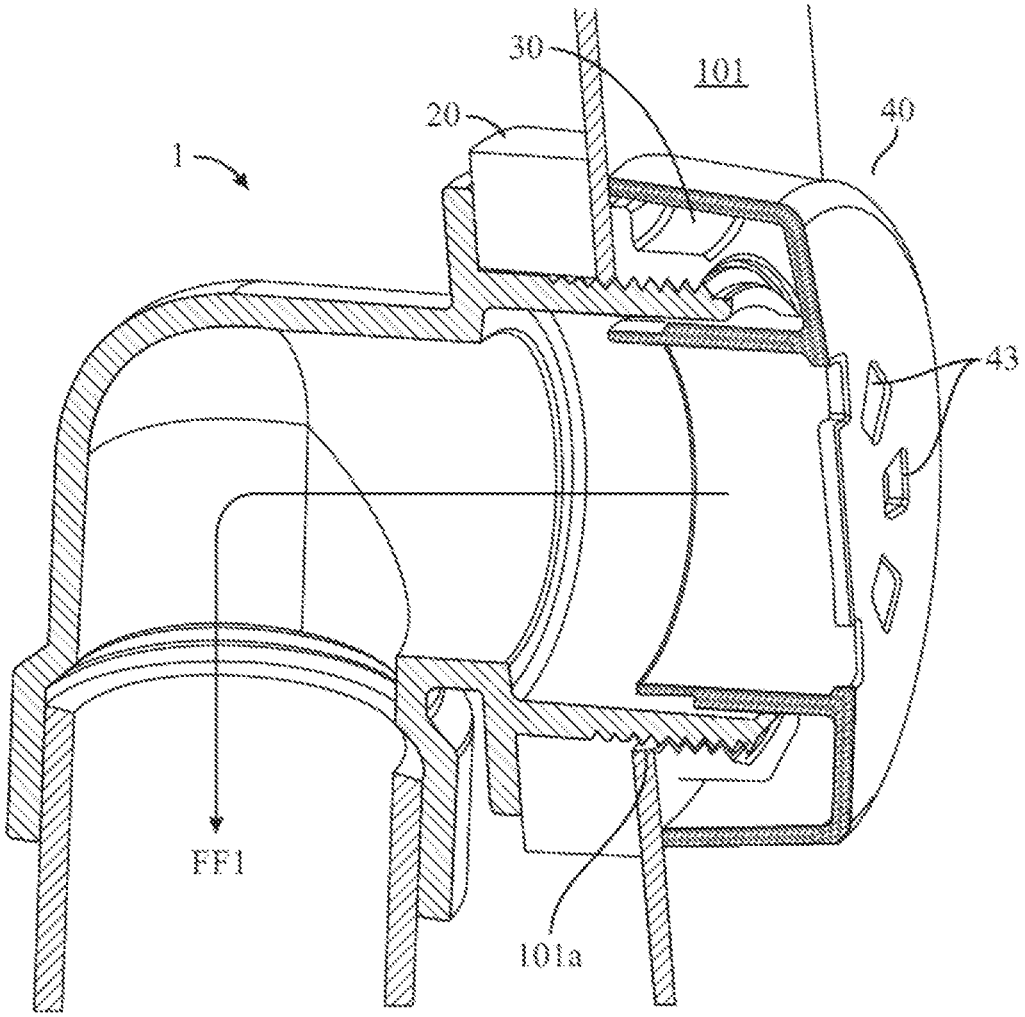
FIG. 10A is a perspective view of a drain stopper according to an embodiment of the invention.
FIG. 10B is a perspective, cross-sectional view of the bottom portion of the supply valve illustrated in FIG. 10A, such cross-section being taken along lines 10B-10B, as shown in FIG. 10A.
FIG. 10C is a detailed perspective view of the drain stopper illustrated in FIG. 10A.
FIG. 10D is a perspective view of a traditional "lift and turn" drain stopper.
FIG. 10E is a partial cross-sectional side elevation view of a drain assembly according to an alternative embodiment.
FIG. 10F is a partial cross-sectional side elevation view of a drain assembly according to yet a further alternative embodiment.
FIG. 10G is a bottom plan view of a drain trim as illustrated in FIG. 10F.
Figure 1E:
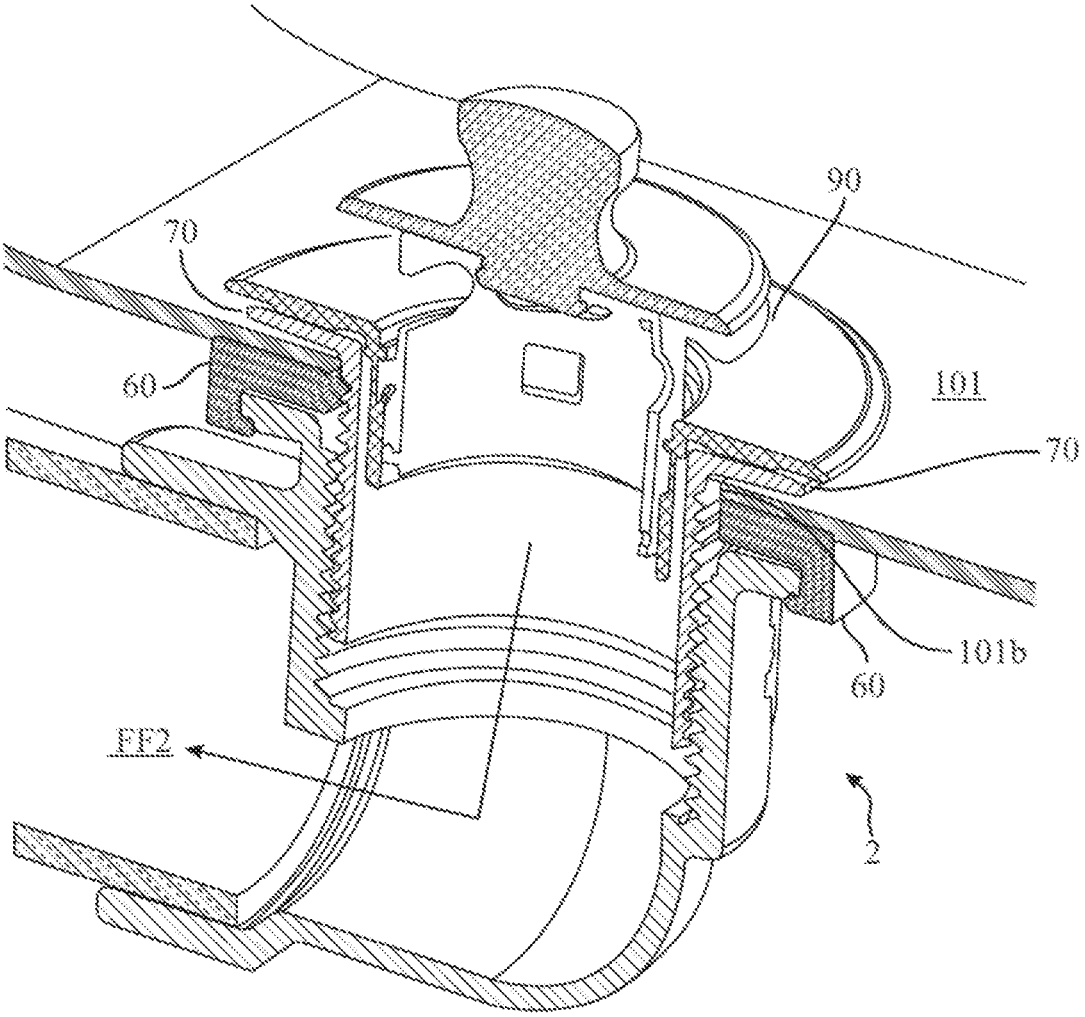
FIG. 1E is a detailed perspective, cross-sectional view of a drain portion of the system illustrated in FIG. 1C, such cross-section being taken along lines 1C-1C, as shown in FIG. 1A.

Referring now to FIGS. 1C, 1D, and 1E, a cross-section of the system (100) is shown, taken along the lines 1C-1C illustrated in FIG. 1A. The cross-sectional views of FIGS. 1C-1E illustrate the hollow nature of the components in the system (100), and particularly the hollow nature of the overflow assembly (1) and the drain assembly (2) (shown in detail in FIGS. 1D and 1E, respectively), which will individually be described below in greater detail. Generally speaking, the hollow interior of the overflow assembly (1) defines a first fluid flow path ($FF_1$) generally directed from the interior of the bathtub (101), through the overflow assembly (1), and toward the tee (3), and the hollow interior of the drain assembly (2) defines a second fluid flow path ($FF_2$) generally directed from the interior of the bathtub (101), through the drain assembly (2), and toward the tee (3). The first and second fluid flow paths ($FF_1$, $FF_2$) will ultimately intersect within the tee (3), and accordingly, overflow/drain water following each of these respective paths will combine within the tee (3) and empty into the main drain system.

With reference to FIGS. 1C and 1D, the overflow assembly (1) in an installed configuration (i.e., assembled and tightened to the bathtub (101)) remains in constant fluid communication with the interior of the bathtub (101). This is so because (as shown more particularly in FIG. 1D), openings (43) in an overflow faceplate (40) of the overflow assembly (1) are unblocked at all times, and accordingly, any water reaching a vertical level in the bathtub (101) that approaches or surpasses a vertical location of the openings (43) will drain into the overflow assembly (1) and follow the first fluid flow path ($FF_1$) to drain into the main drain system. By contrast, however, the drain assembly (2) when in an installed configuration (i.e., assembled and tightened to the bathtub (101)) is in selective fluid communication with the interior of the bathtub (101). More specifically, and with reference now to FIG. 1E, the drain assembly (2) includes a drain stopper (90) that is selectively positionable between an open configuration (illustrated in FIG. 1E) where the drain assembly (2) is in fluid communication with the interior of the bathtub (101), and a closed configuration (not depicted) where the drain stopper (90) seals the drain port (101*b*) and, thus, the drain assembly (2) is not in fluid communication with the interior of the bathtub (101). In the open configuration, any water passing into the drain assembly (2) will follow the second fluid flow path ($FF_2$) to drain into the main drain system.

Figure 2A:
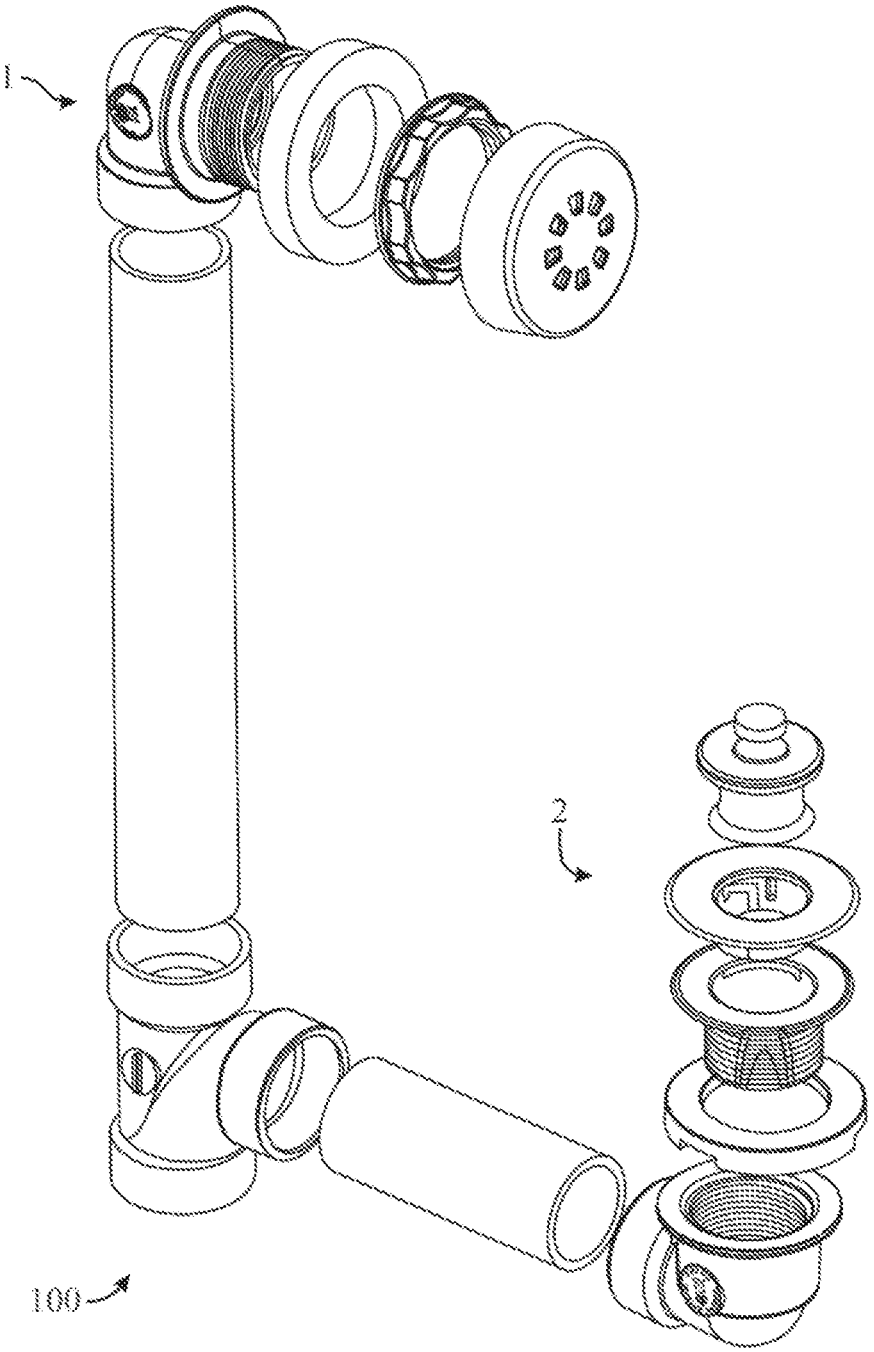
FIG. 2A is a front perspective view of the system of FIGS. 1A-1E, illustrated in an exploded form and without the tub for clarity.
Figure 2B:
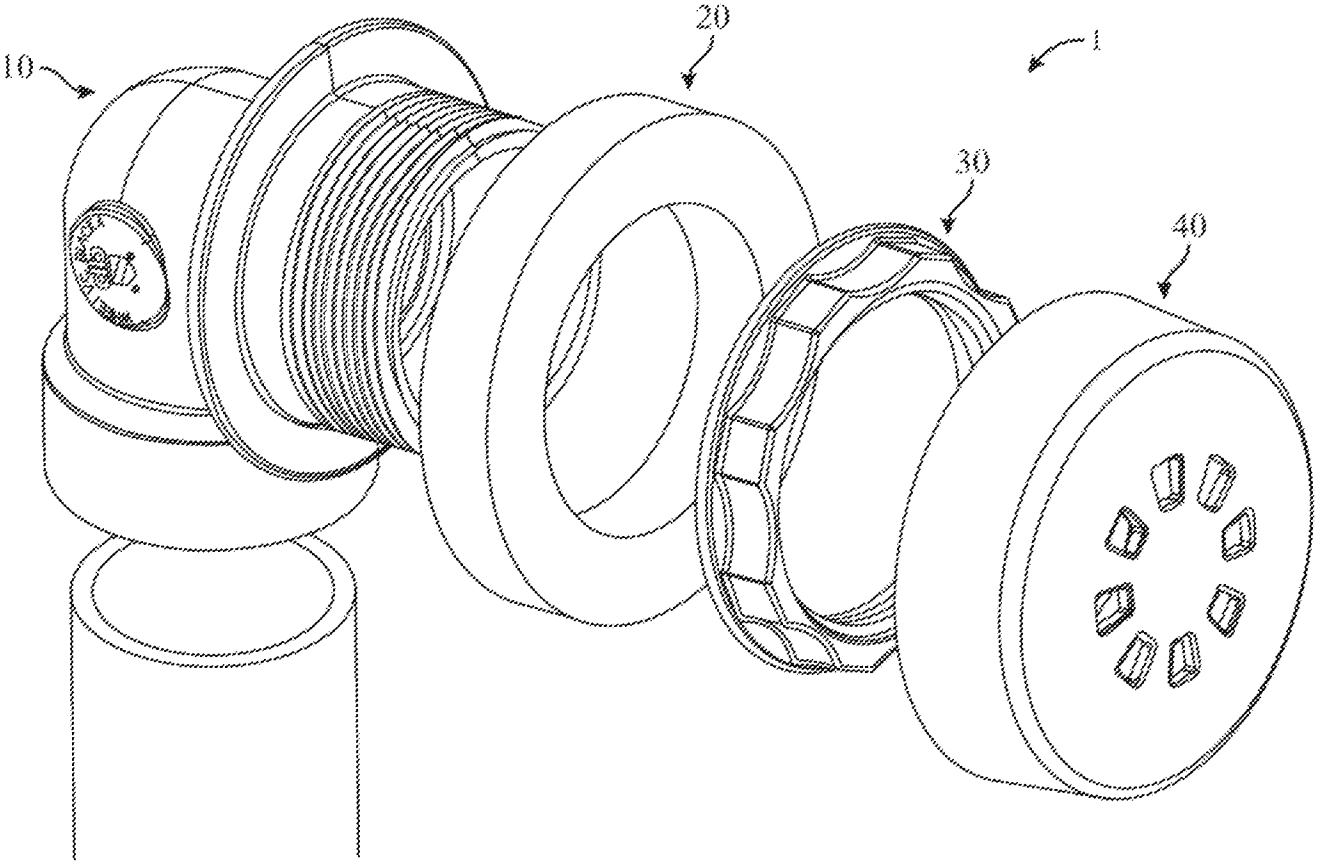
FIG. 2B is a detailed perspective, exploded view of the overflow portion of the system illustrated in FIG. 2A.
Figure 2C:
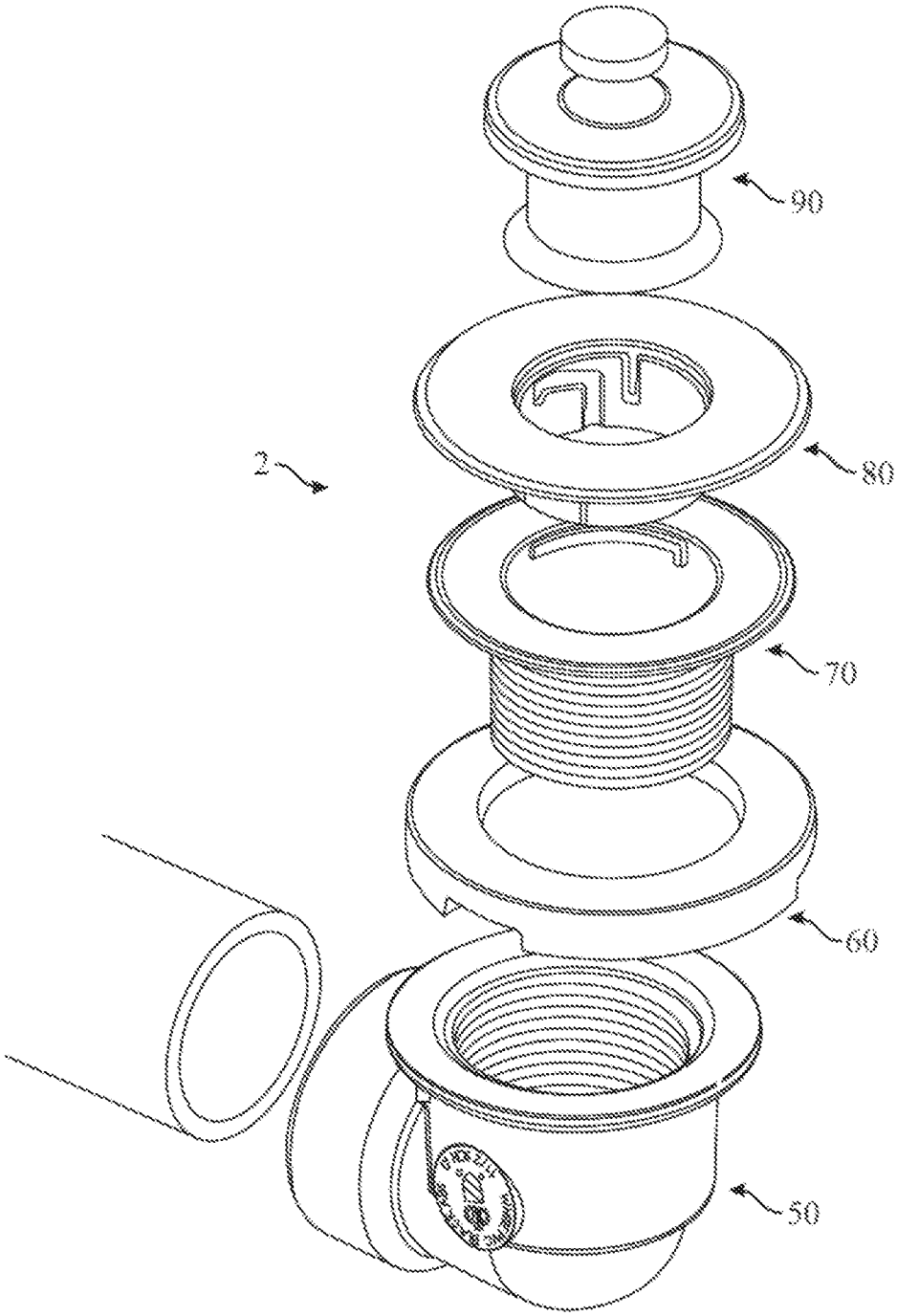
FIG. 2C is a detailed perspective, exploded view of the drain portion of the system illustrated in FIG. 2A.

With reference now to FIGS. 2A-2C, the system (100) is illustrated in an exploded view to show the various components of the overflow and drain assemblies (1, 2) and the components' relative arrangement with respect to one another in the installed configuration, which will be described below in greater detail. The bathtub (101) has not been illustrated in these figures for sake of clarity and to show the various details of the overflow and drain assemblies (1, 2).

Figure 3A:
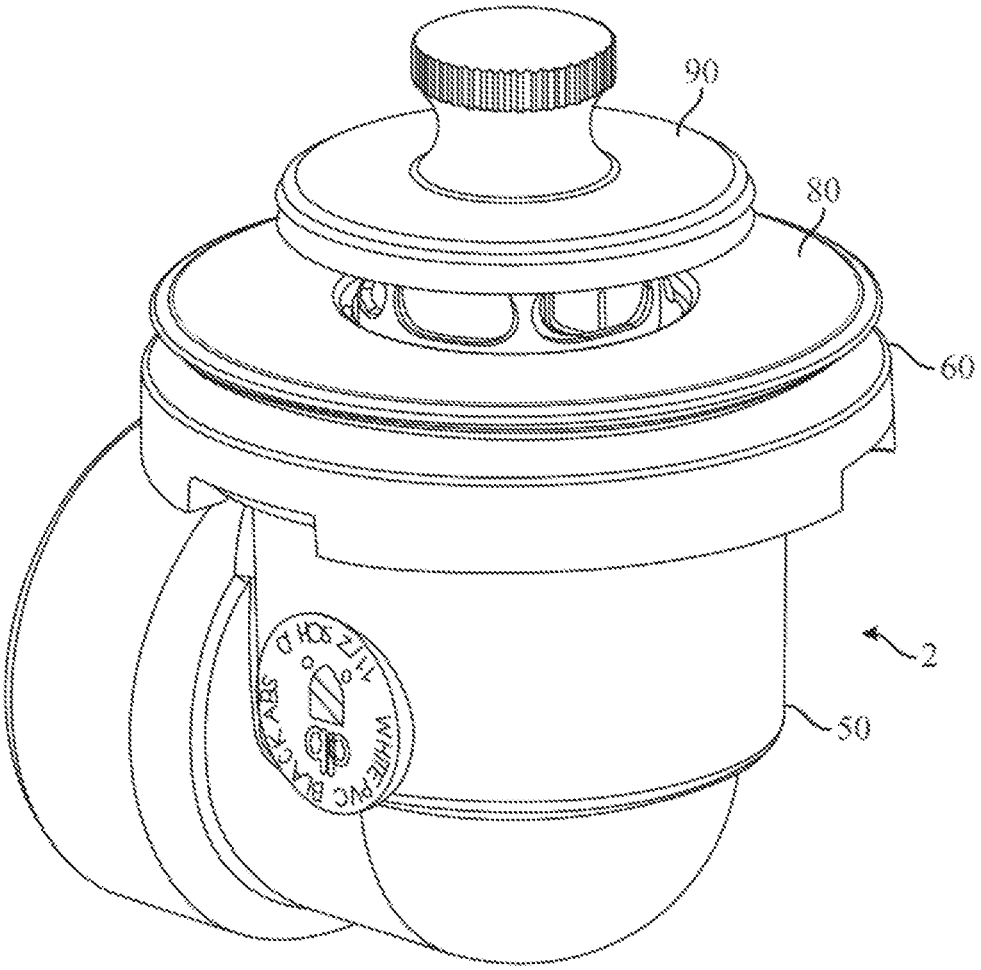
FIG. 3A is a perspective view of a drain aspect of a bath waste and drain system according to an embodiment of the invention.
Figure 3B:
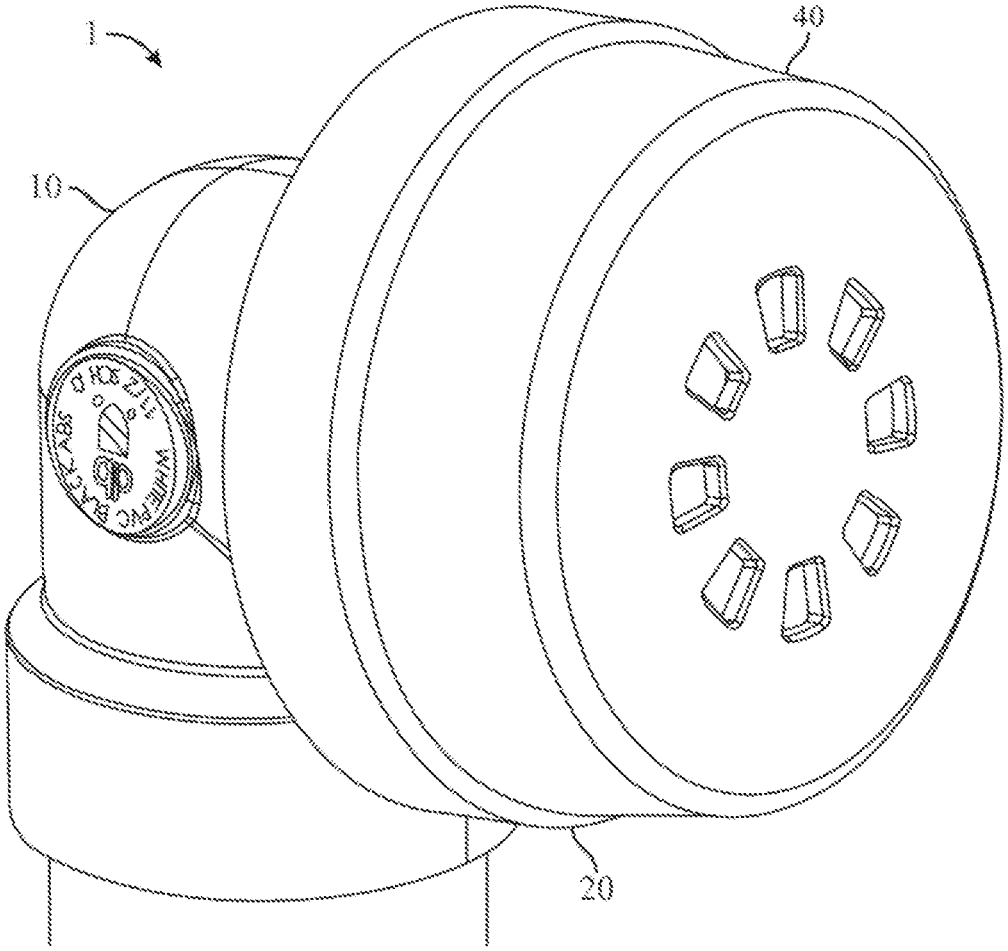
FIG. 3B is a perspective view of an overflow aspect of a bath waste and drain system according to an embodiment of the invention.
Figure 3C:
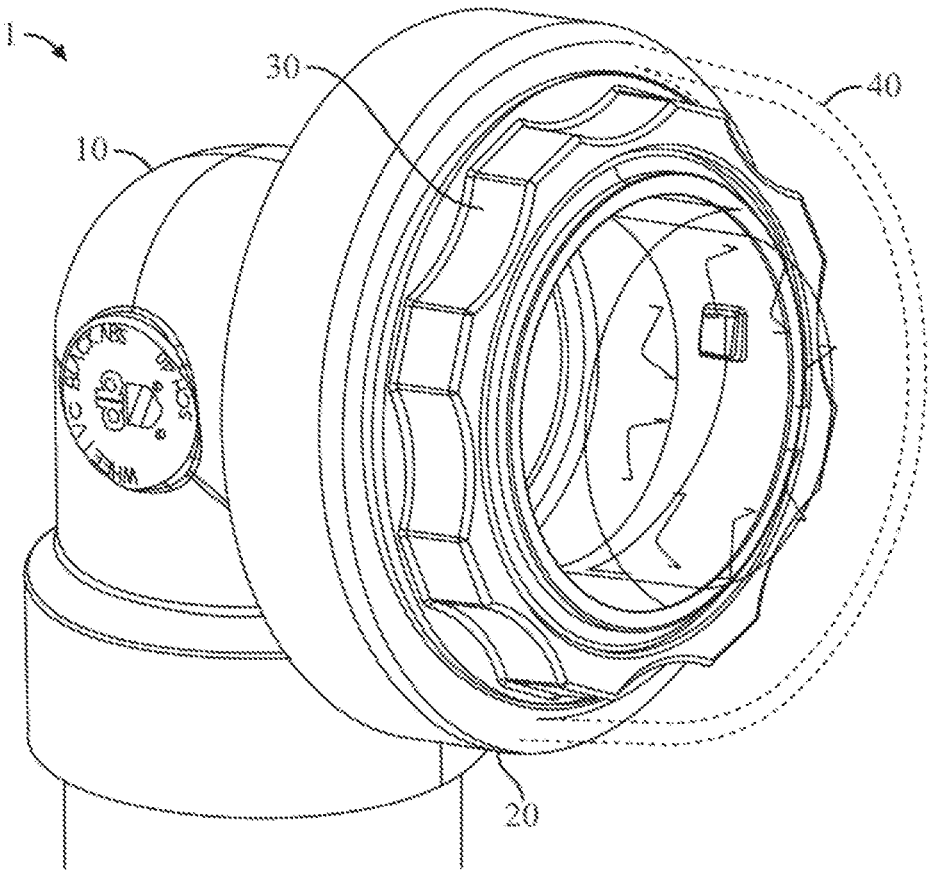
FIG. 3C is a perspective view of the overflow aspect of the system illustrated in FIG. 3B, where an overflow faceplate is shown transparently for clarity.

Referring first to FIG. 2B, the overflow assembly (1) generally includes the overflow elbow (10), an overflow gasket (20), a retaining nut (30), and the overflow faceplate (40). Although an exemplary method of installing the various components of the overflow assembly (1) to the bathtub (101) will be described in greater detail below, the exploded view of FIG. 2B illustrates the relative placement of the overflow elbow (10), overflow gasket (20), retaining nut (30), and overflow faceplate (40) to one another during an installation. Also, and as shown in FIG. 1D, the wall of the bathtub (101) is interposed and compressed between the overflow gasket (20) and the retaining nut (30) in the installed configuration. This compression will cause the overflow assembly (1) to form a fluid tight seal with the overflow port (101*a*) of the bathtub (101). When in the assembled configuration, the aforementioned components of the overflow assembly (1) will be arranged as shown in FIG. 3B, where the tub (101) is not illustrated for clarity, and where the retaining nut (30) is hidden beneath the overflow faceplate (40), such that the overflow faceplate (40) conceals the retaining nut (30). With reference to FIG. 3C, the overflow faceplate (40) is shown transparently, and the retaining nut (30) can be seen disposed about the overflow elbow (10) beneath the overflow faceplate (40). As shown, the openings (43) (as described above) will place the interior of the bathtub (101) in constant fluid communication with the overflow assembly (1) when the overflow assembly (1) is in the installed configuration.

Referring now to FIG. 2C, the drain assembly (2) generally includes the drain elbow (50), a drain gasket (60) a drain spud (70), a drain trim (80), and the drain stopper (90). Although an exemplary method of installing the various components of the drain assembly (2) to the bathtub (101) will be described in greater detail below, the exploded view of FIG. 2C illustrates the relative placement of the elbow (50), gasket (60), spud (70), trim (80), and stopper (90) to one another during an installation. Generally speaking, and as noted above, the drain elbow (50) is positioned adjacent the drain port (101*b*) at the exterior of the bathtub (101). The drain spud (70) may be inserted generally downwardly and into the drain elbow (50) from the interior of the bathtub (101). In one aspect, the drain spud (70) may be inserted into the drain elbow (50) in this regard along an insertion direction, which as shown may be generally downwardly (although other orientations are considered to be within the scope of the disclosure). Likewise, the drain trim (80) may be inserted generally downwardly (as shown) into the drain spud (70) substantially along the insertion direction. As shown in FIG. 1E, the wall of the bathtub (101) is interposed and compressed between the gasket (60) and the spud (70) in the installed configuration. Although not specifically illustrated, the plumber or user may also apply plumber's putty, silicone, or some other sealant on a bottom portion of the drain spud (70) to seal the same at the drain port (101*b*). This compression (like that for the overflow assembly (1)) in combination with application of a sealant, will cause the drain assembly (2) to form a fluid tight seal with the drain port (101*b*) of the bathtub (101). When in the assembled configuration, the aforementioned components of the drain assembly (2) will be arranged as shown in FIG. 3A, where the tub (101) is not illustrated for clarity, and where the drain spud (70) is hidden beneath the drain trim (80). As shown in FIG. 3A, the stopper (90) is in the open configuration (as described above), which will place the interior of the bathtub (101) in fluid communication with the drain assembly (2) when the assembly (2) is in the installed configuration.

Figure 4A:
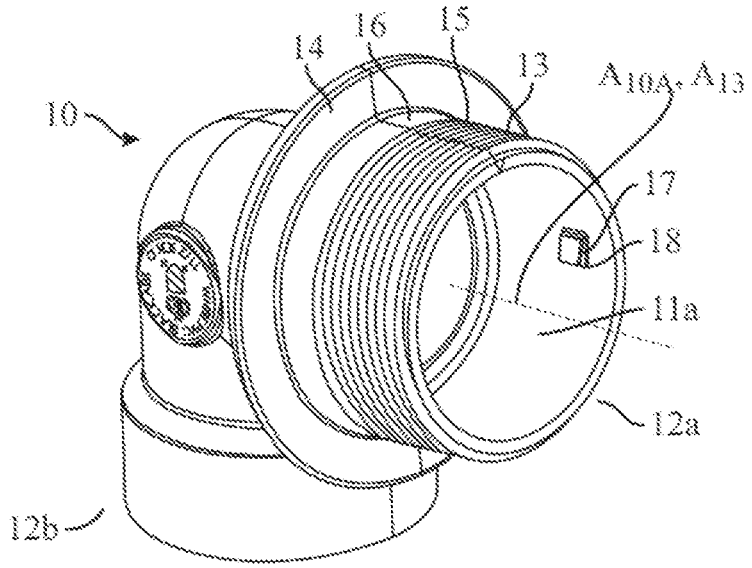
FIG. 4A is a front perspective view of an overflow elbow according to an embodiment of the invention.
Figure 4B:
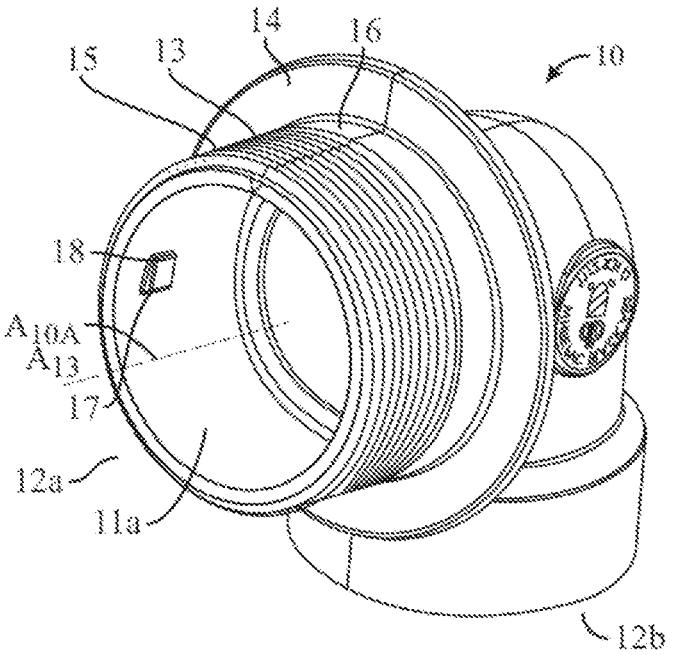
FIG. 4B is another front perspective view of the overflow elbow illustrated in FIG. 4A.

With reference now to FIGS. 4A-4B, the overflow elbow (10) is illustrated from two front perspective views. The overflow elbow (10) as illustrated has a generally 90-degree shape, including first and second openings (11*a*, 11*b*) at opposing first and second ends (12*a*, 12*b*) of the overflow elbow (10). The first opening (11*a*) extends about a first opening axis ($A_{10A}$) while the second opening (11*b*) extends about a second opening axis ($A_{10B}$). The overflow elbow (10) further includes a neck portion (13) about the first opening (11*a*) that extends from the first end (12*a*) to flange member (14). The neck portion (13) likewise defines a neck portion axis ($A_{13}$) that is parallel and intersecting with the first opening axis ($A_{10A}$) As illustrated in FIGS. 4A and 4B, an exterior part of the neck portion (13) may include a partially threaded portion (15) and a partially unthreaded portion (16). The neck portion (13) is sized and configured to be inserted through the overflow port (101*a*) of the bathtub (101) (see, e.g., FIG. 1D) so as to substantially align the first opening axis ($A_{10A}$) (and thereby the neck portion axis ($A_{13}$)) with the overflow port axis ($P_1$), thereby centering the overflow elbow (10) within the overflow port (101*a*). The neck portion (13) defines a neck portion diameter ($D_{13}$) with respect to the neck portion axis ($A_{13}$), which as illustrated may be constant along a length of the neck portion (13), measured from the first opening (11*a*) to the flange member (14). As described in more detail below the neck portion diameter ($D_{13}$) may closely match an inner diameter of the overflow gasket (20) and an inner diameter of the retaining nut (30) such that the gasket (20) and nut (30) may engage with the neck portion (13) of the overflow elbow (10) and thereby reside along the threaded (15) and unthreaded (16) portions of the neck portion (13). It is contemplated that in some embodiments of the overflow elbow (10), the neck may be entirely threaded, entirely unthreaded, or may comprise both threaded (15) and unthreaded (16) portions (as does the illustrated embodiment in FIGS. 4A-4B) of varying respective percentages; all such variations are considered to be within the scope of this disclosure.

An interior of the neck portion (13) may include a plurality of overflow locking features (17), which as illustrated in FIGS. 4A-4B may comprise two projections (18) each having a thickness ($T_1$) measured with respect to an inner wall of the neck portion (13). The locking features (17) are sized and configured to permit engagement/attachment of additional components with the overflow elbow (10). For example, and as will be described in greater detail below, the locking features (17) may permit engagement of the overflow faceplate (40) by mating a complementary receiver feature of the faceplate (40) with the locking features (17), such as the projections (18), of the overflow elbow (10). As but another example, and as will be described below with respect to components of a system (200) enabling a plumber to run a pressure test, a plumber or user may engage an overflow test plug (240) (see FIG. 13A) directly with the locking features (17) of the overflow elbow (10). In such a situation, the overflow test plug (240) would mate directly with the interior portion of the neck portion (13) of the overflow elbow (10) so as to seal the overflow elbow (10), and thereby the overflow port (101*a*), so as to effectuate a proper pressure test of the overflow assembly (1).

Although not separately illustrated, the overflow gasket (20) may be made of a known variety/material (such as elastomeric, foam, or some other flexible and water-impervious material known in the art) and the gasket (20) comprise an outer diameter ($D_{20A}$) and an inner diameter ($D_{20B}$) as measured with respect to a central gasket axis ($A_{20}$). As noted above, the inner diameter ($D_{20B}$) may be sized and configured to conform substantially to the neck diameter ($D_{13}$) of the overflow elbow (10). This close conformity of diameters will permit the overflow gasket (20) to snugly and securely fit over the neck portion (13) of the overflow elbow (10) and will ultimately permit the overflow gasket (20) (as described below in greater detail) to advantageously form a leak-proof seal between the overflow assembly (1) and the bathtub (101). The overflow gasket (20) is further configured to abut the flange member (14) of the overflow elbow (10) in the installed configuration. The overflow gasket (20) may advantageously reside entirely along the unthreaded portion (16) of the neck portion (13), or it may also along the threaded portion (15) of the neck portion (13).

Figure 4C:
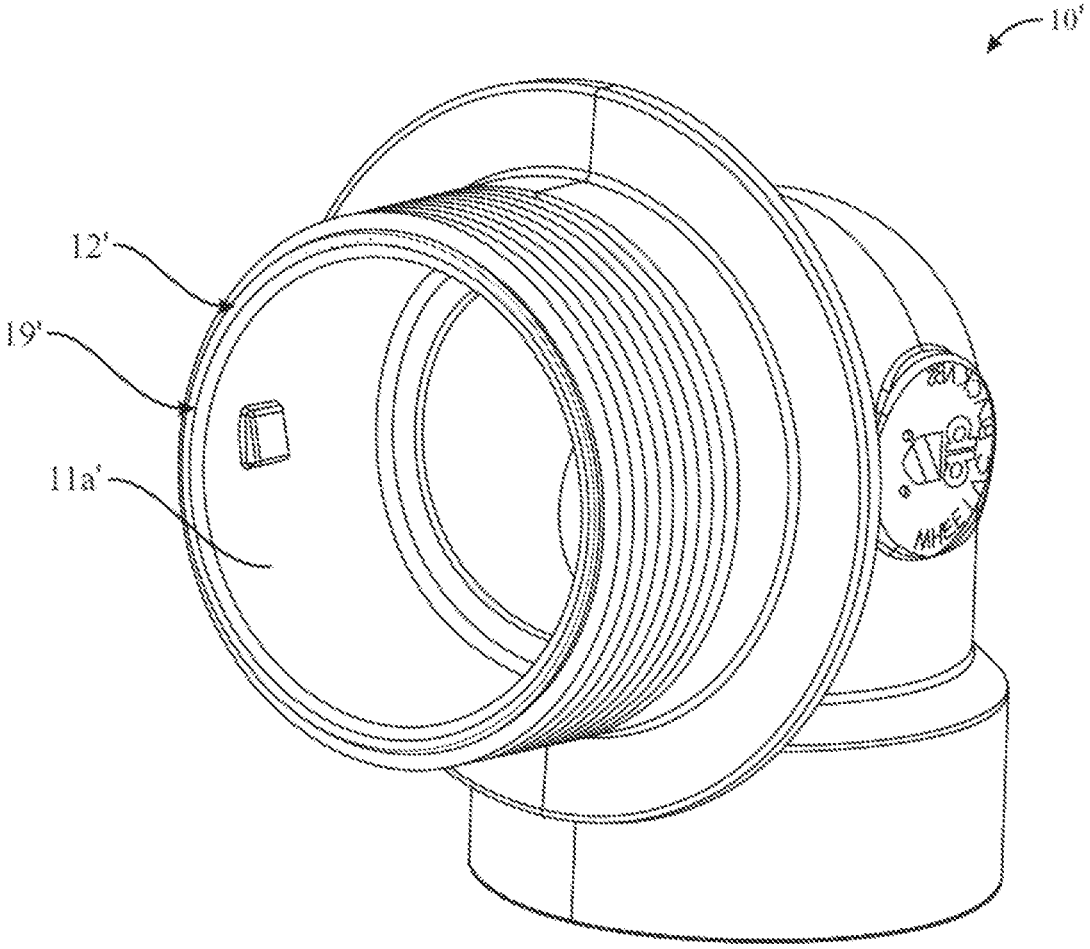
FIG. 4C is a front perspective view of an alternate embodiment of an overflow elbow.

FIG. 4C illustrates a perspective view of an alternative embodiment of an overflow elbow (10'). Portions of the embodiment disclosed in FIG. 4C are similar to aspects described above in FIGS. 4A and 4C and those portions function similarly to those described above. A first end (12*a*') of the overflow elbow (10') defines an overflow edge (19'). The overflow edge (19') defines a first opening (11*a*'). In an aspect, the overflow edge (19') has a chamfered configuration, such that the overflow edge (19') is circumferentially chamfered about the first opening (11*a*').

Figure 5A:
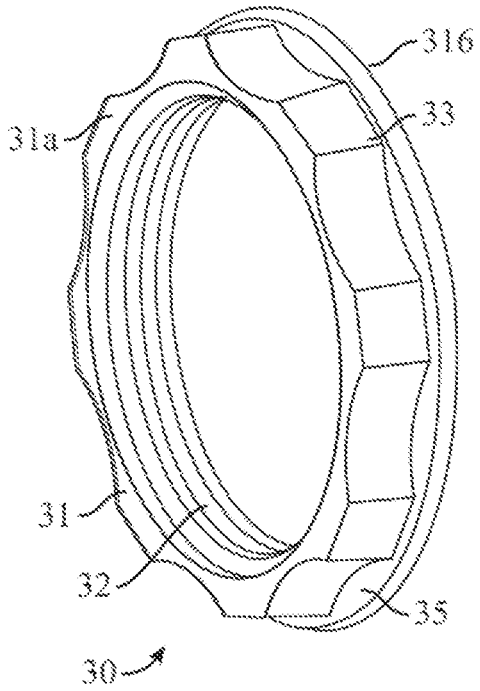
FIG. 5A is a front perspective view of a retaining nut according to an embodiment of the invention.
Figure 5B:
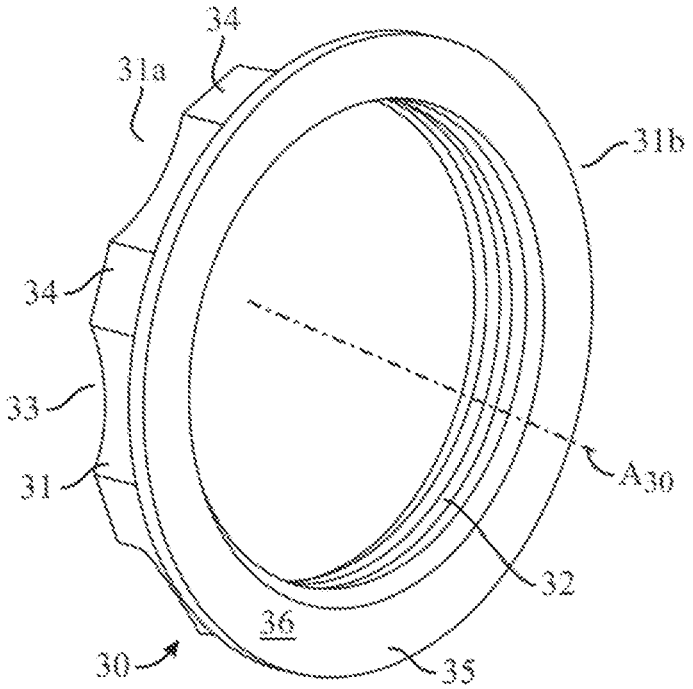
FIG. 5B is a rear perspective view of the retaining nut illustrated in FIG. 5A.
Figure 5C:
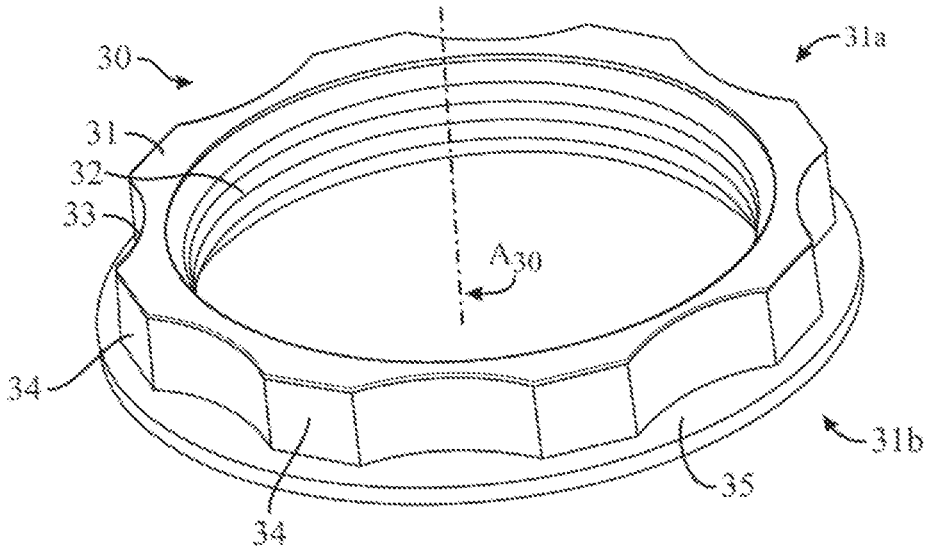
FIG. 5C is a perspective view of the retaining nut illustrated in FIGS. 5A-5B.

With reference now to FIGS. 5A-5C, the retaining nut (30) according to an embodiment is illustrated from several perspective views. The retaining nut (30) may comprise a generally circular body (31) that extends along a central axis ($A_{30}$) from a first end (31*a*) to a second end (31*b*). An inner portion of the retaining nut (30) defines an inner diameter ($D_{30}$), and the inner portion may comprise threading (32) that extends thereabout. The threading (32) may extend throughout an entirety of the inner portion of the retaining nut (30), or alternatively less than the entirety. The threading (32) is complementarily sized (as is the diameter ($D_{30}$)) and configured to cooperate with the threaded portion (15) on the neck portion (13) of the overflow elbow (10), as best shown in FIG. 1D. An outer portion of the retaining nut (30), opposite the inner portion, may comprise a knurled feature (33) at the first end (31*a*) that is sized and shaped to allow for ease of grasping the retaining nut (30) with a user's hands so as to rotate or otherwise manipulate the retaining nut (30). The knurled feature (33) may include a plurality of lugs (34) disposed about a periphery of the knurled feature (33), where the lugs (34) may be equally and symmetrically spaced about the circumference of the knurled feature (33) with respect to the central axis ($A_{30}$). In a further respect, each lug (34) of the knurled feature (33) may define a diameter ($D_{34}$) with respect to the central axis ($A_{30}$) where the lug diameter ($D_{34}$) is greater than the inner diameter ($D_{30}$) of the retaining nut (30). The second end (31*b*) may include a flange member (35) having a substantially planar surface (36), as shown best in FIG. 5B. As will be described in greater detail below with respect to a method of installation, the planar surface (36) of the flange member (35) is sized and configured to abut the inner wall (101*d*) of the bathtub (101). As will be described below in greater detail with respect to an installation method (and with brief reference now to FIG. 1D), during installation of the overflow assembly (1), the retaining nut (30) will be threadingly tightened onto the threaded portion (15) of the neck portion (13) of the overflow elbow (10), such that the flat planar surface (36) of the flange member (34) bears against the inner wall (101*d*) of the bathtub (101). This will create a compressive force ($F_1$) directed between the flange member (14) of the overflow elbow (10) and the flange member (35) of the retaining nut (30). The compressive force ($F_1$) is partially absorbed by the overflow gasket (20), which is compressed against the outer wall (101*c*) of the bathtub (101). The result of the compressive force ($F_1$) acting on the overflow gasket (20) is a leak-proof seal as between the overflow assembly (1) and the bathtub (101).

Figure 6A:
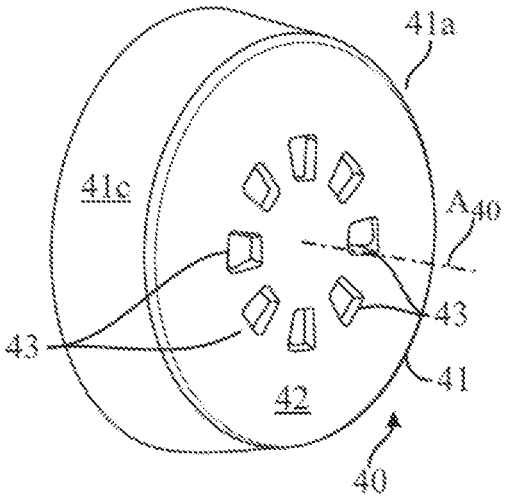
FIG. 6A is a front perspective view of an overflow faceplate according to an embodiment of the invention.
Figure 6B:
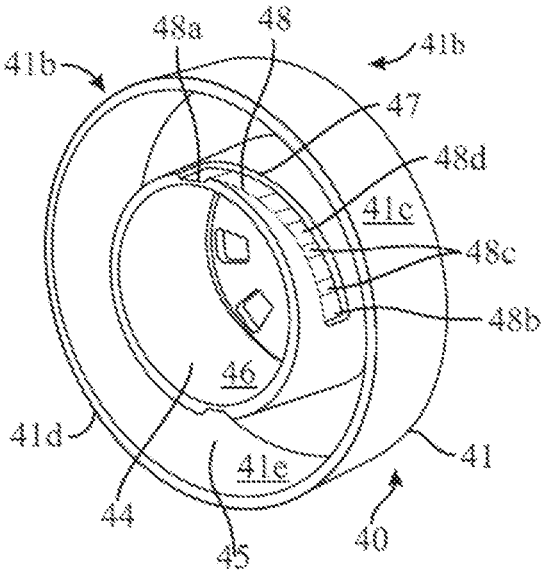
FIG. 6B is a rear perspective view of the overflow faceplate illustrated in FIG. 6A.
Figure 6C:
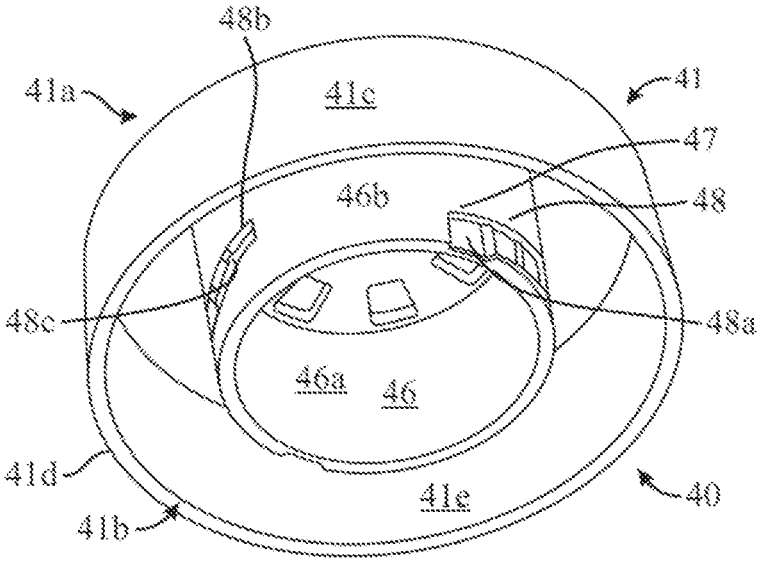
FIG. 6C is a perspective view of the overflow faceplate illustrated in FIGS. 6A-6B.

With reference now to FIGS. 6A-6C, the overflow faceplate (40) is illustrated from several perspective views according to an embodiment. Generally speaking, the overflow faceplate (40) serves the function of permitting controlled overflow drainage of water from the bathtub (101) when it reaches or exceeds the vertical level of the overflow assembly (1) within the bathtub (101). One of ordinary skill in the art will further appreciate that, in the installed configuration of the overflow assembly (1), the faceplate (40) will be the sole visible component of the overflow assembly (1) from the interior of the bathtub (101). It is therefore desirable that the overflow faceplate (40) be made of (or at least exteriorly plated with) an aesthetically pleasing material (such as chrome, nickel, brass, or other similar material).

As illustrated in FIGS. 6A-6C, the faceplate (40) comprises a generally circular body (41) that extends from a first end (41*a*) to a second end (41*b*) along a central faceplate axis ($A_{40}$). The first end (41*a*) generally consists of a cover plate (42) having a plurality of openings (43), which may (as shown in the embodiment illustrated in FIG. 6A) be symmetrically disposed on the cover plate (42) with respect to the central faceplate axis ($A_{40}$). It is contemplated that the plurality of openings (43) may comprise various numbers of openings (43), and that each opening (43) may vary in size or be non-uniform with other openings (43) as desired; these alternatives are all included within the scope of this disclosure. The first end (41*a*) is spaced from and connected to the second end (41*b*) by a rounded edge wall (41*c*). As illustrated best in FIG. 6A, the edge wall (41*c*) may be tapered slightly outwardly from the first end (41*a*) toward the second end (41*b*). The edge wall (41*c*) may terminate at the second end in an engagement edge (41*d*), as shown in FIGS. 6B and 6C. As will be described in greater detail below with respect to an installation method, the engagement edge (41*d*) is shaped and configured to abut the inner wall (101*d*) of the bathtub (101) so as to prevent overflow water from passing around the edge wall (41*c*) and instead to direct overflow water exclusively through the openings (43) in the cover plate (42). The second end (41*b*) of the faceplate (40) includes two hollow portions: a central hollow portion (44) that is in fluid communication with the openings (43), and an outer hollow portion (45) that is separated from the central hollow portion (44) by a partition wall (46). In an installed configuration (as shown in FIG. 1D in cross section), and as illustrated, the lugs (34) of the retaining nut (30) may be spaced from an interior portion (41*e*) of the edge wall (41*c*), and accordingly, may not frictionally engage or otherwise physically contact the interior portion (41*e*).

The partition wall (46) includes both an inner part (46*a*) (disposed within the central hollow portion (44)) and an outer part (46*b*) (disposed within the outer hollow portion (45). The partition wall (46) may include locking feature receivers (47) disposed within the outer part (46*b*), where the locking feature receivers (47) are configured to complementarily mate with the locking features (17) of the overflow elbow (10) described above. In the illustrated embodiment of FIGS. 6B and 6C, the locking feature receivers (47) may be configured as two bayonet-style channels (48) that are disposed within the outer part (46*b*) of the partition wall (46), where the channels (48) extend helically about the partition wall (46) from an open portion (48*a*) adjacent the second end (41*b*) to a terminal portion (48*b*) adjacent the first end (41*a*). The channels (48) may define a depth ($T_2$) with respect to the outer part (46*b*) of the partition wall (46), where the depth ($T_2$) is substantially equal to the thickness ($T_1$) of the projections (18) of the overflow elbow (10), although slight differences therebetween are contemplated within the scope of this disclosure. As illustrated in the embodiments of FIGS. 6A and 6B, the channels (48) may include a plurality of raised ridges (48*c*) therein, where the ridges (48*c*) subdivide or segment the channels (48) into sub-channels (48*d*). Advantageously, and as will be described in greater detail below with respect to the installation method, the aforementioned configuration of the channels (48) permit staged and adjustable attachment of the overflow faceplate (40) to the overflow elbow (10). More particularly, the bayonet-style channels (48) allow the faceplate (40) to be incrementally tightened and secured to the overflow elbow (10) to permit the engagement edge (41*d*) to secure to the inner wall (101*d*) of the bathtub (101), thereby compensating for unknown thicknesses of the bathtub (101) and/or thicknesses of the overflow gasket (20) in a given installation. Once the overflow faceplate (40) is snugly tightened to the bathtub (101) such that the engagement edge (41*d*) abuts the inner wall (101*d*) of the bathtub (101), the ridges (48*c*) of the channels (48) will, further advantageously, resist loosening of the faceplate (40) from the bathtub (101) subsequent to an initial installation or a repair/replacement. This is so because a threshold amount of rotational force (i.e., torque) may be needed to be applied to the faceplate (40) to flex the partition wall (46) and to thereby rotationally permit the projections (18) of the overflow elbow (10) to transition from a first sub-channel (48*d*) and into a second adjacent sub-channel (48*d*).

Figure 7A:
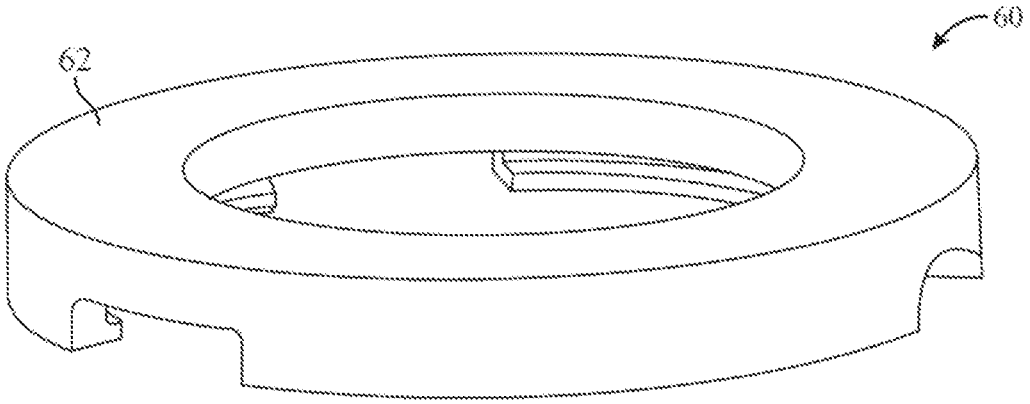
FIG. 7A is a top perspective view of a drain gasket according to an embodiment of the invention.
Figure 7B:
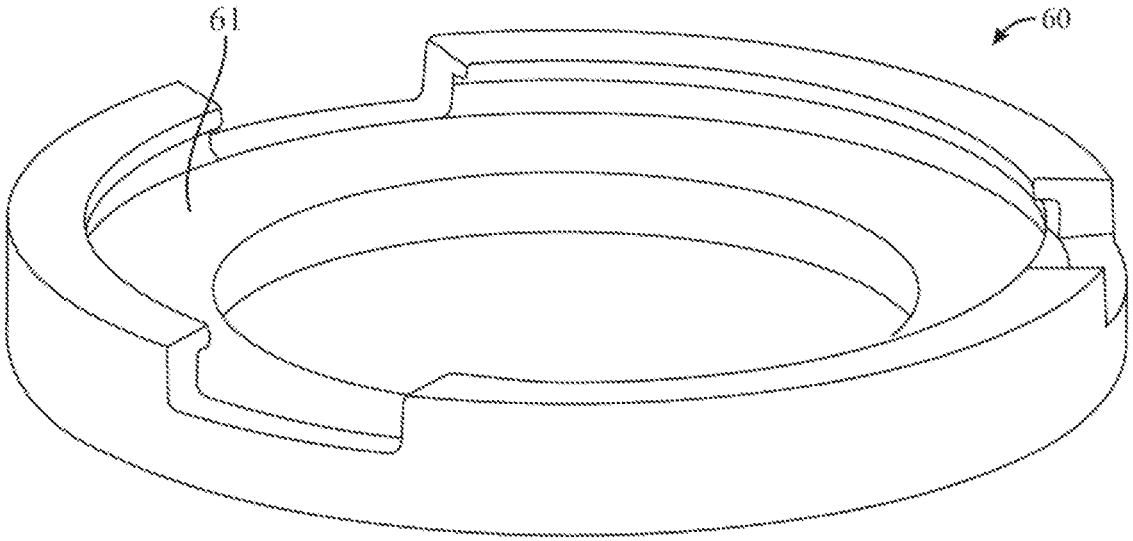
FIG. 7B is a bottom perspective view of the drain gasket illustrated in FIG. 7A.

With reference now to FIGS. 7A-7B, the drain gasket (60) of the drain assembly (2) is illustrated, respectively, from a top and bottom perspective view in accordance with an embodiment. Like the overflow gasket (20) described above, the drain gasket (60) may be made of a water impervious material (such as elastomeric, foam, or another similar material known in the art). The drain gasket (60) is sized and shaped to fit around a flange (51) of the drain elbow (50) (see FIG. 1E), and in some embodiments, it is contemplated that the drain gasket (60) will come pre-installed onto the flange (51), including possibly overmolded onto the flange (51). In that respect, an inner portion (61) of the gasket (60) will closely conform to the geometry of the flange (51) of the drain elbow (50). As described below in greater detail with respect to an installation method (and with reference to FIG. 1E), an outer portion (62) of the drain gasket (60), opposite the inner portion (61), is configured to be compressed against the outer wall (101*c*) of the bathtub (101) as a result of a compressive force ($F_2$) generated between the drain elbow (50) and the drain spud (70). The compressive force ($F_2$) will advantageously form a leak-proof seal between the drain assembly (2) and the bathtub (101).

Figure 8A:
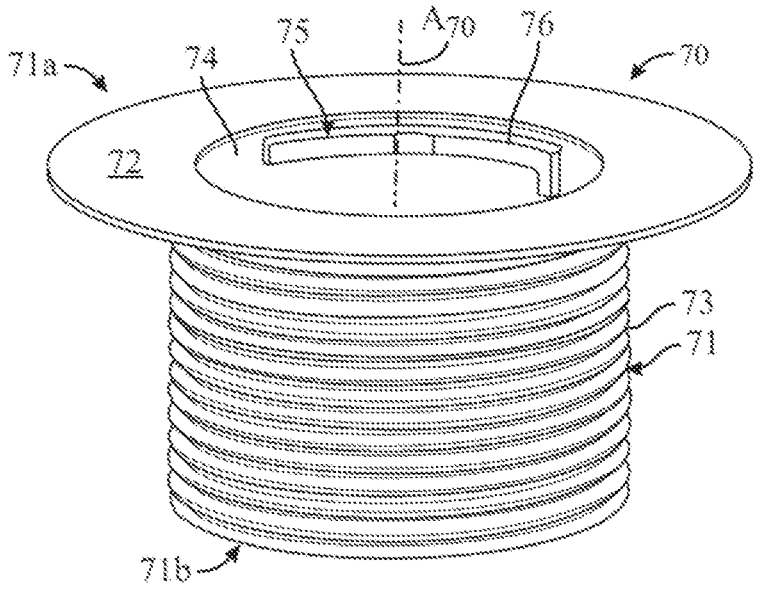
FIG. 8A is a perspective view of a drain spud according to an embodiment of the invention.
Figure 8B:
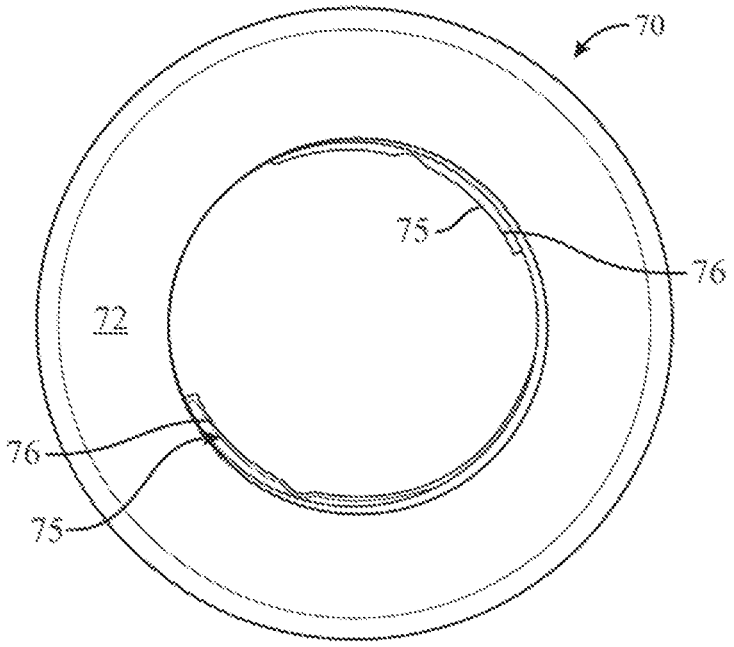
FIG. 8B is a top plan view of the drain spud illustrated in FIG. 8A.

With reference now to FIGS. 8A-8B, the drain spud (70) is illustrated according to a first embodiment. The drain spud (70) defines a substantially cylindrical body (71) extending along a central axis ($A_{70}$) from a first end (71*a*) to a second end (71*b*). The body (71) defines a diameter ($D_{71}$) as measured with respect to the central axis ($A_{70}$) The first end (71*a*) as illustrated includes a flange member (72) extending radially outwardly from the body (71) with respect to the central axis ($A_{70}$). The flange member (72) defines a diameter ($D_{72}$) as measured with respect to the central axis ($A_{70}$), where the flange diameter ($D_{72}$) is greater than the body diameter ($D_{71}$). An outer surface (73) of the body (71) may be substantially threaded from the second end (71*b*) to the flange member (72). The threads of the outer surface (73) may be complementarily configured to mate and cooperate with an internally threaded portion (52) of the drain elbow (50), as shown best in FIG. 1E. The inner surface (74) of the body (71), which is substantially opposite the outer surface (73), may include a locking feature (75) for engagement with other complementary components as will be described below (e.g., the drain trim (80) and the drain test plug (280)). As illustrated in FIGS. 8A and 8B, the locking feature (75) may comprise two quarter-turn projections (76) extending radially inwardly toward the central axis ($A_{70}$) from the inner surface (74). The projections (76) may engage with complementary quarter-turn projections on other components in order to releasably secure them to the drain spud (70). As will be described in greater detail below with respect to the method of installation, the drain spud (70) is configured to be threadedly and lockingly engaged to the drain elbow (50) from the interior of the bathtub (101). In that respect, the drain spud (70) must be inserted downwardly though the drain port (101*b*) from the interior of the bathtub (101) such that the flange member (72) engages the inner wall (101*d*) of the bathtub (101) Accordingly, it is desirable for a lower-portion of the flange (72) to be fitted with a small o-ring, gasket, or other sealing member to prevent water from becoming entrained within the complementarily mated threads of the drain spud (70) and the elbow (50), which would otherwise be prone to rust if water were permitted to collect at said threaded junction.

Figure 8C:
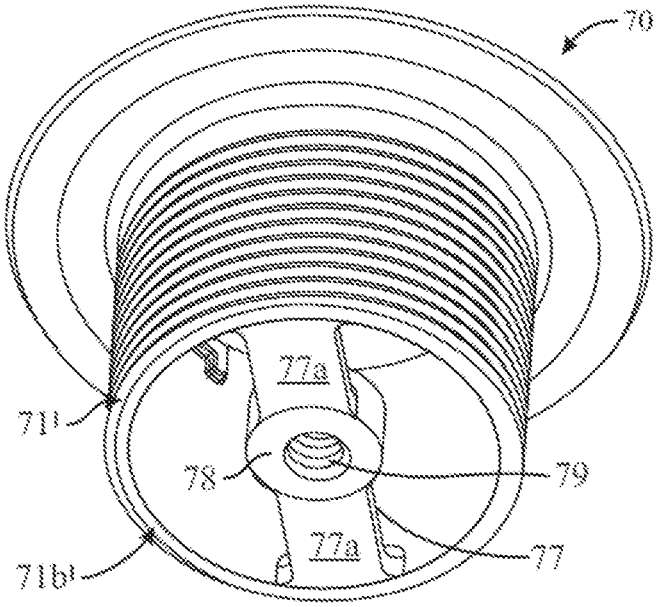
FIG. 8C is a perspective view of a drain spud according to another embodiment of the invention.
Figure 8D:
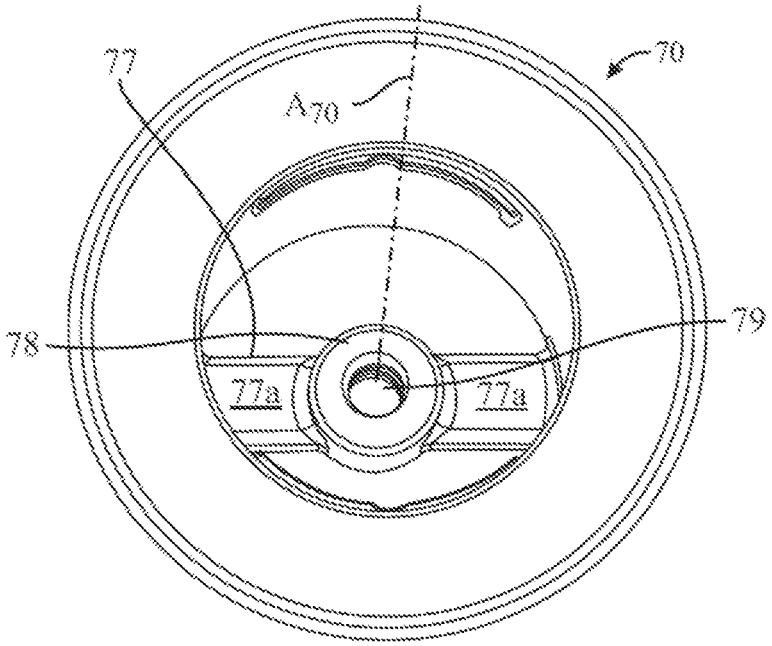
FIG. 8D is a top perspective view of the drain spud illustrated in FIG. 8C.

With reference now to FIGS. 8C-8D, a drain spud (70') is illustrated according to a second, alternative embodiment. It is noted that components of the drain spud (70') that otherwise are identical to the drain spud (70) as previously described will be identified with an asterisk (') to signify their similarity in function and design. The drain spud (70') differs from the drain spud (70) according to the first embodiment due to the addition of cross-member (77) at the second end (71*b*'). The cross-member (77) may further include a series of extension arms (77*a*) extending radially inwardly toward the central axis ($A_{70}$') from the body (71'). The arms (77*a*) may be joined at a center point by a hub (78), which may include a raised portion (78*a*) having a thickness that is greater than a respective thickness of either one of the arms (77*a*). The hub (78) may further include an internally threaded, central opening (79) extending through an entirety of the hub (78). The central opening may (79) extend about a respective axis ($A_{79}$) that is aligned with the central axis ($A_{70}$') of the drain spud (70'). By these additional features beyond the drain spud (70) disclosed previously, the drain spud (70') may be configured to receive a threaded post of a traditional "lift and turn" drain stopper (see FIG. 10D), which is well known in the art.

Figure 9A:
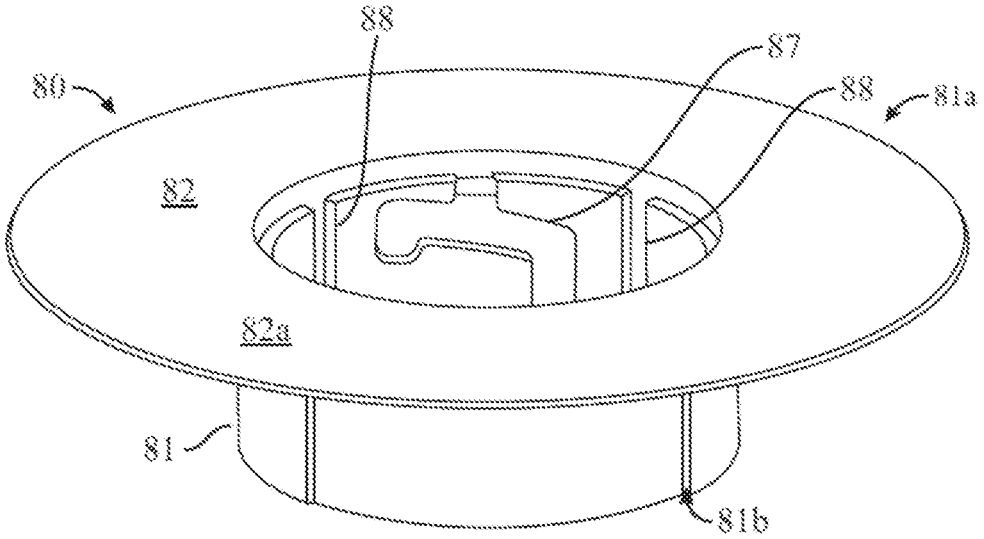
FIG. 9A is a top perspective view of a drain trim according to an embodiment of the invention.
Figure 9B:
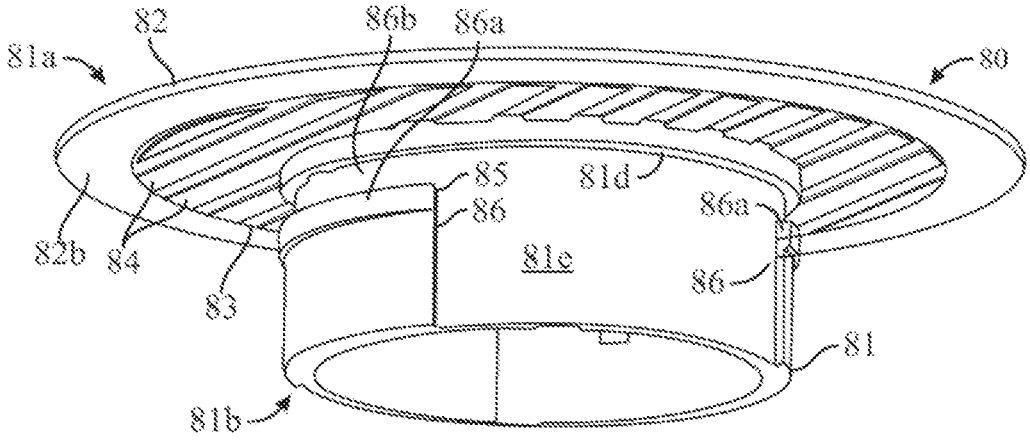
FIG. 9B is a bottom perspective view of the drain trim illustrated in FIG. 9A.
Figure 9C:
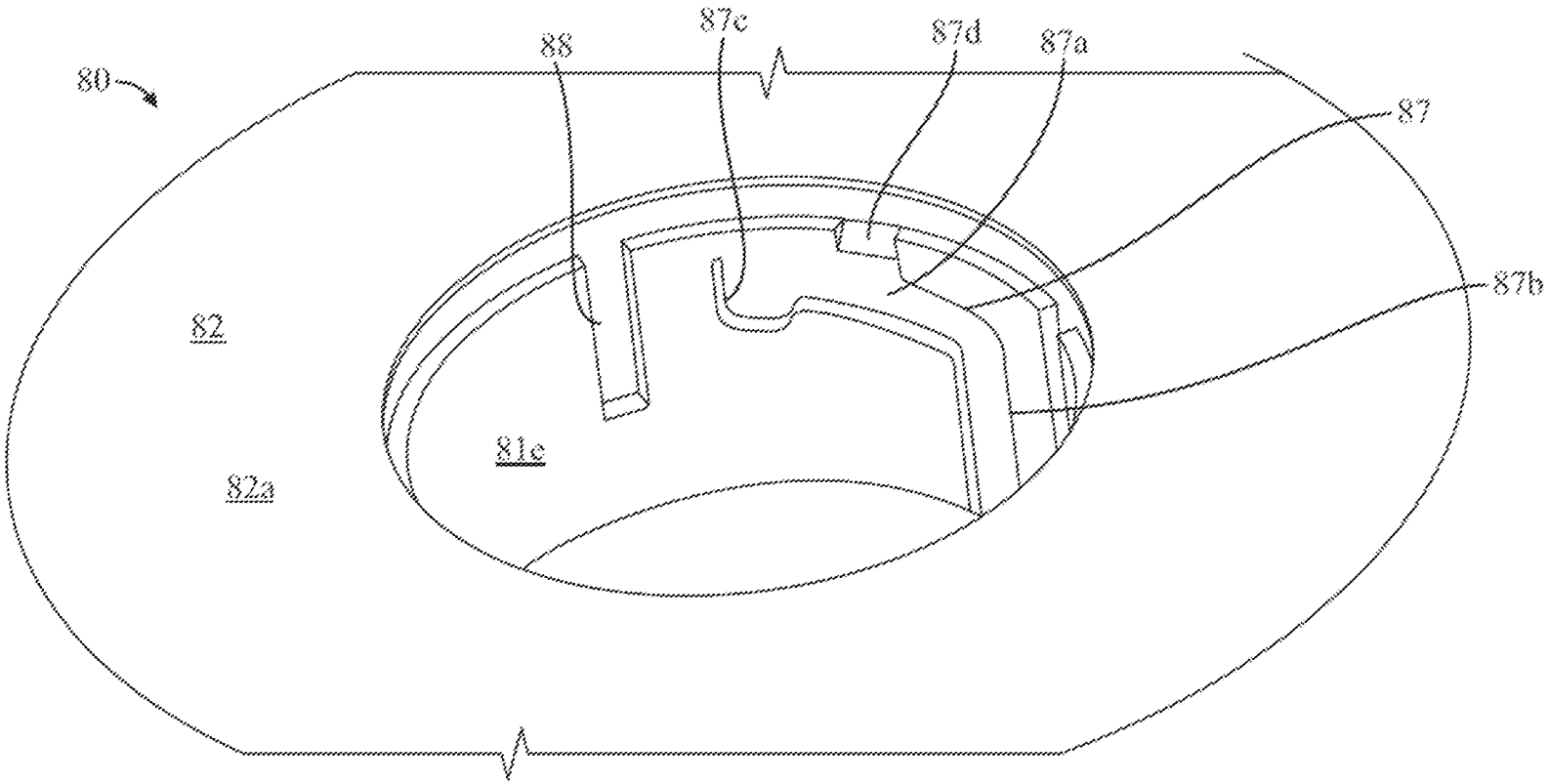
FIG. 9C is a detailed, top perspective view of the drain trim illustrated in FIGS. 9A-9B.

With reference now to FIGS. 9A-9C, a drain trim (80) is illustrated from several perspective views according to an embodiment. The drain trim (80), as will be described in greater detail below, is sized and configured to complementarily mate with the drain spud (70) previously described. The drain trim (80) defines a substantially cylindrical body (81) extending along a central axis ($A_{80}$) from a first end (81*a*) to a second end (81*b*). The body (81) defines a diameter ($D_{81}$) as measured with respect to the central axis ($A_{80}$) The first end (81*a*) as illustrated includes a flange member (82) extending radially outwardly from the body (81) with respect to the central axis ($A_{80}$). The flange member (82) defines a diameter ($D_{82}$) as measured with respect to the central axis ($A_{70}$), where the flange diameter ($D_{82}$) is greater than the body diameter ($D_{81}$). Also, and with reference briefly to FIG. 1E, the flange diameter ($D_{82}$), pertaining to the flange (82) of the drain trim (80) is greater than the flange diameter ($D_{72}$) pertaining to the flange (72) of the drain spud (70). The flange member (82) of the drain trim (80) generally defines a top flange surface (82*a*) and a bottom flange surface (82*b*) that is opposed from the top flange surface (82*a*). As shown in FIG. 9A, the top flange surface (82*a*) may be substantially flat and planar. However, and with reference specifically to FIG. 9B, the bottom flange surface (82*b*) may not be substantially flat and planar, and may instead be arranged with a plurality of weep channels (83) formed between respective adjacent ones of a plurality of weep projections (84) projecting from the bottom flange surface (82*b*). As shown the weep projections (84) may be substantially parallel to one another and raised from the bottom flange surface (82*b*). In other words, and as shown in FIG. 9B, each pair of immediately adjacent weep projections (84) have a single weep channel (83) formed therebetween. The weep channels (83), as will be described in greater detail below, selectively permit (in cooperation with aspects of the drain stopper (90)) the drainage of excess water from the bathtub (101) that may accumulate about an exterior portion of the flange (82) when the drain trim (80) is installed with the drain spud (70). In effect, the weep projections (84) will allow the bottom flange surface (82*b*) of the drain trim (80) to remain slightly spaced from the flange (72) of the drain spud (70) so as to create a path through which weep drainage water may flow. More particularly, water is urged from a periphery of the drain trim (80), through the weep channels (83), and toward the drain port (101*b*) substantially along a weep fluid flow path (WFF) for ultimate drainage into the main drain system. In one aspect, the weep fluid flow path may be substantially perpendicular to the second fluid flow path ($FF_2$) associated with the drain assembly (2).

With reference to FIG. 9B, an outer surface (81*c*) of the body (81) may include a locking feature (85) for complementary engagement with the drain spud (70) as previously described. As illustrated, the locking feature (85) may comprise two quarter-turn projections (86) extending radially outwardly from the central axis ($A_{80}$) on the outer surface (81*c*). As shown in FIG. 9B, the quarter-turn projections (86) may further include a top ledge (86*a*). The top ledge (86*a*) may cooperate with an upper rail (81*d*) of the body, adjacent the flange (82), to define horizontal channels (86*b*). Although a method of installation is provided in greater detail below, to install the drain trim (80) to the drain spud (70), the drain trim (80) and drain spud (70) should be aligned along their respective central axes ($A_{80}$, $A_{70}$) and the trim (80) should be lowered into the drain spud (70), such that the projections (86) of drain trim (80) are radially disposed in between the projections (76) of the drain spud (70) (corresponding to non-projection portions of the inner surface (74)) until the projections (76) abut the upper rail (81*d*). At such point, the trim (80) may be rotated to guide the projections (76) of the drain spud (70) into the horizontal channels (86*b*) such that the projections (76) of the spud (70) are retained therein. Thus, and in substantially this manner, the projections (86) of the trim (80) may engage with the complementary projections (76) of the drain spud (70) to releasably secure the drain trim (80) to the drain spud (70). One of skill in the art will readily appreciate that the trim (80) may be disengaged from the drain spud (70) in substantially the opposite manner as set forth above for the quarter-turn installation. It should be further understood that slight departures from the method above, possibly due to variances made to the structure of the projections (76/86) are contemplated and considered to be within the scope of this disclosure.

Figure 13A:
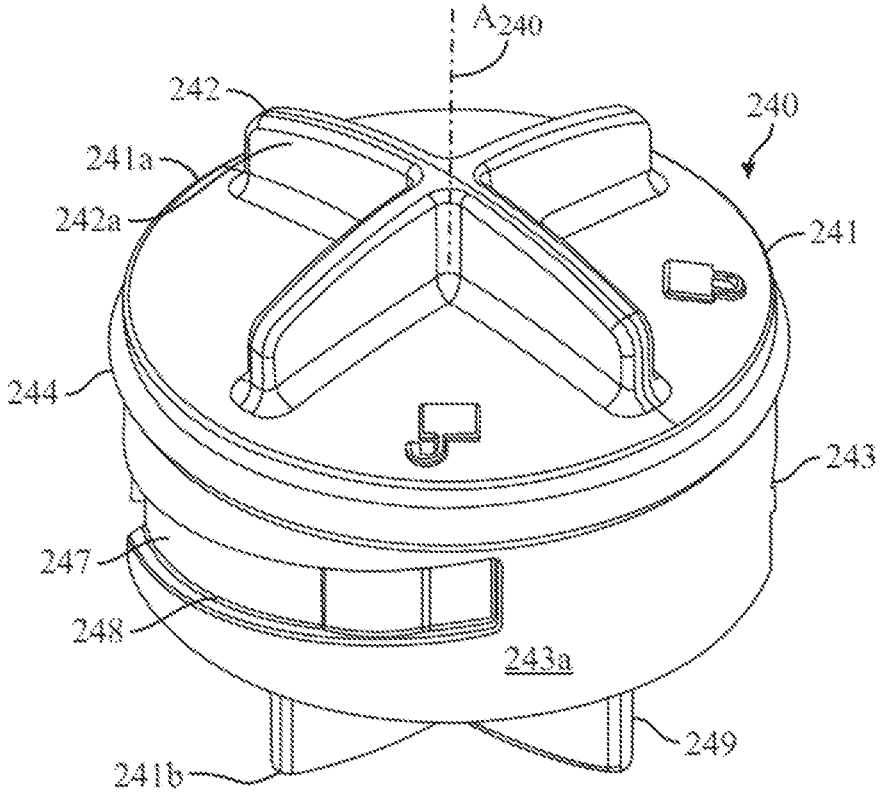
FIG. 13A is a top perspective view of an overflow test plug according to an embodiment of the invention.
Figure 13B:
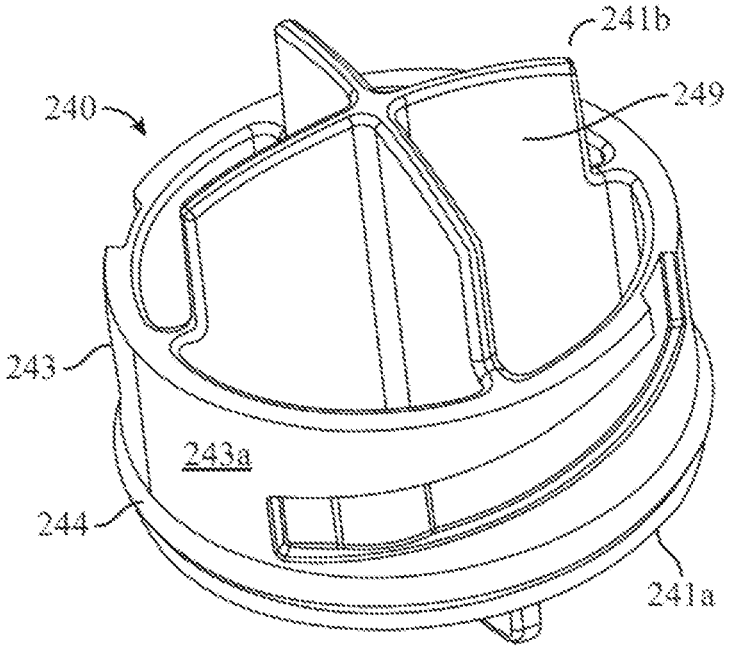
FIG. 13B is a bottom perspective view of the overflow test plug illustrated in FIG. 13A.

With reference now to FIGS. 9A and 9C, the body (81) may include a plurality of stopper-engagement channels (87) and a plurality of tool-engagement channels (88) about a periphery of an inner surface (81*e*), which is substantially opposite the outer surface (81*c*) previously described. The stopper-engagement channels (87) are sized and configured to engage with complementary projections (96) of the stopper (90) (as will be described in greater detail below) so as to both retain the stopper (90) to the drain trim (80) and also to permit operational use of the stopper (90) within the drain trim (80) (i.e., selectively opening and closing the stopper (90) to unseal and seal, respectively, the second fluid flow path ($FF_2$)). As shown most clearly in FIG. 9C, the stopper-engagement channels (87) define a generally arcuate path, including a horizontal component (87*a*) and a vertical component (87*b*). The horizontal component (87*a*) includes a notch (87*c*) at a terminal portion thereof. As will be described in greater detail below with respect to the drain stopper (90), the notch (87*c*) provides a seat for the stopper (90) to be retained in the open configuration, thereby opening the second fluid flow path ($FF_2$). To transition the stopper (90) from the open configuration to the closed configuration, the complementary projections (96) of the stopper (90) may be guided through the arcuate path of the stopper-engagement channels (87) from the notch (87*c*) and into the vertical components (87*b*). As will be described in greater detail below, the stopper (90) may be rotated about, and translated along, its own central axis in order to facilitate guiding the complementary projections (96) in the aforesaid manner. As shown in FIG. 9C, the stopper-engagement channels (87) may further include a locking ridge (87*d*) that provides access to the stopper-engagement channels (87) from the first end (81*a*) of the drain trim (80). The locking ridge (87*d*) allows the drain stopper to be selectively placed within (or removed from) the stopper-engagement channels (87) as would be necessary during installation, repairs, or replacements. In the illustrated embodiment, the drain trim (80) has two stopper-engagement channels (87), but it is contemplated that a different number of channels may be used, and such variation is considered to be within the scope of the invention. The tool-engagement channels (88), as shown in FIG. 9C are vertically oriented and parallel to the central axis ($A_{80}$) of the drain trim (80). It is contemplated that the tool-engagement channels (88) will facilitate both installation and removal of the drain trim (80) from the drain spud (70) using, for example, the quarter-turn process detailed above. In operation, a tool may be inserted downwardly to engage some (or all) of the tool-engagement channels (88) so as to facilitate manipulation of the drain trim (80). For convenience, and as shown in FIGS. 13A and 13B, the overflow test plug (240) may include a cross-shaped tool element (249) on a bottom portion thereof, and the tool element (249) may be conveniently used to engage the tool-engagement channels (88) of the drain trim (80). This feature allows for simpler and more expedient installation and repair/replacement of the drain trim (80) since an operable tool is built right into the overflow test plug (240) that will already be available to the user affecting the installation.

Figure 9D:
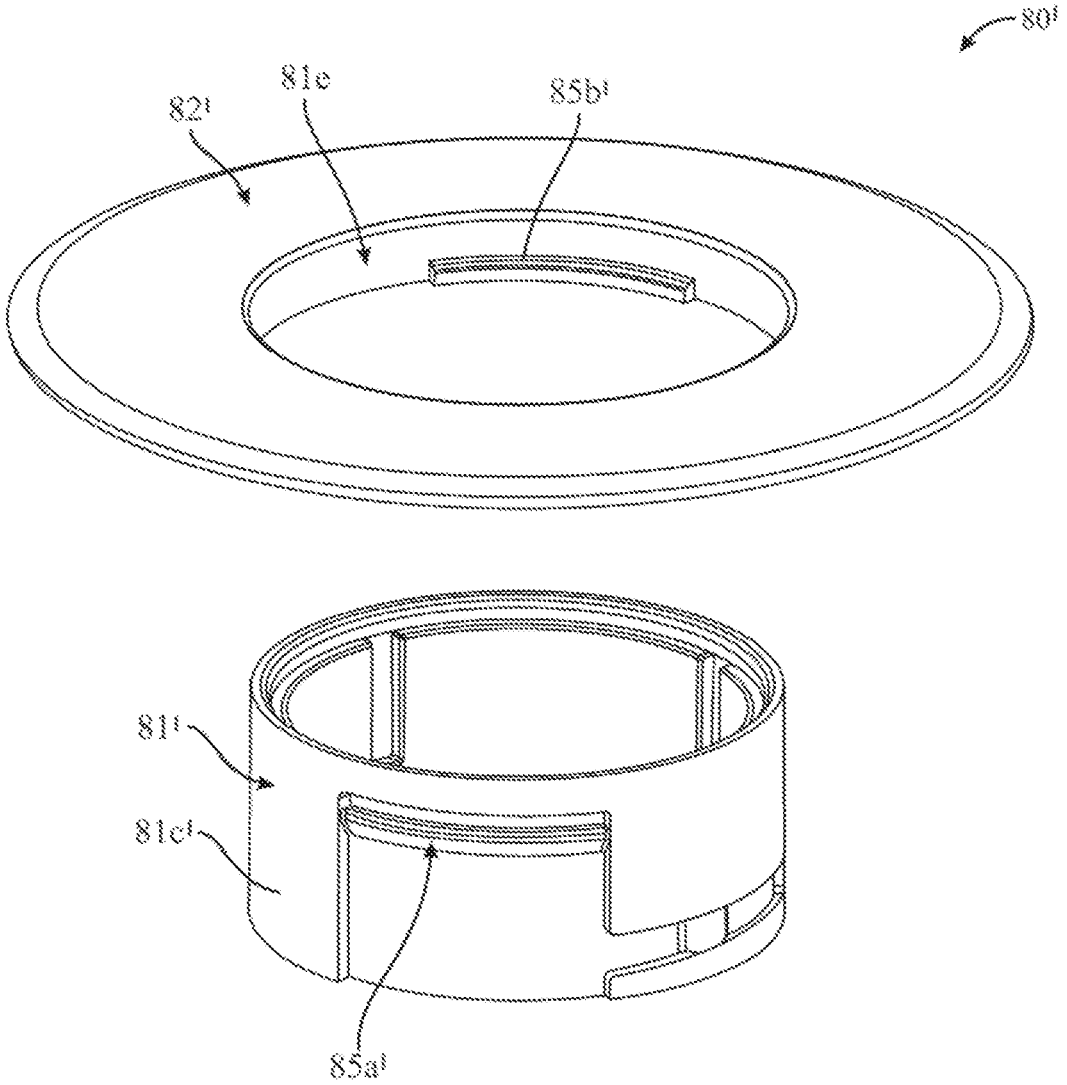
FIG. 9D is perspective view of an alternative embodiment of a drain trim.

FIG. 9D illustrates a perspective view of an alternative embodiment of a drain trim (80'). Portions of the embodiment disclosed in FIG. 9D are similar to aspects described above in FIGS. 9A through 9C and those portions function similarly to those described above. The drain trim (80') includes a drain trim flange (82') that is detachably coupled to an exterior surface (81*c'*) of a body (81') of the drain trim (80'). The drain trim (80') includes a trim locking feature (85*a'*) on the exterior surface (81*c'*) that is connectable to a flange locking feature (85*b'*) on an inner flange surface (81*e'*) of the drain trim flange (82'). In an aspect, the trim locking feature (85*a'*) is a protrusion that snaps over the flange locking feature (85*b'*).

Figure 10A:
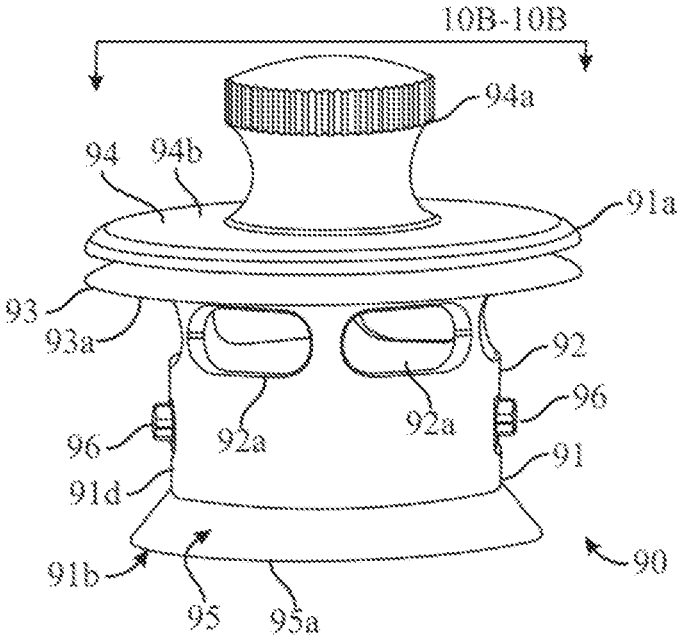
Figure 10B:
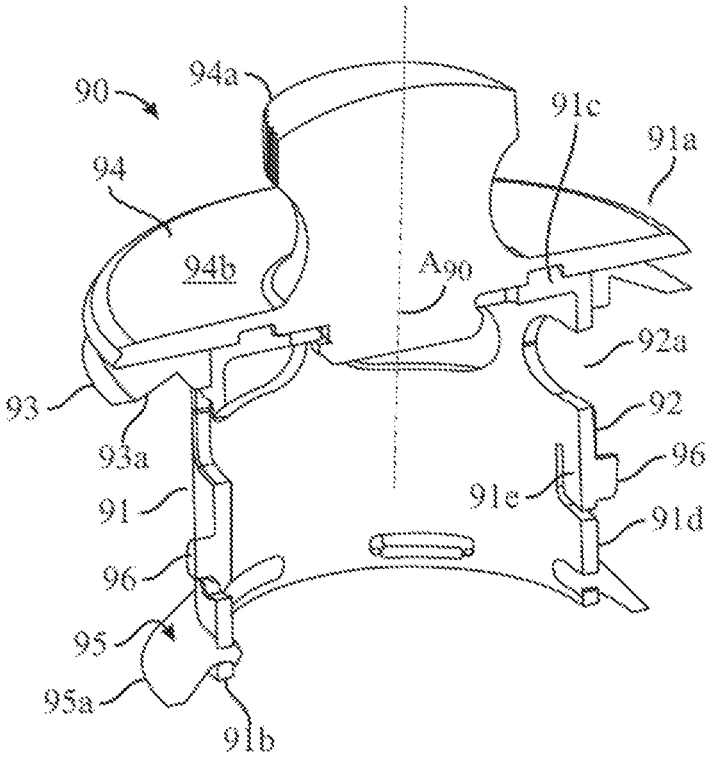
Figure 10C:
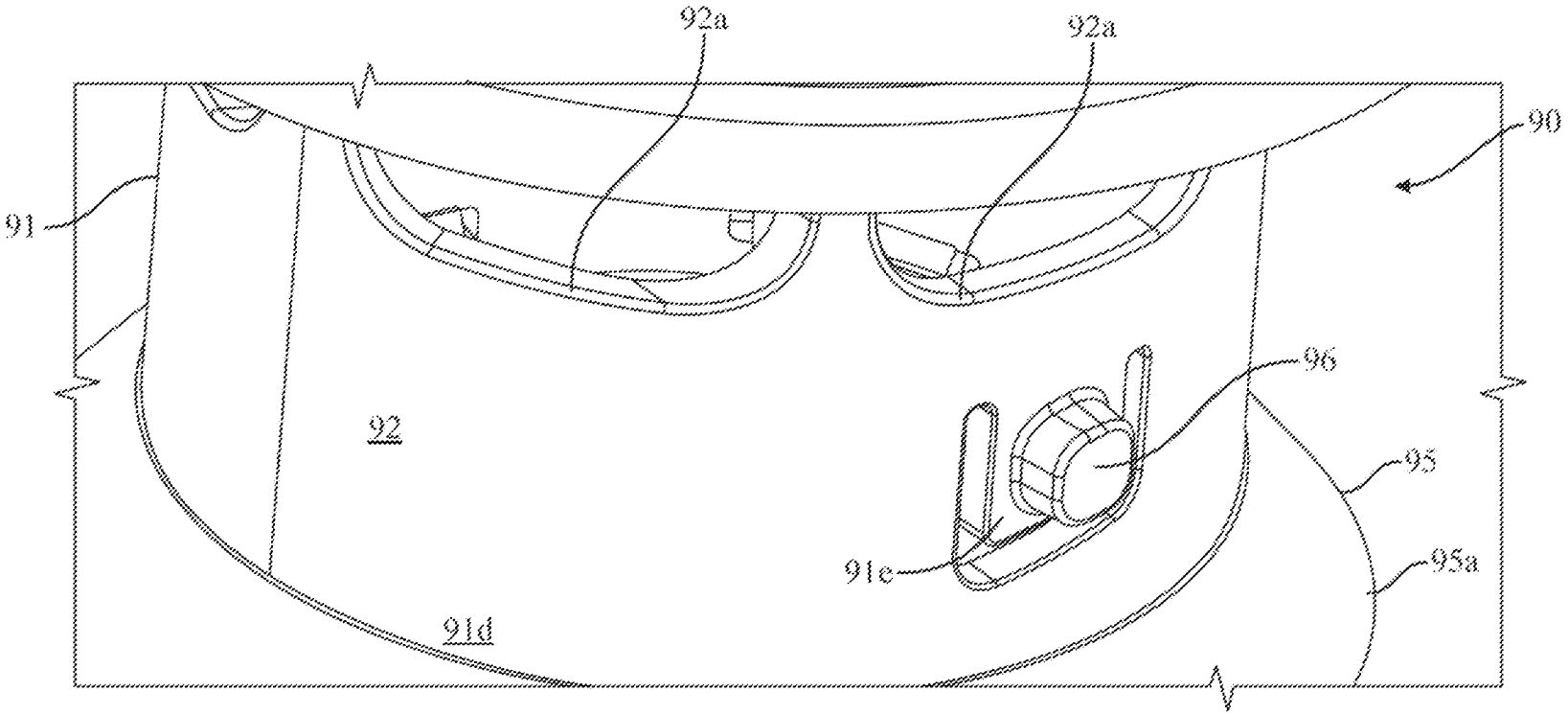
Figure 10D:
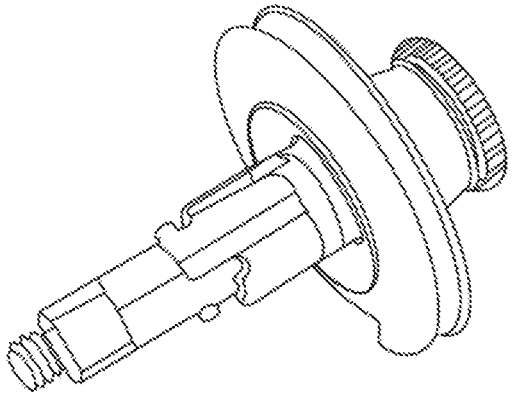

With reference now to FIGS. 10A-10C, the drain stopper (90) is illustrated according to an embodiment. The stopper (90) includes a generally cylindrical body (91) that extends along a central stopper axis ($A_{90}$) from a first end (91*a*) to a second end (91*b*). The body (91) comprises a strainer (92)

which defines a plurality of drain apertures (92*a*) therein about a periphery of the body (91) adjacent the first end (91*a*). When the drain stopper (90) is disposed in the open configuration (described above), water in the bathtub (101) will drain along the second fluid flow path ($FF_2$) by first entering the apertures (92*a*) and passing downwardly through a hollow center of the strainer (92). Because drainage is restricted by the size, shape, and number of apertures (92*a*) in the strainer (92), entrained matter can be "strained" out of the drained water so that it does not enter the drain and pose a potential clog risk. In this manner, and advantageously, the strainer (92) is built directly into the stopper (90) rather than, as existing strainers require, being added on top of existing structures.

As shown particularly in FIG. 10B, the first end (91*a*) of the body (91) carries a top seal element (93). The top seal element (93) comprises an elastomeric sealing component (93*a*) that is disposed about a periphery of the body (91) at the first end (91*a*). It is alternatively contemplated in some embodiments that the top seal element (93) may be overmolded or otherwise attached to the body (91) of the stopper (90) during a manufacturing process before being provided to the end user. Such means of attachment are advantageous as they simplify installation of the drain stopper (90). Adjacent the top seal element (93), the stopper (90) has a drain stopper cap (94) that is mounted to a connection plate (91*c*) of the body (91). The cap (94) includes a knurled knob (94*a*) that permits a user to manipulate the stopper (90) so as to both rotate and translate the stopper (90) along its central axis ($A_{90}$). The cap (94) also includes a flange (94*b*) that is integrally formed with the knob (94*a*). The cap (94) may be made of metal, such as stainless steel, brass, or nickel. When the stopper (90) is disposed in the closed configuration, the weight of the cap (94), and more particularly the flange (94*b*), generates a gravity-induced compression force against the top seal element (93) so as to sealingly engage the top seal element (93) (and hence, the stopper (90)) against a top flange surface (82*a*) of the flange (82) of the drain trim (80). This engagement, while the drain stopper (90) is in the closed configuration, advantageously creates a fluid-tight seal between the drain stopper (90) and the drain assembly (2).

With continuing reference to FIGS. 10A and 10B, the second end (91*b*) of the body (91) carries a bottom seal element (95). The bottom seal element (95) comprises an elastomeric sealing component (95*a*) that is disposed about a periphery of an outer surface (91*d*) of the body (91) at the second end (91*b*). In one respect, the bottom seal element (95) may be considered to be downstream of the top seal element (93) when the stopper (90) is installed in the system (100) and within the drain port (101*b*) of the bathtub (101). It is alternatively contemplated in some embodiments that the bottom seal element (95), like the top seal element (93) described above, may be overmolded or otherwise attached to the body (91) of the stopper (90) during a manufacturing process before being provided to the end user. As noted above, such means of attachment are advantageous as they simplify installation of the drain stopper (90). While the top seal element (93) described above facilitates drainage of water from the bathtub (101), the bottom seal element (95) is chiefly responsible for selectively providing weep drainage, accumulating from the weep channels (83) of the drain trim (80). In operation, the bottom seal element (95) will permit weep drainage only when the drain stopper (90) is disposed in the open configuration, which is when small quantities of remnant water will stagnate and accumulate about the periphery of the flange (82) of the drain trim (80) after the bathtub (101) has been substantially emptied of water. One of ordinary skill in the art will appreciate that weep drainage is not desired when the drain stopper (90) is in the closed configuration, chiefly because in the closed configuration, water is to be retained (and not drained) within the bathtub (101). In conformity with that principle, when the stopper (90) is in the open configuration, the bottom seal element (95) will sealingly engage with the inner surface (74) of the body (71) of the drain spud (70). When the stopper (90) is in the open configuration, the bottom seal element (95) will fold downwardly and within the drain trim (when the drain assembly (2) is in the installed configuration) at the moment it comes into contact with the inner surface (81*e*) of the drain trim (80). When the bottom seal element (95) is folded in this manner, it will unblock a portion of the strainer (92) adjacent the outer surface (91*d*) of the body (91) so as to advantageously allow weep drainage into the drain assembly (2) in the manner described above.

The outer surface (91*d*) of the drain stopper (90) further includes projections (96) that protrude outwardly therefrom. As illustrated more particularly in FIG. 10C, the projections (96) may reside on top of a flexible cutout (91*e*) of the body (91). The flexible cutout (91*e*) permits hinge-like movement of the projections (96) as the cutout (91*e*) has been partially detached from a remaining portion of the outer surface (91*d*) of the body (91). The flexibility provided by the cutouts (91*e*) to the projections (96) enables the stopper (90) to be securably inserted into (or removed from) the stopper-engagement channels (87) of the drain trim (80), as described in greater detail above. Specifically, the flexibility of the projections (96) as provided by the cutouts (91*e*) permits the projections (96) to temporarily recess within strainer (92) so that that stopper can be guided over the locking ridge (87*d*) as described above. By contrast, a rigid design not having the cutouts (91*e*) would not be "removably" secured to the stopper-engagement channels (87) but would instead (disadvantageously) be irremovably secured using the structures disclosed above. Users prefer versatility and the ability to repair/replace drain and overflow components when needed, so the existing design meets that needs and saves significant time during both installation and removal.

A method of installing the bath waste and overflow system (100) of the present disclosure may be carried out as follows (with reference to FIGS. 2B and 2C for illustration purposes).

With regards to the overflow assembly (1): the neck portion (13) of the overflow elbow (10) may be fitted with the overflow gasket (40) and subsequently inserted through the overflow port (101*a*) of the bathtub (101) such that the gasket abuts the outer wall (101*c*) of the bathtub (101) adjacent the overflow port (101*a*). Next, the retention nut (30) may be threaded onto the threaded portion of the neck portion (13) from the inside of the bathtub (101) so as to secure the overflow elbow (10) to the overflow port (101*a*) and so as to compress the overflow gasket (20) to the outer wall (101*c*) of the bathtub (101) so as to create a leak proof seal between the overflow elbow (10) and the bathtub (101). In some situations, the overflow elbow (10) may (as a preliminary step) be secured to an extension pipe (4) that is in fluid communication with the main drain system. In other situations, the overflow elbow (10) may be secured to the extension pipe (4) after the overflow elbow (10) has been secured to the overflow port (101*a*) of the bathtub (101). Such securing of the overflow elbow (10) to the extension pipe (4) may be accomplished using conventional means, such as solvent cement or by using a fastening means. At this juncture, the plumber or user should determine whether he/she is desirous of performing a pressure-related test of the system (100) before completing the installation. If so, the plumber or user should proceed forward with the testing method, as set out below in this disclosure. If not, then the method may continue as below.

Subsequently, the central axis ($A_{80}$) of the overflow faceplate (40) should be aligned with an axis ($A_{13}$) of the neck portion (13) of the overflow elbow (10). Upon such alignment, the overflow faceplate (40) may be overlaid (or introduced) onto the retention nut (30) so as to obscure the retention nut (30) therebeneath without physically contacting the retention nut (30). Next, a portion of the overflow faceplate (40) may be inserted into the interior of the neck portion (13) such that the projections (18) (or other suitable locking features (17)) on the interior of the neck portion (13) are received within the open portion (48*a*) of the channel (48) of the overflow faceplate (40). After the projections (18) are so received therein, the overflow faceplate (40) may be rotated about its central axis ($A_{40}$) so as to guide the projections (18) through the channels (48) and toward the terminal portion (48*b*). The rotating step may be performed with by the user with his/her hands by manipulating the operable handle (42), or alternatively it may be performed by using a plumbing tool or other conventional tool known in the art. The rotating step may continue such that the projections (18) approach and surpass one or more ridges (48*c*) within the channels (48) on their journey toward the terminal portions (28*b*) of the channels (48), wherein continuing the rotating step incrementally reduces the distance between the engagement edge (41*d*) of the overflow faceplate (40) and the inner wall (101*d*) of the bathtub (101) (and hence, more generally, between the overflow faceplate (40) and the overflow elbow (50)). The rotating step may be discontinued when the engagement edge (41*d*) is secured to (or simply abuts) the inner wall (101*d*) of the bathtub (101) adjacent the overflow port (101*a*).

With regards to the drain assembly (2): the drain elbow (50) may be fitted with the drain gasket (60) to the extent the gasket (60) is not already pre-installed, factory-assembled, or overmolded to be disposed on the flange (51) of the elbow (50). Next, the elbow (50) may be positioned adjacent the drain port (101*b*) at the exterior of the bathtub (101) and secured thereto by threading the drain spud (70) into the interior threaded portion (52) of the drain elbow (50) from the interior of the bathtub (101). In this respect, the drain spud (70) may be inserted along the insertion direction into the drain elbow (50). This securing step will likewise cause the drain gasket (60) to be compressed against the outer wall (101*c*) of the bathtub (101) so as to create a leak proof seal between the elbow (50) and the bathtub (101). Although not specifically illustrated, and as introduced in the description above, the plumber or user may also apply plumber's putty, silicone, or some other sealant on a bottom portion of the flange (72) of the drain spud (70) so as to seal the same at the drain port (101*b*). This compression (like that for the overflow assembly (1)) in combination with application of a sealant to the flange (72) in this fashion, will ensure a desirable leak-proof seal. In some situations, the elbow (50) may (as a preliminary step) be secured to an extension pipe (4) that is in fluid communication with the main drain system before securing the elbow (50) to the drain port (101*b*) of the bathtub (101). In other situations, the elbow (50) may be secured to the extension pipe (4) after having been secured to the overflow port (101*b*) by the drain spud (70).

Next, the drain trim (80) and drain spud (70) may be aligned along their respective central axes ($A_{80}$, $A_{70}$) and the drain trim (80) may be lowered and inserted into the drain spud (70) substantially along the insertion direction, such that the projections (86) of the drain trim (80) are radially disposed in between the projections (76) of the drain spud (70) (corresponding to non-projection portions of the inner surface (74)) until the projections (76) abut the upper rail (81*d*). After the drain trim (80) has been inserted into the drain spud (70) as set forth above, the drain trim (80) may be rotated about its central axis ($A_{80}$) to guide the horizontal channels (86*b*) along a circumference of the spud (70) to receive the projections (76) of the spud (70) and to retain the projections (76) therein. To accomplish this rotation, a plumber or user may utilize a plumbing tool to grasp the drain trim (80) or to engage the tool-engagement channels (88) of the drain trim (80). Conveniently, a plumber or user having access to the overflow test plug (240) may utilize the tool element (249) to perform an installation of the drain trim (80) as described above, and such tool element (249) is sized and shaped to mate directly with the tool-engagement channels (88) in an interior portion of the trim (80). Following such rotation, the drain trim (80) will be releasably secured to the drain spud (70) such that the drain trim (80) may not be translated relative to the drain spud (70) about the drain trim's central axis ($A_{80}$).

Once the drain trim (80) is so secured, the plumber or user can proceed to install the stopper (90) within the trim (80). In a first aspect, the respective central axes ($A_{90}$, $A_{80}$) of the stopper (90) and trim (80) may be substantially aligned, such that the stopper (90) can be lowered into a central opening of the trim (80). In a further aspect, the drain stopper (90) may need to be rotated about its central axis ($A_{90}$) so as to align the projections (96) of the stopper (90) with the locking ridges (87*d*) of the drain trim (80). Next, the plumber or user will engage the projections (96) directly with the locking ridges (87) by translating the stopper (90) downwardly and into the central opening of the trim (80), where such translation causes the projections (90) to temporarily recess within the strainer (92) of the stopper (90). The translating downwardly step may be discontinued once the projections (96) of the stopper have passed over the locking ridge (87*d*) and into the generally arcuate path of the drain trim (80). The plumber or user may manipulate the stopper (90) so as to both rotate and translate the stopper (90) along its central axis ($A_{90}$) by grasping the knurled knob (94*a*) and using the same to actuate the stopper (90). By manipulating the stopper (90) in this manner, the plumber or user can actuate the stopper (90) between the open and closed configurations. To achieve the open configuration, the projections (96) of the stopper may be guided along the arcuate path (such as by rotating and translating the stopper (90) about and along its axis ($A_{90}$) vis-à-vis the knurled knob (94*a*)), through the horizontal component (87*a*) and into the notch (87*c*). To achieve the closed configuration, the projections (96) of the stopper may be guided along the arcuate path (also such as by rotating and translating the stopper about and along its axis ($A_{90}$) vis-à-vis the knurled know (94*a*)) and into the vertical components (87*b*), wherein the stopper (90) will translate downwardly until the top seal element (93) seals against the top flange surface (82*a*) of the flange (82) of the drain trim (80). In another aspect, once the projections pass into the vertical components (87*b*), the weight of the cap (94) of the stopper (90) may automatically generate a gravity-induced compression force, directed downwardly against the top seal element (93) so as to sealingly engage the top seal element (93) (and hence, the stopper (90))

against a top flange surface (82*a*) of the flange (82) of the drain trim (80). In either respect, this engagement in the closed configuration advantageously and automatically creates a fluid-tight seal between the drain stopper (90) and the drain assembly (2).

It should be further understood that slight departures from the method above, possibly due to variances made to the structure of the projections (18, 76, or 96) or the structure of the channels (48, 87) are, of course, contemplated and considered to be within the scope of this disclosure. Similarly, the steps are not required to be performed in precisely the order as presented above, and the steps may also be combined with one another by the plumber or user in the field to save time and effort as may be required or deemed necessary under the circumstances of the test. These variations in the method are specifically and expressly contemplated and also considered to be within the scope of this disclosure.

Figure 10E:
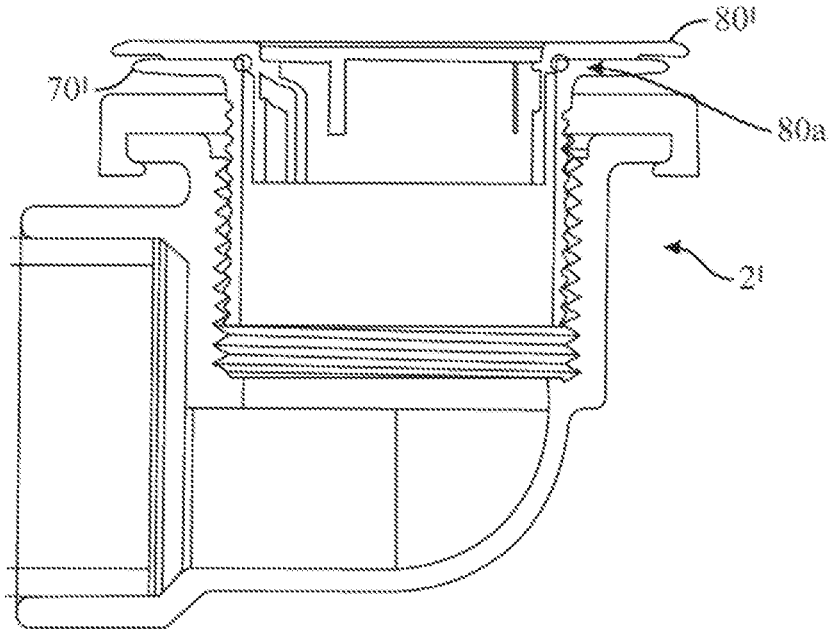
Figure 10F:
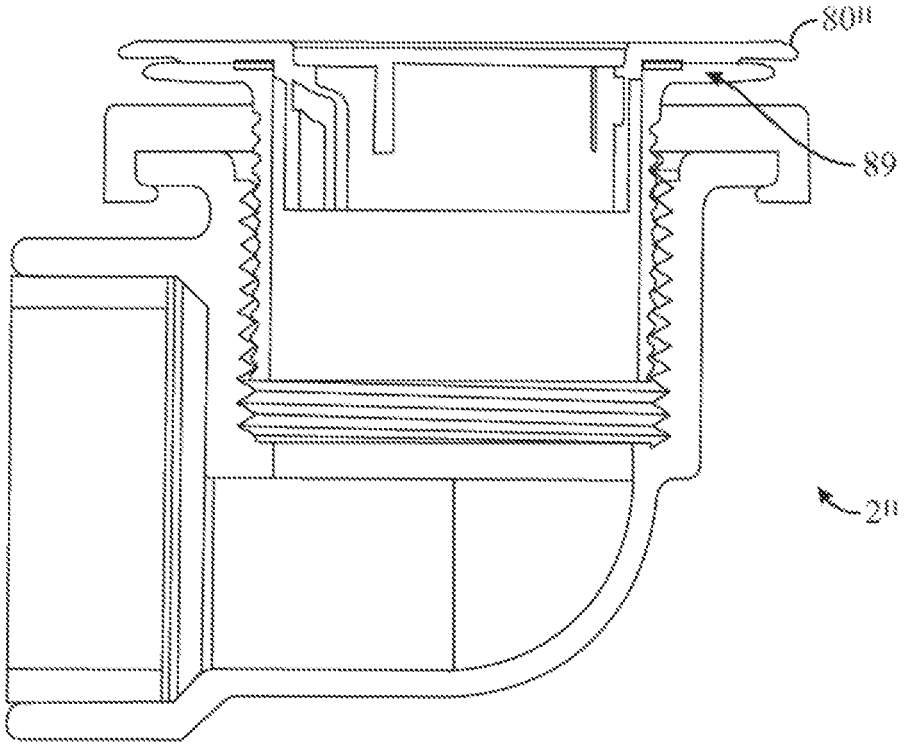
Figure 10G:
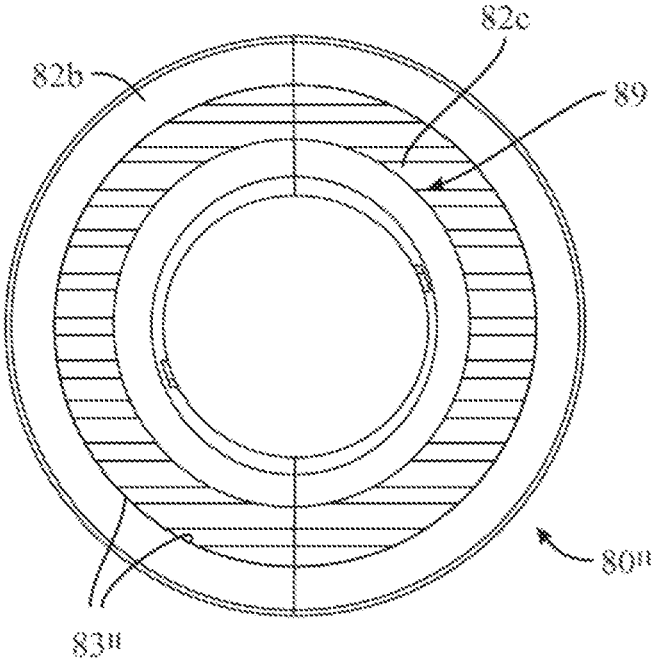

As noted above, some users may desire (for any number of subjective reasons or preferences) to utilize the traditional "lift and turn" drain stopper (see FIG. 10D), a toe touch stopper (not illustrated), or a tap tap drain stopper (not illustrated) in connection with the disclosed system (100) in favor of the drain stopper (90) disclosed herein. It is contemplated that the system (100) could be adapted to receive any of these known stopper designs, as detailed in part below with the lift and turn drain stopper (as but one example), and all such variations are considered to be within the scope of this disclosure. In the instance of a lift and turn drain stopper, as already explained, the plumber or user may utilize the alternative drain spud (70') which has additional elements designed to receive the traditional "lift and turn" drain stopper. However, in such instances where a "lift and turn" stopper is desired, a difficulty exists particularly with the drain trim (80) as disclosed above. Namely, because the traditional "lift and turn" stopper does not have a bottom seal element (95) like that of the stopper (90), weep drainage cannot be sealed off at a lower portion of the drain when the bathtub (101) is filled with water and the "lift and turn" stopper is in a closed configuration (similarly intended as the closed configuration in connection with the stopper (90)). Accordingly, in such an instance, the weep drainage aspects of the drain trim (80) will provide undesirable weep drainage so as to slowly drain the tub, even when the "twist and pull" stopper is in the closed position. To combat this undesirable affect, FIG. 10E and FIGS. 10F-10G illustrate (respectively) two alternative embodiments of the drain assembly (2' and 2") and its various components that would address this concern. It is noted that components of the alternative drain assemblies (2', 2") that otherwise are identical to the drain assembly (2) as previously described will be identified with an asterisk (') and a double asterisk ("), respectively, to signify their similarity in function and design.

In the first alternative embodiment of the drain assembly (2'), shown partially in FIG. 10E in cross-section, the weep channels (83, see FIG. 9B pertaining to drain trim (80)) have been removed entirely from the drain trim (80'). In their place, and as shown in FIG. 10E, a standard O-Ring (80*a*) has been added about the periphery of the junction between the drain trim (80') and the drain spud (70'). In this respect, the O-Ring (80*a*) seals off the inside diameter of the drain spud (70'), thereby blocking any undesirable water from entering the drain assembly (2') between the spud (70') and the trim (80'). In the second alternative embodiment of the drain assembly (2"), shown partially at FIGS. 10F-10G, the weep channels (83") have not been removed from the drain trim (80"). Instead, bottom flange surface (82*b*") of the drain trim (80") has been fitted with a recess (82*c*) which may house a gasket (89), such as a flat gasket (89). The flat gasket (89), in an installed configuration on the bottom flange surface (82*b*") will seal off all of the weep channels to block all drainage along the weep fluid path. It is contemplated that the alternative drain trim (80") having the features disclosed above could potentially substitute for the drain trim (80) disclosed above for use in the drain assembly (2) having otherwise identical components as disclosed. In that respect, and where weep drainage is still desired due to usage of the stopper (90), the recess (82*c*) in the drain trim (80") need not be fitted with the flat gasket (89) as illustrated in FIG. 10F-10G.

With reference now to FIGS. 11A-11G, a bath waste and overflow system (200) according to another embodiment is illustrated. The waste and overflow system (200) differs from the previously discussed embodiments because the system (200) further includes an overflow test plug (240) and a drain test plug (280). Although the other components of the system (200) aside from the test plugs, are introduced with different component reference numbers than for the system (100), one of skill in the art will appreciate that the overflow and drain test plugs (240, 280) are usable with exactly the same components in the system (100).

As introduced previously, test plugs are utilized by plumbers (or other end users) to perform pressure-related tests on the pipelines prior to completing the installation. Each of the overflow and drain test plugs (240, 280) of the present disclosure are configured to attach quickly and easily to portions of the respective overflow and drain assemblies (1, 2) as presently disclosed and illustrated with respect to this embodiment. A method of performing a pressure test on a bath waste and overflow system according to the present disclosure is provided in greater detail below.

Figure 11A:
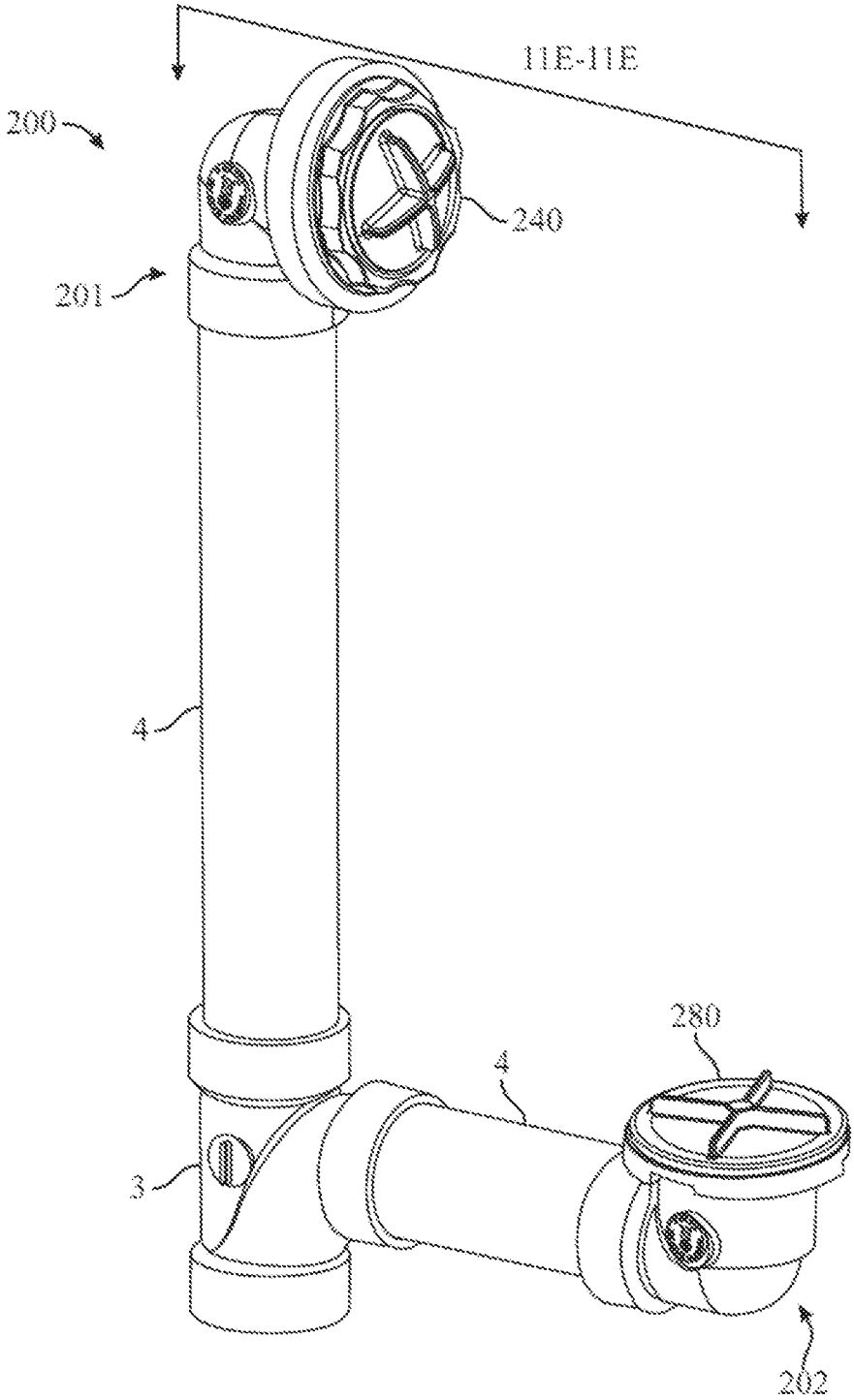
FIG. 11A is a front perspective view of a bath waste and overflow system according to another embodiment of the invention.
Figure 11B:
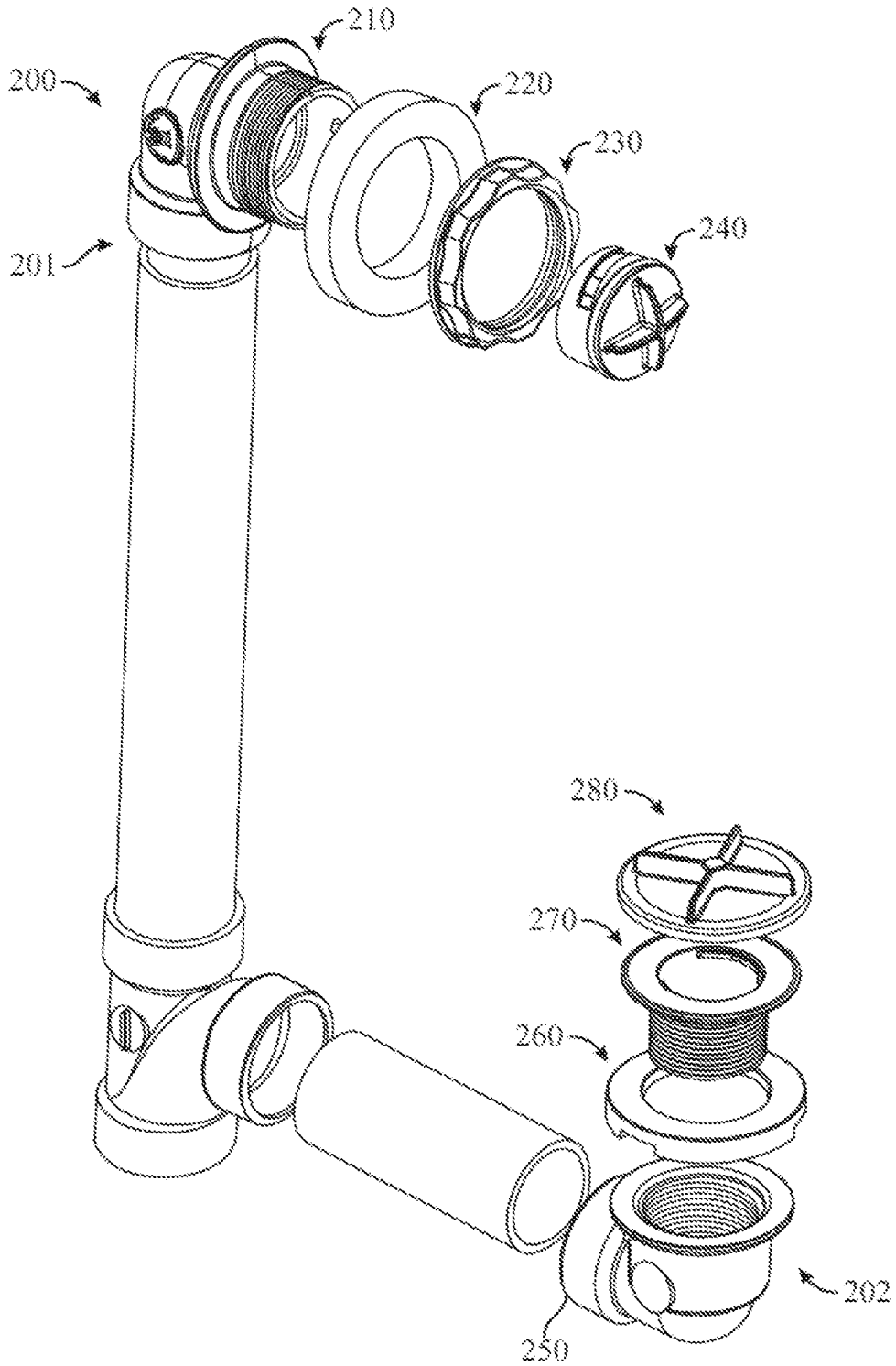
FIG. 11B is a front perspective view of the system of FIG. 11A, illustrated in an exploded form.

With reference first to FIG. 11A, the system (200) is illustrated from a front perspective view and without the bathtub for sake of clarity. The system (200) includes an overflow portion (201) and a drain portion (202) positioned (in an installed configuration) at locations respectively adjacent to the overflow port (101*a*) and the drain port (101*b*) of the bathtub. With reference to FIG. 11B, the bath waste and overflow system (200) of FIG. 11A has been illustrated in an exploded view to show all components of the respective overflow and drain portions (201, 202) in the relative manner that they are arranged when each of the portions is finally installed to the tub (i.e., in an installed configuration).

Figure 11C:
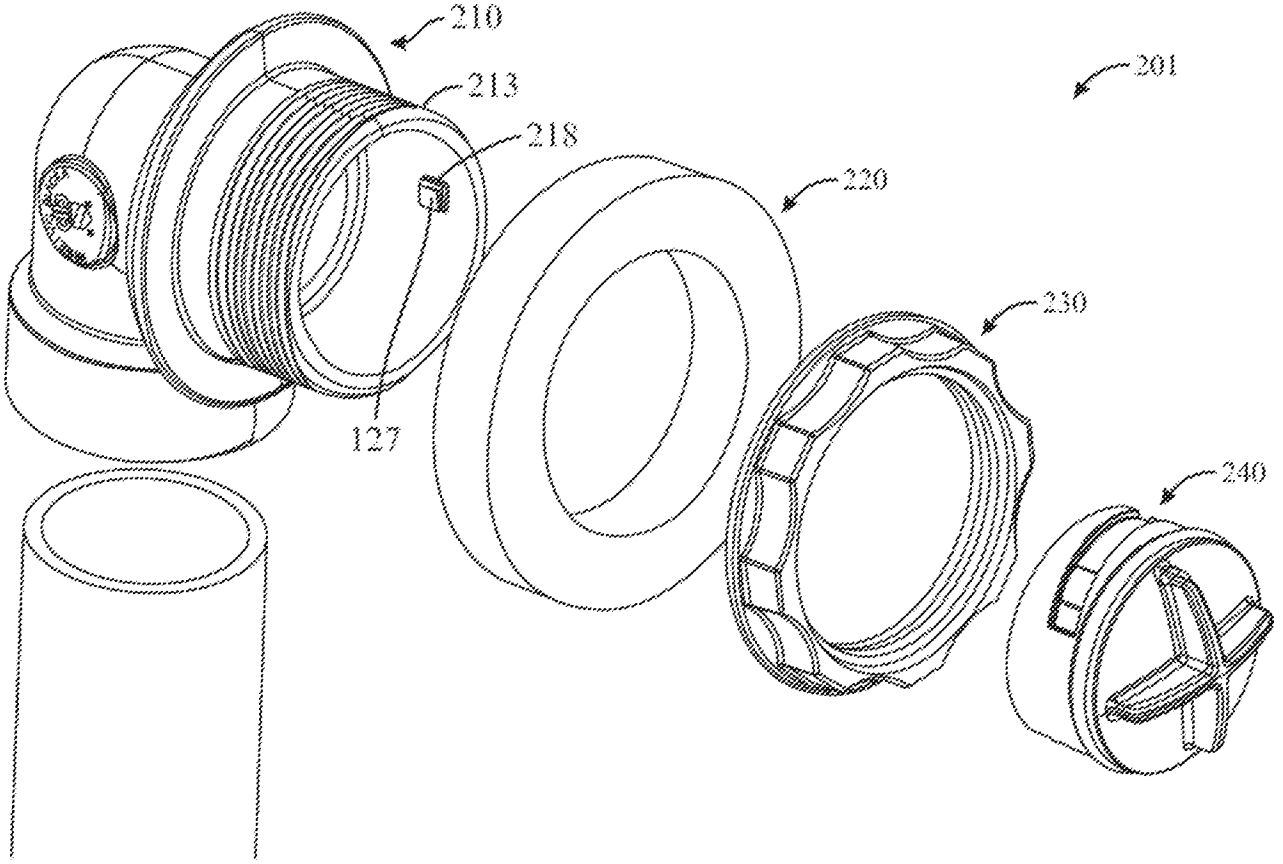
FIG. 11C is a detailed perspective, exploded view of an overflow portion of the system illustrated in FIG. 11B.
Figure 11D:
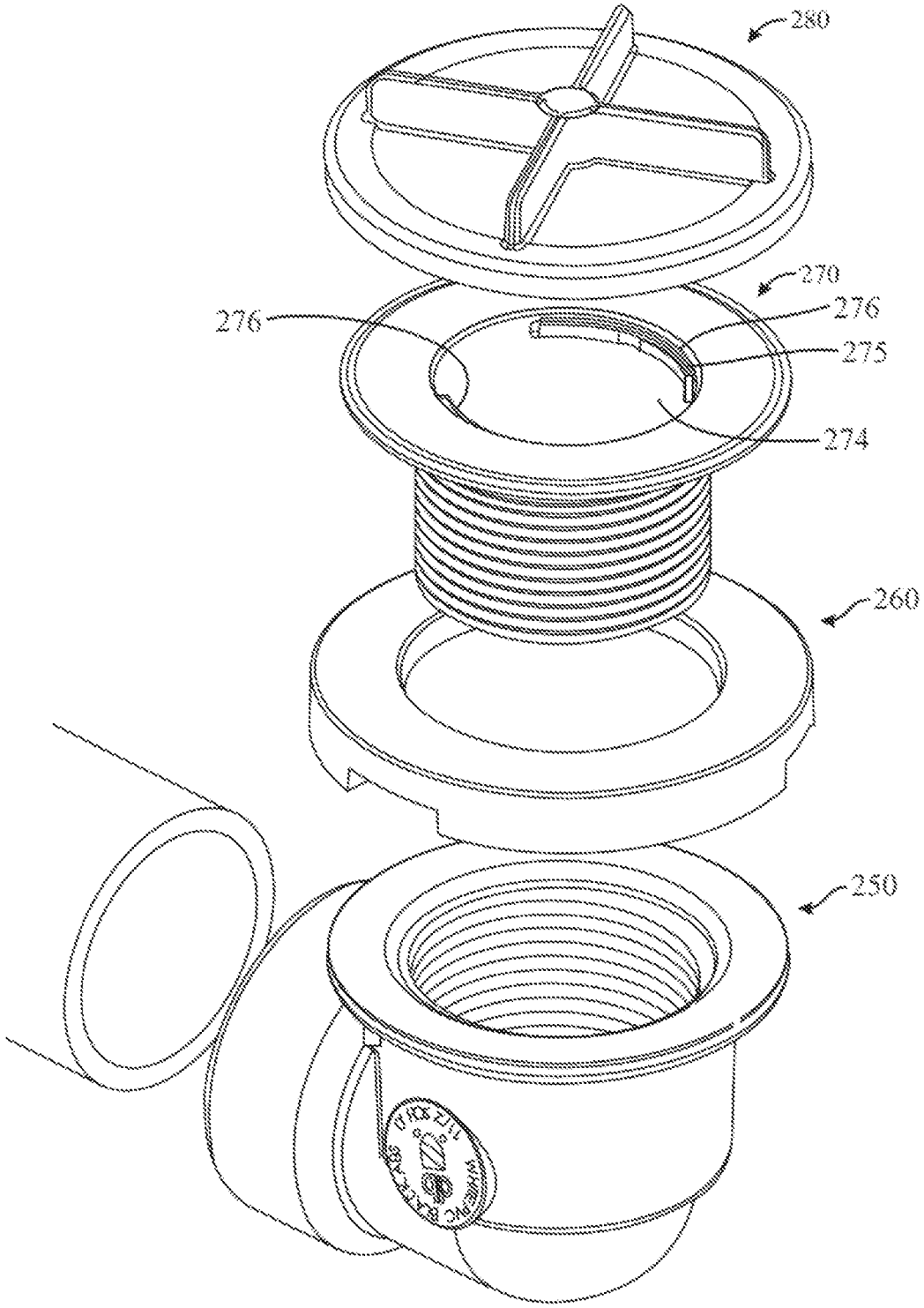
FIG. 11D is a detailed perspective, exploded view of a drain portion of the system illustrated in FIG. 11B.
Figure 11E:
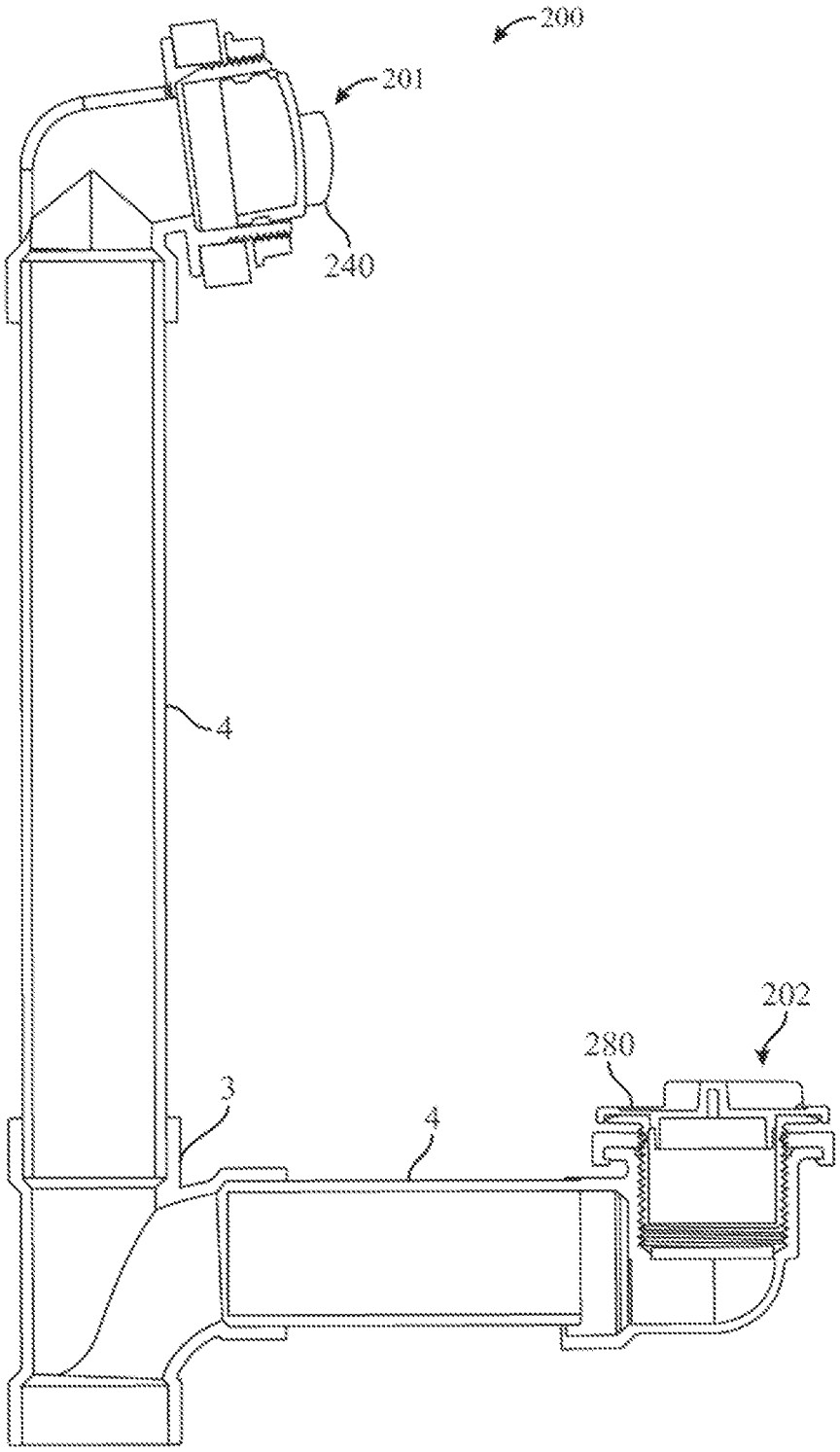
FIG. 11E is a side cross-sectional view of the system illustrated in FIG. 11A, such cross-section being taken along lines 11E-11E, as shown in FIG. 11A.
Figure 11F:
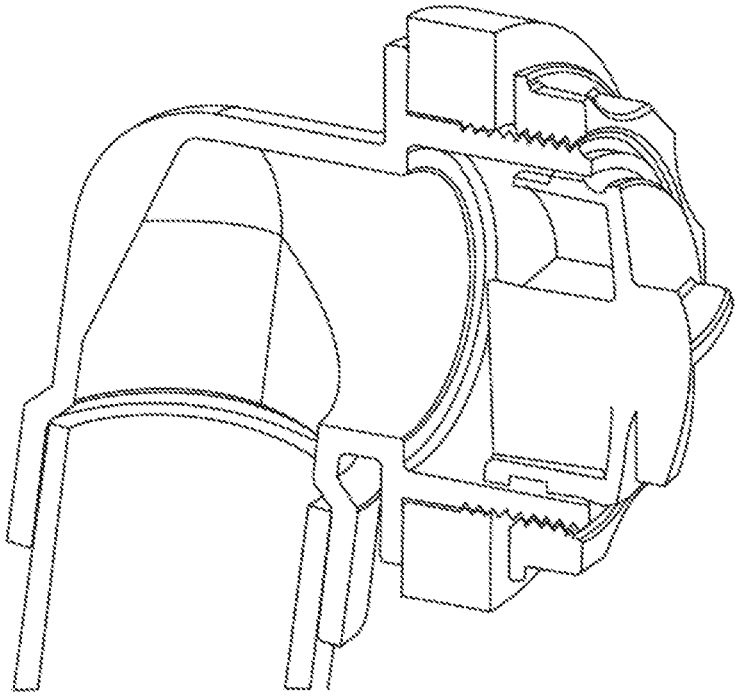
FIG. 11F is a detailed perspective, cross-sectional view of an overflow portion of the system illustrated in FIG. 11E, such cross-section being taken along lines 11E-11E, as shown in FIG. 11A.
Figure 11G:
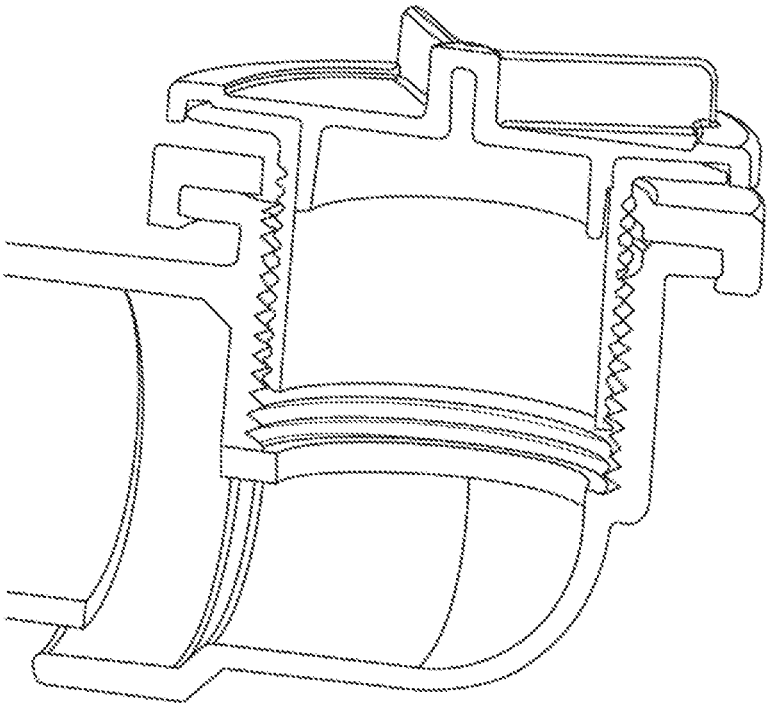
FIG. 11G is a detailed perspective, cross-sectional view of a drain portion of the system illustrated in FIG. 11E, such cross-section being taken along lines 11E-11E, as shown in FIG. 11A.

The drain portion (202) is shown in an exploded, detailed view in FIG. 11D. As shown, the drain portion (202) generally includes a drain elbow (250), a drain gasket (260), and a drain spud (270). The drain test plug (280) is operable with the drain portion (202) to perform pressure related testing. The drain elbow (250), drain gasket (260), and drain spud (270) are structurally identical to the drain elbow (50), drain gasket (60), and drain spud (70) of the system (100), and so those portions of description above relating to the components in system (100) are hereby incorporated by reference for system (200). Although a method of performing a pressure test using the drain portion (202) of the system (200) will be provided in greater detail below, it is sufficient to note that the drain spud (270), like the spud (70) will thread into the drain elbow (250), and furthermore that the drain spud (270), also like the spud (70), the inner surface (274) may include a locking feature (275) for complementarily engaging the drain test plug (280). As illustrated best in FIG. 11D, the locking feature (275) may comprise two quarter-turn projections (276) extending radially inwardly toward a central axis ($A_{270}$) of the drain spud (270) from the inner surface (274).

Figure 12A:
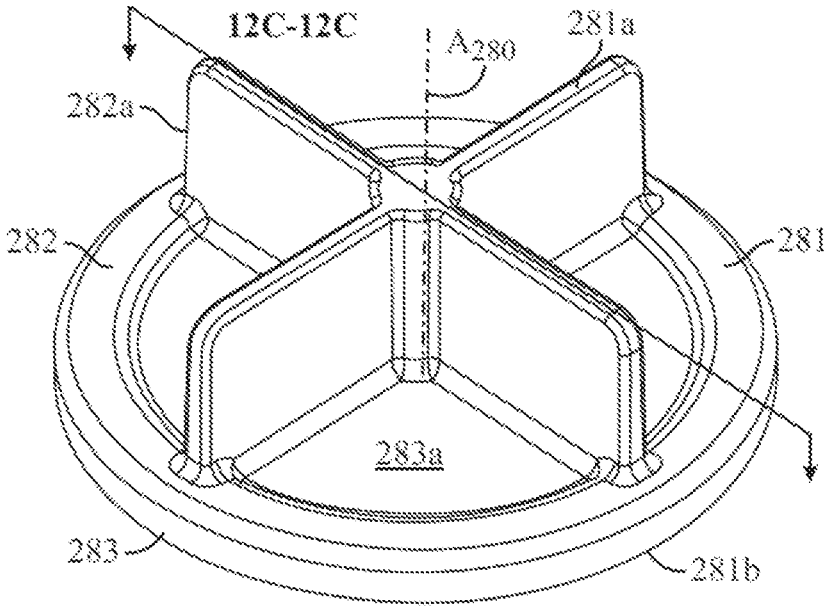
FIG. 12A is a top perspective view of a drain test plug according to an embodiment of the invention.
Figure 12B:
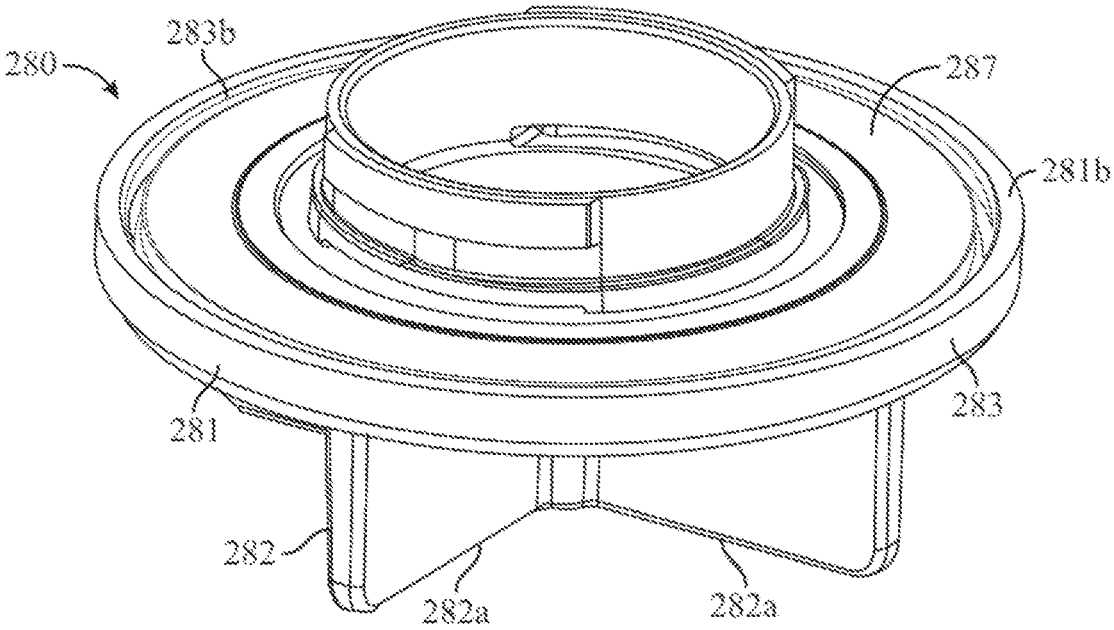
FIG. 12B is a bottom perspective view of the drain test plug illustrated in FIG. 12A.
Figure 12C:
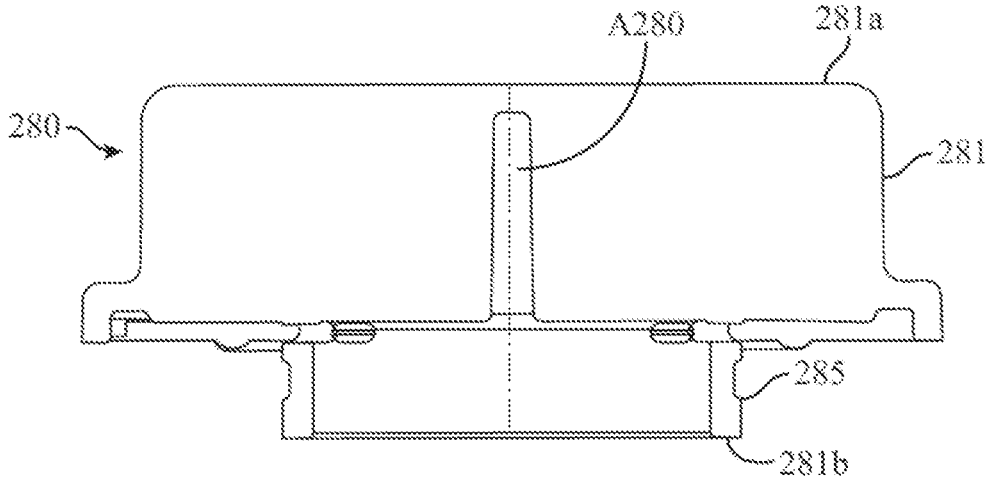
FIG. 12C is a side elevation, cross-sectional view of the drain test plug illustrated in FIGS. 12A-12B, such cross-section being taken along lines 12C-12C, as shown in FIG. 12A.

With reference now to FIGS. 12A and 12B, the drain test plug (280) is illustrated according to an embodiment. The drain test plug (280) has a generally elongate body (281) that extends along a central axis ($A_{280}$) between a first end (281*a*) and a second end (281*b*). The first end (281*a*) of the drain test plug (280) includes an operable handle (282) that is capable of being grasped by a user's hand (or by a tool) in order to manipulate, rotate, translate, or otherwise affect the position of the drain test plug (280). As illustrated, the operable handle (282) may comprise a cross-shaped handle (282*a*), but one of skill in the art will appreciate that the handle (282) may alternatively comprise any shape that will maintain a high level of operability. The handle (282) may extend downwardly from the first end (281*a*) and terminate in a widened portion (283) of the drain test plug (280). The widened portion (283) may have a diameter ($D_{283}$) as measured with respect to the central axis ($A_{280}$). The widened portion (283) is bounded by upper and lower surfaces (283*a*, 283*b*) where the upper surface (283*a*) is located closer to the first end (281*a*) than to the second end (281*b*), and where the lower surface (283*b*) is located closer to the second end (281*b*) than to the first end (281*a*).

The lower surface (283*b*) may be advantageously fitted with a sealing gasket (287) of an elastomeric or similarly water-impervious material. Although it will be described with greater detail below with respect to the method of testing the drain portion (202), the gasket (287) is intended to be compressed onto an upper surface of a flange member (272) of the drain spud (270) when tightened thereagainst, and the result of the compression is a leak proof seal created between the drain test plug (280) and the drain spud (270) (see FIG. 11G). Accordingly, and with continuing reference to FIG. 11G, a diameter ($D_{272}$) of the flange (272) will be less than the diameter ($D_{283}$) of the widened portion (283) of the drain test plug (280), and more specifically, a diameter ($D_{287}$) of the drain gasket (287) will be larger than the diameter ($D_{272}$) of the flange (272).

Figure 12D:
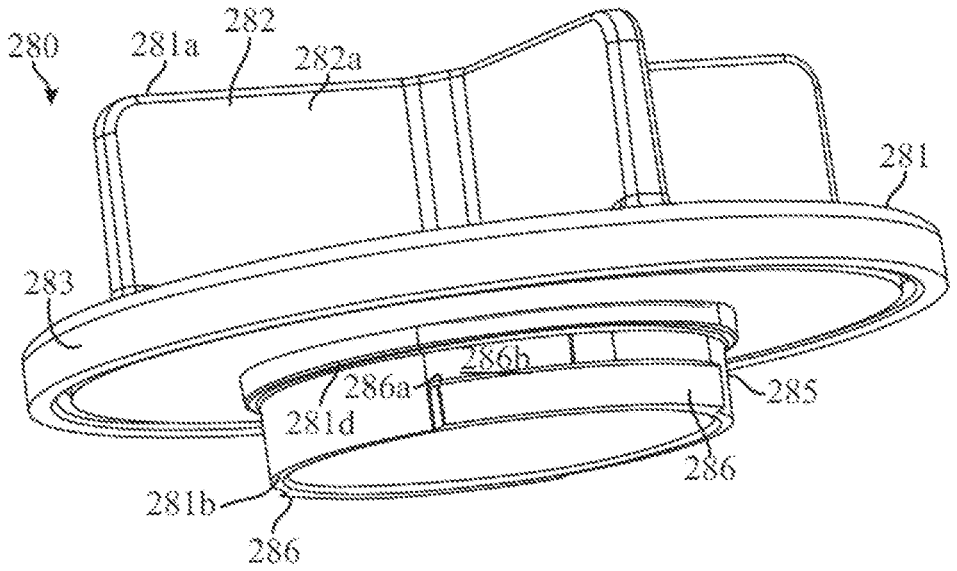
FIG. 12D is a perspective view of the drain test plug illustrated in FIGS. 12A-12C.

With reference to FIG. 12D, an outer surface (281*c*) of the body (281) may include a locking feature (285) for complementary engagement with the drain spud (270) as previously described. As illustrated, the locking feature (285) may comprise two quarter-turn projections (286) extending radially outwardly from the central axis ($A_{280}$). As shown in FIG. 12D, the quarter-turn projections (286) may further include a top ledge (286*a*). The top ledge (286*a*) may cooperate with an upper rail (281*d*) of the body, adjacent the widened portion (283), to define horizontal channels (286*b*).

Figure 12E:
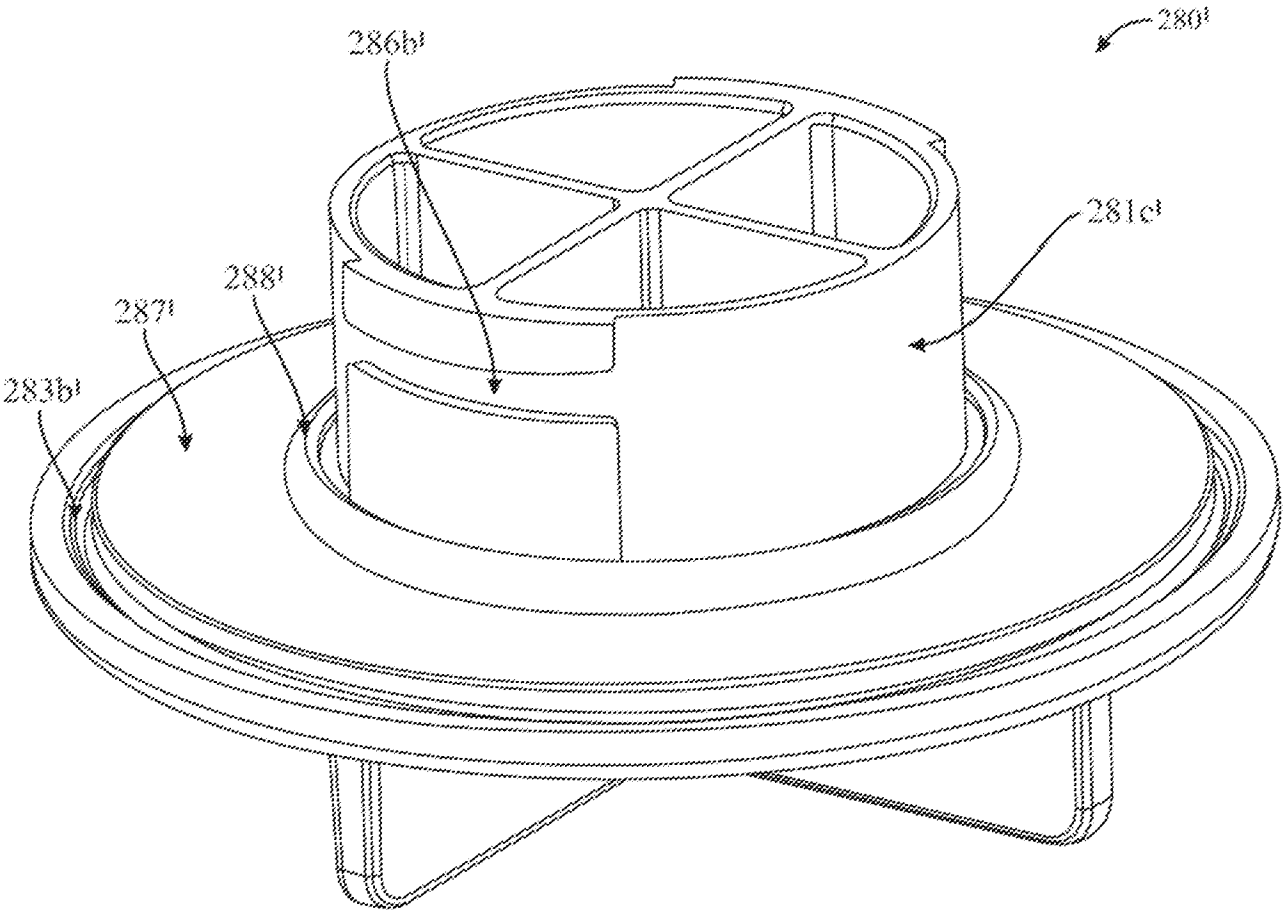
FIG. 12E is a perspective view of an alternative embodiment of a drain test plug.

FIG. 12E illustrates a perspective view of an alternative embodiment of a drain test plug (280'). Portions of the embodiment disclosed in FIG. 12E are similar to aspects described above in FIGS. 12A through 12D and those portions function similarly to those described above. A lower surface (283*b*') may be fitted with a sealing gasket (287') of an elastomeric or similarly water-impervious material. The sealing gasket (287') includes a drain sealing element (288'). The gasket (287') is configured to be compressed onto an upper surface of a flange member (272) of the drain spud (270) when tightened thereagainst, and the result of the compression is a leak proof seal created between the drain test plug (280) and the drain spud (270). When the gasket (287') is compressed onto the upper surface of the flange member (272), the drain sealing element (288') forms a fluid tight seal against a drain edge of the drain spud (270). In an aspect, the drain edge of the drain spud (270) has a chamfered configuration, such that the drain edge is circumferentially chamfered about the drain spud (270).

An outer surface (281*c*') of the drain test plug (280') includes a channel (286*b*') formed thereon. In an aspect, the channel (286*b*') has a helical shape that extends about the outer surface (281*c*'). In an alternative aspect, the channel (286*b*') includes a first portion having a helical shape and a second portion having a horizontal shape. The second portion is adjacent to the first portion. The channel (286*b*') is configured to receive the projections (276) of the spud (270) therein.

A method of performing a pressure test of the drain portion (202), including installing the drain test plug (280) to the drain spud (270) so as to effectuate the test may be detailed as follows. The drain elbow (250) may be fitted with the drain gasket (260) to the extent the gasket (220) is not already pre-installed, factory-assembled, or overmolded to be disposed on a flange of the elbow (250). Next, the elbow (250) may be positioned adjacent the drain port (101*b*) and secured thereto by threading the drain spud (270) into the interior threaded portion of the drain elbow (250). This securing step will likewise cause the drain gasket (260) to be compressed against the outer wall (101*c*) of the bathtub (101) so as to create a leak proof seal between the elbow (250) and the bathtub (101). Also, as with the system (100) described above, and although not specifically illustrated with regard to the system (200), the plumber or user may also apply plumber's putty, silicone, or some other sealant on a bottom portion of the flange (272) of the drain spud (270) to seal the same at the drain port (101*b*). This compression (like that for the overflow portion (201)) in combination with application of a sealant, will ensure a liquid-proof seal of the drain portion (202). In some situations, the elbow (250) may (as a preliminary step) be secured to an extension pipe (4) that is in fluid communication with the main drain system before securing the elbow to the drain port (101*b*) of the bathtub (101). In other situations, the elbow (250) may be secured to the extension pipe after having been secured to the overflow port (101*b*) by the drain spud (270).

The drain test plug (280) and drain spud (270) may be aligned along their respective central axes ($A_{280}$, $A_{270}$) and the drain test plug (280) may be lowered into the drain spud (270), such that the projections (286) of drain test plug (280) are radially disposed in between the projections (276) of the drain spud (270) (corresponding to non-projection portions of the inner surface (274)) until the projections (276) abut the upper rail (281*d*).

After the drain test plug (280) has been inserted into the drain spud (270) as set forth above, the drain test plug (280) may be rotated to guide the projections (276) of the spud (270) into the horizontal channels (286*b*) such that the projections (276) of the spud (270) are retained therein. Thus, and in substantially this manner, the projections (286) of the drain test plug (280) may engage with the complementary projections (276) of the drain spud (270) to releasably secure the drain test plug (280) to the drain spud (70). In this manner, the gasket (287) of the lower surface (283*b*) of the widened portion (283) is compressed onto an upper surface of the flange member (272) of the drain spud (270) to thereby form a leak proof seal between the drain test plug (280) and the drain spud (270) (see FIG. 11G).

Once the drain test plug (280) is so secured (and once the overflow test plug (240) is also secured, as set forth in the detailed method below), the plumber can run a pressure test on the system (200) using conventional means (e.g., by pressurizing the system), and during such test, the test plug (280) will block any backflow of water traveling in a direction substantially opposite to the fluid flow direction ($FF_2$) (defined with respect to the system (100) but incorporated herein by reference) at the drain portion (202) until the conclusion of the test and the pressure in the main drain system is reduced.

At the conclusion of the test, the drain test plug (280) may be disengaged from the drain spud (270) in substantially the opposite manner as set forth above for the quarter-turn installation. Subsequent to such removal, the plumber or other user may continue with the general installation method as outlined in the more detailed installation method of this disclosure.

It should be further understood that slight departures from the method above, possibly due to variances made to the structure of the projections (276/286) are, of course, contemplated and considered to be within the scope of this disclosure. Similarly, the steps are not required to be performed in precisely the order as presented above, and may also be combined with one another by the plumber or user in the field to save time and effort as may be required or deemed necessary under the circumstances of the test. These variations in the method are specifically and expressly contemplated and also considered to be within the scope of this disclosure.

The overflow portion (201) is shown in an exploded, detailed view in FIG. 11C. As shown, the overflow portion (201) generally includes an overflow elbow (210), an overflow gasket (220), and an overflow nut (230). The overflow test plug (240) is operable with the overflow portion (201) to perform pressure related testing. The overflow elbow (210), overflow gasket (220), and overflow nut (230) are structurally identical to the overflow elbow (10), overflow gasket (20), and overflow nut (30) of the system (100), and so those portions of description relating to the components in system (100) are hereby incorporated by reference for system (200). Although a method of performing a pressure test using the overflow portion (201) of the system (200) will be provided in greater detail below, it is sufficient to note that the retaining nut (230), like the retaining nut (30) will thread onto an externally threaded neck portion (213) of the overflow elbow (210), and furthermore that the overflow elbow (210), also like the elbow (10), on an interior of the neck portion (213) may include a plurality of overflow locking features (217), which as illustrated in FIGS. 11B-11C may comprise two projections (218) each having a thickness ($T_3$) measured with respect to an inner wall of the neck (213). The locking features (217) are sized and configured to permit engagement/attachment of the overflow test plug (240) by mating a complementary receiver feature of the overflow test plug (240) with the locking features (217), such as the projections (218), of the overflow elbow (210). As described in further detail below, and with regard to the specific overflow testing method, the overflow test plug (240) may mate directly with the projections (218) on the interior portion of the neck (213) of the overflow elbow (210) so as to seal the overflow elbow (210), and thereby the overflow port (101*a*), so as to effectuate a proper pressure test of the overflow portion (201).

Figure 13C:
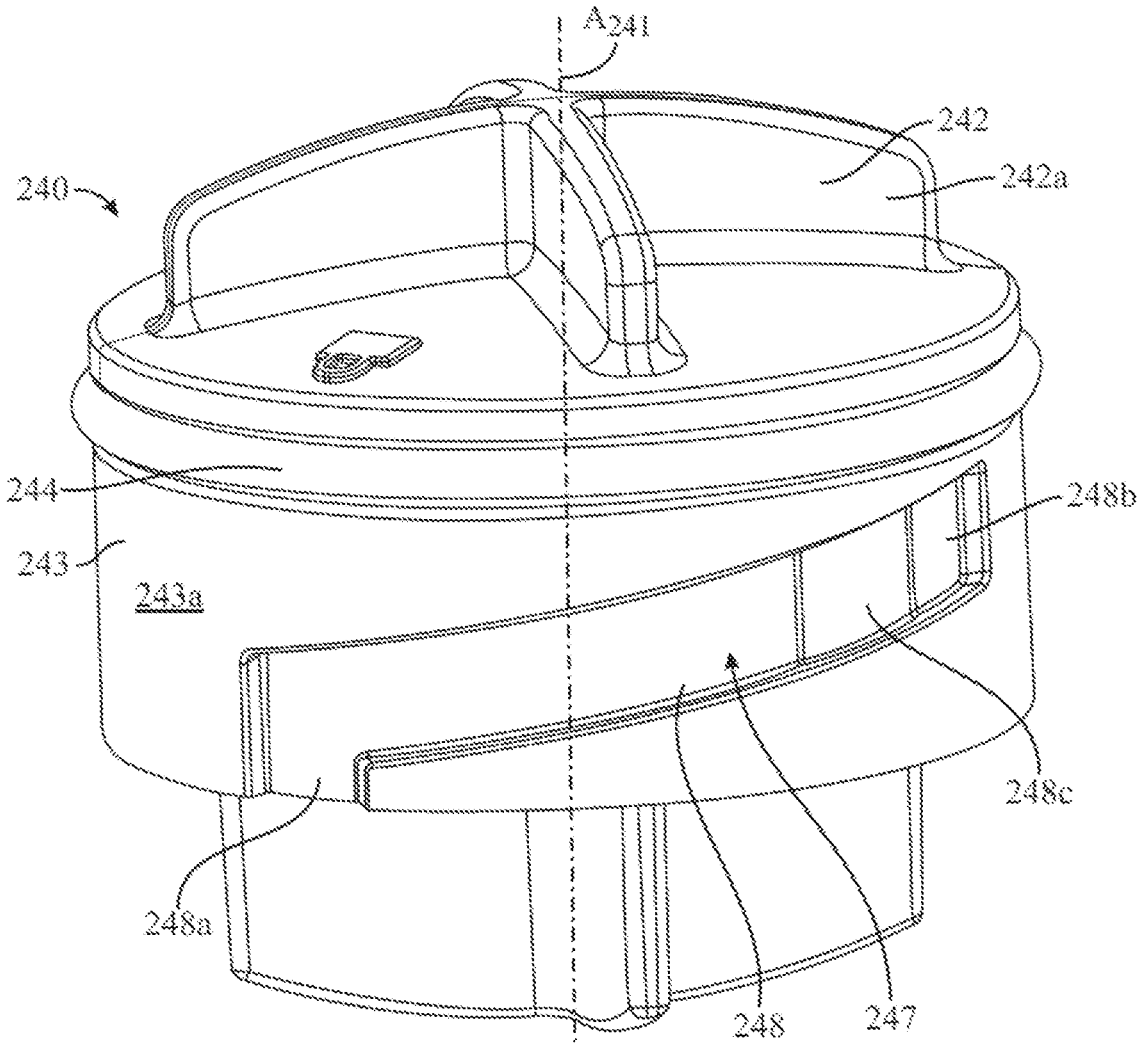
FIG. 13C is a perspective view of the overflow test plug illustrated in FIGS. 13A-13B.

As illustrated in FIGS. 13A-13C, the overflow test plug (240) comprises a generally circular body that extends from a first end (241*a*) to a second end (241*b*) along a central faceplate axis ($A_{240}$). The first end (241*a*) generally includes an operable handle (242) similar to the operable handle (282) previously described with respect to the drain test plug (280). The operable handle (242) of the overflow test plug similarly may be capable of being grasped by a user's hand (or by a tool) in order to manipulate, rotate, translate, or otherwise affect the position of the overflow test plug (240). As illustrated, the operable handle (242) may comprise a cross-shaped handle (242*a*), but one of skill in the art will appreciate that the handle (242) may alternatively comprise any shape that will maintain a high level of operability. The handle (242) may extend downwardly from the first end (241*a*) and terminate in a widened portion (243) of the drain test plug (240). The widened portion (243) may have a diameter ($D_{243}$) as measured with respect to the central axis ($A_{240}$), and the widened portion (243) may extend downwardly toward the second end (241*b*) of the overflow test plug (240), as shown in FIG. 13A. A side wall (243*a*) of the widened portion (243) may have a circumferential recess about the central axis ($A_{240}$) within which a sealing gasket or sealing element (244), such as O-Ring, may be fitted and secured. When the overflow test plug (240) is secured in the overflow elbow (210), and thus to the drain portion (201), as detailed in the testing method below, the sealing gasket (244) will be compressed against an interior surface of an inner wall of the neck portion (213) to thereby form a leak proof seal therebetween. In an alternative aspect, when the overflow test plug (240) is secured in the overflow elbow (10'), the sealing gasket (244) forms a fluid tight seal with the chamfered overflow edge 19'. The second end (241*b*) generally includes the cross-shaped tool element (249), and as introduced above, the tool element (249) may be used to engage the tool-engagement channels (88) of the drain trim (80) so as to quickly install or remove the drain trim (80) from the drain assembly (2).

As illustrated in FIG. 13C, the side wall (243*a*) may include locking feature receivers (247) that are configured to complementarily mate with the locking features (217) of the overflow elbow (210) described above. In the illustrated embodiment, the locking feature receivers (247) may be configured as two bayonet-style channels (248) that are disposed within the side wall (243*a*), where the channels (248) extend helically about the side wall (243*a*) from an open portion (248*a*) adjacent the second end (241*b*) to a terminal portion (248*b*) adjacent the first end (241*a*). The channels (248) may define a depth ($T_4$) with respect to the side wall (243*a*), where the depth ($T_4$) is substantially equal to the thickness ($T_3$) of the projections (218) of the overflow elbow (210), although slight differences therebetween are contemplated within the scope of this disclosure. As illustrated in the embodiments of FIGS. 13A-13C may include a raised ridge (248*c*) therein (although it is contemplated that, like the overflow faceplate (40) of the system (100), the channels (248) may also include multiple ridges (248*c*). Referring specifically to the illustrated embodiment, the ridge (248*c*) subdivides or segments the channels (248) into two sub-channels (248*d*). Advantageously, and as will be described in greater detail below with respect to the installation method, the aforementioned configuration of the channels (248) permit secured, locking attachment of the overflow test plug (240) to the overflow elbow (210). More particularly, the bayonet-style channels (248) allow the overflow test plug (240) to be both tightened and secured to the overflow elbow (210).

A method of testing the system (200) may include the following steps.

First and with regard to the overflow portion (201): the neck portion (213) of the overflow elbow (210) may be fitted with the overflow gasket (240) and subsequently inserted through the overflow port (101*a*) of the bathtub (101) such that the gasket abuts the outer wall (101*c*) of the bathtub (101). Next, the retention nut (230) may be threaded onto the threaded portion of the neck (213) from the inside of the bathtub (101) so as to secure the elbow (210) to the overflow port (101*a*) and so as to compress the overflow gasket (220) to the outer wall (101*c*) of the bathtub (101) so as to create a leak proof seal between the elbow (210) and the bathtub (101). In some situations, the elbow (210) may (as a preliminary step) be secured to an extension pipe (4) that is in fluid communication with the main drain system. In other situations, the elbow (210) may be secured to the extension pipe (4) after the elbow (210) has been secured to the overflow port (101*a*) of the bathtub (101). Subsequently, the central axis ($A_{280}$) of the overflow test plug (280) should be aligned with an axis ($A_{213}$) of the neck portion (213) of the overflow elbow (210).

Upon such alignment, the overflow test plug (240) should be inserted into the interior of the neck portion (213) such that the projections (218) (or other suitable locking feature (217) known in the art and incorporated in the elbow (210)) on the interior of the neck portion (213) are received within the open portion (248*a*) of the channel (248) of the overflow test plug (240). After the projections (218) are received therein, the overflow test plug (240) may be rotated about its central axis ($A_{240}$) so as to guide the projections (218) through the channels (248) and toward the terminal portion (248*b*). The rotating step may be performed with by the user with his/her hands by manipulating the operable handle (242), or alternatively it may be performed by using a plumbing tool or other conventional tool known in the art. The rotating step may continue such that the projections (218) approach and surpass the ridges (248*c*) within the channels (248) on their journey toward the terminal portions (248*b*) of the channels. The rotating step may be discontinued either when: A) the projections (218) are disposed in the terminal portions (248*b*) of the channels (248) and the O-Ring 244 is compressed against the inner wall of the neck portion (213) of the overflow elbow (210) so as to create a leak proof seal therebetween, or B) the projections (218) have not yet passed into the terminal portions (248*b*) of the channels (248) (potentially because the test plug (240) cannot be rotated further due to the potential thickness of the bathtub (101), or for some other reason) but the O-Ring 244 is sufficiently compressed against the inner wall of the neck portion (213) of the overflow elbow (210) so as to create a leak proof seal therebetween.

As regards the drain portion (202), a plumber or user may install the drain portion (202) of the system by performing the following steps:

The drain elbow (250) may be fitted with the drain gasket (260) to the extent the gasket (260) is not already pre-installed, factory-assembled, or overmolded to be disposed on the flange (251) of the drain elbow (250). Next, the drain elbow (250) may be positioned adjacent the drain port (101*b*) at the exterior of the bathtub (101) and secured thereto by threading the drain spud (270) into the interior threaded portion (252) of the drain elbow (250) from the interior of the bathtub (101). In this respect, the drain spud (270) may be inserted along the insertion direction into the drain elbow (250). This securing step will likewise cause the drain gasket (260) to be compressed against the outer wall (101*c*) of the bathtub (101) so as to create a leak proof seal between the elbow (250) and the bathtub (101). Although not specifically illustrated, and as introduced in the description above, the plumber or user may also apply plumber's putty, silicone, or some other sealant on a bottom portion of the flange (272) of the drain spud (270) so as to seal the same at the drain port (101*b*). This compression (like that for the overflow portion (201)) in combination with application of a sealant to the flange (272) in this fashion, will ensure a desirable leak-proof seal. In some situations, the elbow (250) may (as a preliminary step) be secured to an extension pipe (4) that is in fluid communication with the main drain system before securing the elbow (250) to the drain port (101*b*) of the bathtub (101). In other situations, the elbow (250) may be secured to the extension pipe (4) after having been secured to the overflow port (101*b*) by the drain spud (270).

Next, the drain test plug (280) and drain spud (270) may be aligned along their respective central axes ($A_{280}$, $A_{270}$) and the drain trim (280) may be lowered and inserted into the drain spud (270) substantially along the insertion direction, such that the projections (286) of the drain test plug (280) are radially disposed in between the projections (276) of the drain spud (270) (corresponding to non-projection portions of the inner surface (274)) until the projections (276) abut the upper rail (281*d*). After the drain test plug (280) has been inserted into the drain spud (270) as set forth above, the drain test plug (280) may be rotated about its central axis ($A_{280}$) to guide the horizontal channels (286*b*) along a circumference of the spud (270) to receive the projections (276) of the spud (270) and to retain the projections (276) therein. This rotation will cause the gasket (287) of the lower surface (283*b*) of the widened portion (283) to be compressed along the insertion direction (as illustrated, downwardly) onto an upper surface of the flange member (272) of the drain spud (270) to thereby form a leak proof seal between the drain test plug (280) and the drain spud (270).

With both the overflow test plug (240) and the drain test plug (280) installed in substantially the manner set forth above, the plumber or user can run a pressure test on the system (200) using conventional means (e.g., by pressurizing the system (200)). During such test, the overflow test plug (240) will block any backflow of water traveling in a direction substantially opposite to the first fluid flow direction ($FF_1$) (defined with respect to the system (100) but incorporated herein by reference) and the drain test plug (280) will block any backflow of water traveling in a direction substantially opposite to the second fluid flow direction ($FF_2$) (also as defined with respect to the system (100) and incorporated herein by reference). At the conclusion of the test, the pressure may be normalized in the main drain system and thereby reduced from its elevated test state. At the conclusion of the test, the overflow test plug (240) may be disengaged from overflow elbow (210) and the drain test plug (280) may be disengaged from the drain spud (270), each in substantially the opposite manner than as set forth above for their respective quarter-turn, rotation-induced installation. Subsequent to such removal, the plumber or user may continue with the general installation method as outlined in the more detailed installation method of this disclosure.

It should be further understood that slight departures from the method above, possibly due to variances made to the structure of the projections (218, 276) or the structure of the channels (248, 286*b*) are, of course, contemplated and considered to be within the scope of this disclosure. Similarly, the steps are not required to be performed in precisely the order as presented above, and may also be combined with one another by the plumber or user in the field to save time and effort as may be required or deemed necessary under the circumstances of the test. As but one example, the overflow test plug (240) may be installed prior to, or subsequent to the installation of the drain test plug (280). Alternatively, the overflow test plug (240) and the drain test plug (280) may be installed simultaneously, such as if more than one plumber or user is performing the installation. These and all similar variations in the method are specifically and expressly contemplated and also considered to be within the scope of this disclosure.

What is claimed is:

1. A testing system for performing a pressure test on a bath waste and overflow system that is attached to a bathtub, the testing system comprising:

an overflow elbow associated with an overflow port of the bathtub;

a drain elbow associated with a drain port of the bathtub;

a drain spud insertable into the drain elbow;

an overflow test plug insertable into the overflow elbow, the overflow test plug having a first overflow locking feature that is connectable to a second overflow locking feature of the overflow elbow so as to form a fluid tight seal between an overflow sealing element of the overflow test plug and the overflow elbow; and a drain test plug insertable into the drain spud, the drain test plug having a first drain locking feature that is connectable to a second drain locking feature of the drain spud so as to form a fluid tight seal between a drain sealing element of the drain test plug and the drain spud.

2. The testing system of claim 1, wherein the first overflow locking feature comprises at least one helical track, and wherein the second overflow locking feature comprises a projection element configured to be received within the at least one helical track such that rotation of the projection element within the at least one helical track forms the fluid tight seal between the sealing element and the overflow test plug.

3. The testing system of claim 1, wherein the first drain locking feature comprises a channel, and wherein the second drain locking feature comprises a projection element, wherein the channel is configured to rotatably receive the projection element so as to form the fluid tight seal between the sealing feature of the drain test plug and the drain spud.

4. The testing system of claim 3, wherein the channel comprises a helical channel.

5. The testing system of claim 1, wherein the fluid tight seal between the overflow test plug and the overflow elbow is between the overflow sealing element and an overflow edge of the overflow elbow, the overflow edge defining an opening into the overflow elbow, and wherein the overflow edge is chamfered.

6. The testing system of claim 1, wherein the fluid tight seal between the overflow test plug and the overflow elbow is between the overflow sealing element and an interior surface of the overflow elbow.

7. The testing system of claim 1, wherein the fluid tight seal between the drain test plug and the drain spud is between the drain sealing element and a drain edge of the drain spud, the drain edge defining an opening into the drain spud, and wherein the drain edge is chamfered.

8. The testing system of claim 1, wherein the fluid tight seal between the drain test plug and the drain spud is between the drain sealing element and a top surface of the drain spud.

9. The testing system of claim 2, wherein the overflow test plug extends from a first end to a second end opposite the first end, and the overflow test plug defines a circumferential sidewall therebetween that carries the overflow sealing element, wherein the at least one helical track is disposed in the sidewall and extends circumferentially about the sidewall from the first end toward the second end.

10. The testing system of claim 1, wherein the overflow test plug includes a tool element that is engageable with a drain trim that is operably associated with the drain spud.

11. The testing system of claim 7, wherein the drain sealing element of the drain test plug comprises a gasket.

12. The testing system of claim 3, wherein the projection element of the drain spud includes two projections and the channel of the drain test plug includes two channels, each of the two channels being separately configured to receive one of the two projections of the drain spud so as to detachably and sealingly connect the drain test plug to the drain spud.

13. A method of installing a bath waste and overflow system to a bathtub, the method comprising the steps of:

inserting a neck of an overflow elbow through an overflow port of the bathtub from an exterior of the bathtub, the neck of the overflow elbow including a threaded portion;

tightening a retention nut onto the threaded portion of the neck from an interior of the bathtub opposite the exterior of the bathtub so as to create a leak-proof seal between the bathtub and the overflow elbow;

introducing an overflow faceplate over the retention nut, wherein the overflow faceplate includes a partition wall and an edge wall that form a hollow portion therebetween, wherein a first locking feature on an interior portion of the neck of the overflow elbow engages a second locking feature on the exterior portion of the partition wall; and rotating the overflow faceplate to cause the first locking feature relative to the second locking feature to reduce a distance between the overflow faceplate and the overflow elbow.

14. The method of claim 13, further comprising the step of discontinuing the rotating step when an abutment edge of the overflow faceplate abuts an inner wall of the bathtub adjacent the overflow port.

15. The method of claim 13, further comprising the step of fitting the neck of the overflow elbow with an overflow gasket thereabout, wherein the fitting step is performed before the inserting step.

16. The method of claim 13, further comprising the step of securing the overflow elbow to a main drain system.

17. The method of claim 13, further comprising the steps of:

positioning a drain elbow adjacent a drain port in the bathtub from the exterior;

attaching a drain spud to the drain elbow from the interior of the bathtub and through the drain port;

locking a drain trim into the drain spud by 1) engaging a locking feature in an interior of the drain spud with a receiving channel on an exterior of the drain trim, and 2) rotating the drain trim relative to the drain spud; and engaging a drain stopper with the drain trim, the drain stopper configured to be actuated between 1) a closed configuration, in which the drain stopper creates a leak-proof seal with the drain trim to prevent fluid drainage from the bathtub, and 2) an open configuration, in which the drain stopper is unsealed from the drain trim and fluid may drain from the bathtub through the drain trim along a fluid flow direction.

18. The method of claim 17, further comprising the step of fitting a drain gasket about a flange of the drain elbow, wherein fitting the drain gasket is performed before the attaching step.

19. The method of claim 18, further comprising the step of securing the drain elbow to the main drain system.

20. A method of performing a pressure test on a bath waste and overflow system that is attached to a bathtub, the method comprising the steps of:

securing a drain spud to a drain elbow through a drain port of the bathtub;

mounting a drain test plug to the drain spud extending through the drain port of the bathtub by aligning a projection of the drain spud with a complementary channel of the drain test plug;

turning the drain test plug relative to the drain spud to cause the projection of the drain spud to reside within the complementary channel and causing a sealing element of the drain test plug to bear against an upper surface of the drain spud, forming a leak-proof seal therebetween; and increasing a pressure within the drain elbow to test the system.

21. The method of claim 20, further comprising: securing an overflow test plug to an overflow elbow extending through an overflow port of the bathtub by engaging a channel of the overflow test plug with a locking feature on an interior portion of the overflow elbow; and rotating the overflow test plug relative to the overflow elbow to cause the locking feature to ride along the channel and force a sealing feature of the overflow test plug against the interior portion of the overflow elbow, forming a leak-proof seal therebetween.

22. The method of claim 21, further comprising the step of removing both the overflow test plug and the drain test plug.

23. The method of claim 21, further comprising the step of sealing the overflow port with an overflow gasket prior to installing the overflow test plug.

24. The method of claim 21, further comprising the step of sealing the drain port with a drain gasket prior to installing the drain test plug.

* * * * *